US007588871B2

(12) United States Patent
Kihara et al.

(10) Patent No.: US 7,588,871 B2
(45) **Date of Patent: *Sep. 15, 2009**

(54) ELECTROPHOTOGRAPHIC PHOTORECEPTOR AND IMAGE FORMING APPARATUS PROVIDED WITH THE SAME

(75) Inventors: Akiko Kihara, Nara (JP); Kotaro Fukushima, Kawanishi (JP); Takatsugu Obata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 444 days.

This patent is subject to a terminal disclaimer.

(21) Appl. No.: 10/575,097

(22) PCT Filed: Oct. 8, 2004

(86) PCT No.: PCT/JP2004/014967

§ 371 (c)(1),
(2), (4) Date: Apr. 10, 2006

(87) PCT Pub. No.: WO2005/036275

PCT Pub. Date: Apr. 21, 2005

(65) Prior Publication Data

US 2007/0077506 A1 Apr. 5, 2007

(30) Foreign Application Priority Data

Oct. 8, 2003 (JP) ..... 2003-349644

(51) Int. Cl.
*G03G 5/06* (2006.01)

(52) U.S. Cl. ..... 430/58.85; 430/56; 430/72; 430/73; 430/59.6

(58) Field of Classification Search ..... 430/58.5, 430/59.6, 72, 73

See application file for complete search history.

(56) References Cited

U.S. PATENT DOCUMENTS 3,824,099 A 7/1974 Champ et al.

(Continued)

FOREIGN PATENT DOCUMENTS

JP 52-4188 2/1977

(Continued)

OTHER PUBLICATIONS

Machine generated translatino of JP 06-043674, Feb. 1994.*

(Continued)

*Primary Examiner*—Mark F Huff
*Assistant Examiner*—Peter L Vajda
(74) *Attorney, Agent, or Firm*—Nixon & Vanderhye P.C.

(57) ABSTRACT

An electrophotographic photoreceptor having excellent electric characteristics such as sensitivity characteristic and light responsiveness with an excellent life duration of abrasion resistance so that no flaw and density unevenness are generated on to-be-formed images for a long period of time, is provided. In an electrophotographic photoreceptor (1), an enamine compound represented by the following general formula (1), for example, an enamine compound represented by the following structural formula (1-1) is contained in a charge transporting layer (6), and a creep value ($C_{IT}$) in a case where a maximum indentation load of 30 mN is put on a surface for 5 seconds under circumstances of temperature of 25° C. and relative humidity of 50%, is set to 2.70% or more and 5.00% or less, and a plastic deformation hardness value (Hplast) of the surface is set to 220 N/mm$^2$ or more and 275 N/mm$^2$ or less.

(1)

7 Claims, 16 Drawing Sheets

U.S. PATENT DOCUMENTS

| | | | | |
|---|---|---|---|---|
| 4,123,269 | A | 10/1978 | Von Hoene et al. | |
| 4,150,987 | A | 4/1979 | Anderson et al. | |
| 4,278,747 | A | 7/1981 | Murayama et al. | |
| 4,338,388 | A | 7/1982 | Sakai et al. | |
| 4,367,273 | A | 1/1983 | Murayama et al. | |
| 4,859,556 | A | 8/1989 | Sasaki | |
| 2002/0119382 | A1* | 8/2002 | Nakata et al. | 430/66 |
| 2003/0021612 | A1 | 1/2003 | Morikawa et al. | |
| 2004/0101770 | A1* | 5/2004 | Obata et al. | 430/58.85 |
| 2006/0029874 | A1* | 2/2006 | Kanazawa et al. | 430/72 |
| 2007/0103749 | A1* | 5/2007 | Shahar | 359/18 |

FOREIGN PATENT DOCUMENTS

| | | | | |
|---|---|---|---|---|
| JP | 54-150128 | A | | 11/1979 |
| JP | 54-151955 | A | | 11/1979 |
| JP | 55-052063 | A | | 4/1980 |
| JP | 55-42380 | B2 | | 10/1980 |
| JP | 58-32372 | B2 | | 7/1983 |
| JP | 58-198043 | A | | 11/1983 |
| JP | 2-51162 | A | | 2/1990 |
| JP | 2-190862 | A | | 7/1990 |
| JP | 06-043674 | | * | 2/1994 |
| JP | 6-43674 | | | 2/1994 |
| JP | 6-43674 | A | | 2/1994 |
| JP | 06-059471 | | * | 3/1994 |
| JP | 7-48324 | A | | 2/1995 |
| JP | 7-134430 | | | 5/1995 |
| JP | 7-134430 | A | | 5/1995 |
| JP | 10-69107 | | | 3/1998 |
| JP | 10-69107 | A | | 3/1998 |
| JP | 2000-10320 | | | 1/2000 |
| JP | 2000-10320 | A | | 1/2000 |
| JP | 2001-125298 | | | 5/2001 |
| JP | 2001-125298 | A | | 5/2001 |
| JP | 2002-82465 | | | 3/2002 |
| JP | 2002-82465 | A | | 3/2002 |
| JP | 2002-365820 | | * | 12/2002 |
| JP | 2002-365820 | A | | 12/2002 |
| JP | 2003-5408 | | | 1/2003 |
| JP | 2003-5408 | A | | 1/2003 |
| JP | 2003-012619 | | * | 1/2003 |
| JP | 2003-76050 | | | 3/2003 |
| JP | 2003-76050 | A | | 3/2003 |
| JP | 2004-4266 | A | | 1/2004 |
| JP | 2004-151666 | A | | 5/2004 |

OTHER PUBLICATIONS

Machine generated translation of JP 2002-365820, Dec. 2002.*
Machine generated translationo f JP 2003-012619, Jan. 2003.*
Diamond, Handbook of Imaging Materials, Marcell Dekker, NY, NY, 1991. p. 160-62.*
English translation of JP 06-059471 published Mar. 1994.*
English translation of the Int'l. Preliminary Report on Patentability mailed Jun. 29, 2006 in corresponding PCT application PCT/JP2004/014967.

* cited by examiner

ELECTROPHOTOGRAPHIC PHOTORECEPTOR AND IMAGE FORMING APPARATUS PROVIDED WITH THE SAME

This application is the U.S. national phase of international application PCT/JP2004/014967 filed 8 Oct. 2004, which designated the U.S. and claims benefit of JP 2003-349644 filed 8 Oct. 2003, the entire contents of each of which are hereby incorporated by reference.

TECHNICAL FIELD

The present invention relates to an electrophotographic photoreceptor used for electrophotographic image formation and an image forming apparatus provided with the same.

BACKGROUND ART

In an electrophotographic image forming apparatus (hereinafter also referred to as an electrophotographic apparatus) used, for example, as a copying machine, a printer, or a facsimile apparatus, an image is formed by way of the following electrophotographic process. At first, a surface of an electrophotographic photoreceptor (hereinafter also referred to simply as a photoreceptor) provided in the apparatus is charged uniformly to a predetermined potential by a charger, and exposed to light in accordance with image information by exposure means so that an electrostatic latent images are formed. The formed electrostatic latent image is developed by use of a developer containing a toner supplied from development means so that a toner image which is a visible image is formed. The formed toner image is transferred by transferring means from the surface of the photoreceptor onto a transfer member, for example, recording paper, and fixed thereto by fixing means. Furthermore, the surface of the photoreceptor onto which the toner image has been transferred is cleaned by cleaning means to remove a toner remained on the photoreceptor surface without being transferred on to the transfer member, and foreign objects such as paper powder of the recording paper which are deposited during transfer and remained on the photoreceptor surface. After this, the surface of the photoreceptor is charge-eliminated by a charge eliminator so that the electrostatic latent image on the photoreceptor surface is eliminated.

An electrophotographic photoreceptor used in such an electrophotographic process is constituted by laminating a photosensitive layer containing a photoconductive material on an conductive substrate. Conventionally, as the electrophotographic photoreceptor, an electrophotographic photoreceptor using an inorganic photoconductive material (hereinafter referred to as an inorganic photoreceptor) has been used. Typical inorganic photoreceptor includes a selenium-series photoreceptor using a layer comprising an amorphous selenium (a-Se) or an amorphous selenium arsenide (a-AsSe) as a photosensitive layer, a zinc oxide-series or cadmium sulfide-series photoreceptor using zinc oxide (chemical formula: ZnO) or cadmium sulfide (chemical formula: CdS) together with a sensitizer such as a dye being dispersed in a resin as the photosensitive layer, and an amorphous silicon-series photoreceptor (hereinafter referred to as a-Si photoreceptor) using a layer comprising amorphous silicone (a-Si) as a photosensitive layer.

However, the inorganic photoreceptor has the following drawbacks. The selenium-series photoreceptor and the cadmium sulfide-series photoreceptor have drawbacks in view of the heat resistance and the store stability. Further, since selenium and cadmium have toxicity to human bodies and environments, the photoreceptors using them have to be recovered and discarded properly after use. Further, the zinc oxide photoreceptor has a drawback that it has low sensitivity and low durability and is scarcely used at present. Further, the a-Si photoreceptor attracting attention as the inorganic photoreceptor with no public pollution has advantages such as high sensitive and high durability but since this is manufactured by using a plasma chemical vapor deposition method, the a-Si photoreceptor has such drawbacks that it is difficult to uniformly deposit the film of the photosensitive layer and that image defects are easily caused. Further, the a-Si photoreceptor also has a drawback of low productivity and high manufacturing cost.

In recent years, development has progressed for the photoconductive material used for the electrophotographic photoreceptor, and organic photoconductive materials (that is, Organic Photoconductor: abbreviated as: OPC) have been now used frequently instead of the inorganic photoconductive materials used so far. While the electrophotographic photoreceptor using the organic photoconductive material (hereinafter referred to as organic photoreceptor) involves some problems in view of the sensitivity, durability and stability to environment, it has various advantages compared with the inorganic photoreceptor in view of the toxicity, the production cost and the degree of freedom for the material design. Further, the organic photoreceptor also has an advantage that the photosensitive layer can be formed by an easy and inexpensive method typically represented by a dip coating method. Since the organic photoreceptor has such various advantages, it has now gradually been predominant in the electrophotographic photoreceptors. In response to demands of recent years for significant improvement of the sensitivity and durability, the organic photoreceptor has been increasingly used at present as the electrophotographic photoreceptor except for special cases.

Especially, the efficiency of organic photoreceptor is being significantly developed by the development of a function-separated electrophotographic photoreceptor of which charge generating function and charge transporting function are separately attained by different substances. In addition to the above-mentioned advantages of the organic photoreceptor, such a function-separated photoreceptor has an advantage that a latitude in selecting materials respectively for charge generating substance bearing the charge generating function and for charge transporting substance bearing the charge transporting function is broad and thus, a photoreceptor having any desired characteristics can be relatively readily produced.

The function-separated photoreceptor includes a lamination type and a single layer type. The function-separated photoreceptor of lamination type is provided with a photosensitive layer of lamination type constituted by lamination of a charge generating layer containing a charge generating substance and a charge transporting layer containing a charge transporting substance. The charge generating layer and the charge transporting layer are generally formed such that the charge generating substance and the charge transporting substance are respectively dispersed in binder resins which are the binding agent. Further, the function-separated photoreceptor of single layer type is provided with a photosensitive layer of single layer type formed by dispersing the charge generating substance and the charge transporting substance together in a binder resin.

A variety of substances has been heretofore investigated for the charge generating substances that may be used in the function-separated photoreceptor, including, for example, phthalocyanine pigments, squarylium-series dyes, azo pigments, perylene pigments, polycyclic quinone pigments, cyanine dyes, squaric acid dyes and pyrylium salt-series dyes, and various materials of good light fastness and good charge generating ability have been proposed.

On the other hand, various compounds are known for the charge transporting substances, including, for example, a pyrazoline compound (e.g., refer to Japanese Examined Patent Publication JP-B2 52-4188 (1977)), a hydrazone compound (e.g., refer to Japanese Unexamined Patent Publication JP-A 54-150128 (1979), Japanese Examined Patent Publication JP-B2 55-42380 (1980), and Japanese Unexamined Patent Publication JP-A 55-52063 (1980)), a triphenylamine compound (e.g., refer to Japanese Examined Patent Publication JP-B2 58-32372 (1983). and Japanese Unexamined Patent Publication JP-A 2-190862 (1990)) and a stilbene compound (e.g., refer to Japanese Unexamined Patent Publications JP-A 54-151955 (1979) and JP-A 58-198043 (1983)). Recently, pyrene derivatives, naphthalene derivatives and terphenyl derivatives that have a condensed polycyclic hydrocarbon structure as the center nucleus have been developed (e.g., refer to Japanese Unexamined Patent Publication JP-A 7-48324 (1995))

The charge transporting substance is required to be:

(1) stable to light and heat;

(2) stable to active substances such as ozone, nitrogen oxides (chemical formula: NOx) and nitric acid that may be generated in corona discharging on charging the photoreceptor surface;

(3) having good charge transporting ability;

(4) highly compatible with organic solvents and binder resins;

(5) easy to produce and inexpensive. However, the above-mentioned charge transporting substance does not satisfy all of these requirements at high level though partly satisfying some of these requirements.

Further, in recent years, electrophotographic apparatuses such as a digital copying machine and a printer have reduced size and increased operation speed, and higher sensitivity corresponding to the size reduction and operation speed increase has been demanded for the photoreceptor characteristic, and a particularly high charge transporting ability is demanded for the charge transporting substance. Further, in a high speed electrophotographic process, since the time from the exposure to the development is short, it has been demanded for a photoreceptor of excellent light responsiveness. In a case where the light responsiveness is low, that is, the decaying speed for the surface potential after exposure is slow, the residual potential increases and the photoreceptor is used repetitively in a state where the surface potential of the photoreceptor is not decayed sufficiently. Consequently, the surface charges at a portion to be eliminated are not eliminated sufficiently by exposure, in a consequence whereof negative results such as lowering of the image quality in the early stage are caused. Since the light responsiveness depends on the charge transporting ability of the charge transporting substance, in terms thereof, the charge transporting substance having higher charge transporting ability is demanded.

For the charge transporting substance that satisfies such requirements, proposed is an enamine compound having higher charge transporting ability than that of the above-mentioned charge transporting substance (e.g., refer to Japanese Unexamined Patent Publications JP-A 2-51162 (1990), JP-A 6-43674 (1994) and JP-A 10-69107 (1998)). Further, in another conventional art, in order to improve hole transporting ability of the photoreceptor, incorporation of polysilane and an enamine compound having a specified structure to a photosensitive layer is proposed ( e.g., refer to Japanese Unexamined Patent Publication JP-A 7-134430 (1995)).

Further, in the electrophotographic apparatus, since the above-mentioned operations of charging, exposure, development, transfer, cleaning, and charge elimination to the photoreceptor are conducted repetitively, the photoreceptor is required to be excellent in the durability to electrical and mechanical external forces in addition to high sensitivity and excellent light responsiveness. Specifically, it has been demanded that abrasion and flaw are not caused by friction with a cleaning member or the like to the surface layer of the photoreceptor and it is not degraded by deposition of active substance such as ozone and $NO_x$ generated upon electric discharge during the charged state.

One of indicators for evaluation of properties of materials, which are not limited to properties of the photoreceptor surface but properties at large, particularly for evaluation of mechanical property, is hardness. The hardness is defined as a stress brought from materials against indentation of an indenter. By use of this hardness in a physical parameter for learning properties of materials, an attempt is given to quantification of mechanical properties of such a film that constitutes the photoreceptor surface. As testing methods of measuring the hardness, for example, the scratch strength test, the pencil hardness test, and the Vickers hardness test are widely known.

However, all of these hardness tests have a problem in measuring the mechanical properties of the material which shows a complicated behavior combining plasticity, elasticity (including a delay component), and a creeping property as in the case of a film which is composed of organics. For example, the Vickers hardness indicates hardness evaluated by measuring a length of indentation produced on a film, but this reflects only plasticity of the film and thus, it is not possible to correctly evaluate mechanical properties of materials such as organics of which deformation mode has a high tendency of elastic deformation as well. Accordingly, the mechanical properties of the film composed of organics have to be evaluated in consideration of various properties.

In one conventional art in which properties of a surface layer of an electrophotographic photoreceptor having an organic photosensitive layer are evaluated, application of a universal hardness value (Hu) through a universal hardness test as defined in DIN50359-1 and a plastic deformation ratio (elasticity deformation ratio) is proposed ( e.g., refer to Japanese Unexamined Patent Publication JP-A 2000-10320).

An art described in JP-A 2000-10320 discloses that limitation of the universal hardness value (Hu) and the plastic deformation ratio to fall within a specific range makes mechanical deterioration of a photoreceptor surface layer less easily occur. However, the limited range of elasticity disclosed in JP-A 2000-10320 includes on a present condition substantially all of the photoreceptors having the charge transporting layer in which commonly used polymer binder is used and thus, there is a problem that a preferable range is not substantially limited.

Further, in the art described in JP-A 2000-10320, Hu and the plastic deformation ratio of the charge transporting layer serving as a surface layer are controlled by arranging kind and blending amount of the binder resin. However, there arises a problem that depending on the kind and blending amount of the binder resin, the sensitivity and light responsiveness of the photoreceptor may decrease.

Since the sensitivity and light responsiveness of the photoreceptor depend on the charge transporting ability of the charge transporting substance as described above, it is considered that a charge transporting substance of high charge transporting ability is used in order to suppress lowering of the sensitivity and light responsiveness. However, the charge transporting ability of the enamine compound as disclosed in JP-A 2-51162, JP-A 6-43674 or JP-A 10-69107 is insufficient and no sufficient sensitivity and light responsiveness can be obtained even by the use of the enamine compounds. Further, as in the photoreceptor disclosed in JP-A 7-134430, it can be considered to incorporate a polysilane and an enamine compound having a specified structure. However, a photoreceptor using the polysilane is sensible to light exposure, and brings about another problem of lowering the various characteristics as the photoreceptor when exposed to light, for example, during maintenance.

In other words, even if the charge transporting substance described in JP-A 2-51162, JP-A 6-43674, JP-A 10-69107, or JP-A 7-134430 is used for the photoreceptor described in JP-A 2000-10320, it is not possible to realize a photoreceptor having both of the electric characteristics such as the sensitivity and the light responsiveness, and the durability to the mechanical external force.

Further, as characteristics of the photoreceptor, it is demanded that characteristics change little by fluctuation of the circumstance and that circumstantial stability is excellent, however, a photoreceptor having such characteristics has not been obtained.

DISCLOSURE OF INVENTION

An object of the invention is to provide an electrophotographic photoreceptor and an image forming apparatus provided with the same, the electrophotographic photoreceptor having high sensitivity and sufficient light responsiveness which are electric characteristics, the electric characteristics being not deteriorated even by any of exposure to light and change of circumstance nor by repetitive use, with an excellent life duration of abrasion resistance so that no flaw and density unevenness are generated on a to-be-formed image for a long period of time.

The invention is an electrophotographic photoreceptor comprising a conductive substrate and a photosensitive layer disposed on the conductive substrate, containing a charge generating substance and a charge transporting substance, wherein the charge transporting substance contains an enamine compound represented by the following general formula (1), and in a case where a maximum indentation load of 30 mN is put on a surface for 5 seconds under circumstances of temperature of 25° C. and relative humidity of 50%, a creep value ($C_{IT}$) is 2.70% or more and 5.00% or less and a plastic deformation hardness value (Hplast) of the surface is 220 N/mm$^2$ or more and 275 N/mm$^2$ or less.

(1)

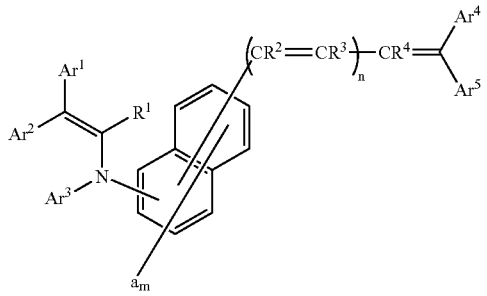

(wherein $Ar^1$ and $Ar^2$ each represent an aryl group which may have a substituent or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent.)

Further, the invention is characterized in that the enamine compound represented by the general formula (1) is an enamine compound represented by the following general formula (2).

(2)

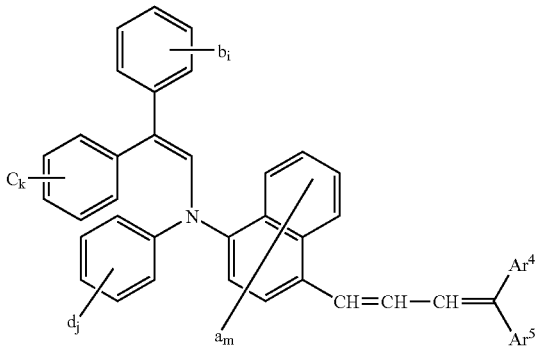

(wherein b, c and d each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).)

Further, the invention is characterized in that the creep value ($C_{IT}$) is 3.00% or more and 5.00% or less.

Further, the invention is characterized in that the charge generating substance contains a titanyl-phthalocyanine compound.

Further, the invention is characterized in that the photosensitive layer is constituted by lamination of a charge generating layer containing the charge generating substance and a charge transporting layer containing the charge transporting substance.

Further, the invention is an image forming apparatus comprising:

the electrophotographic photoreceptor, charging means for charging a surface of the electrophotographic photoreceptor, exposure means for exposing the charged surface of the electrophotographic photoreceptor to light according to image information thereby forming an electrostatic latent image, developing means for developing the electrostatic latent image to form a toner image, transfer means for transferring the toner image from the surface of the electrophotographic photoreceptor to a transfer member, and cleaning means for cleaning the surface of the electrophotographic photoreceptor after transfer of the toner image.

BRIEF DESCRIPTION OF DRAWINGS

Other and further objects, features, and advantages of the invention will be more explicit from the following detailed description taken with reference to the drawing wherein.

BEST MODE FOR CARRYING OUT THE INVENTION

Figure 1:
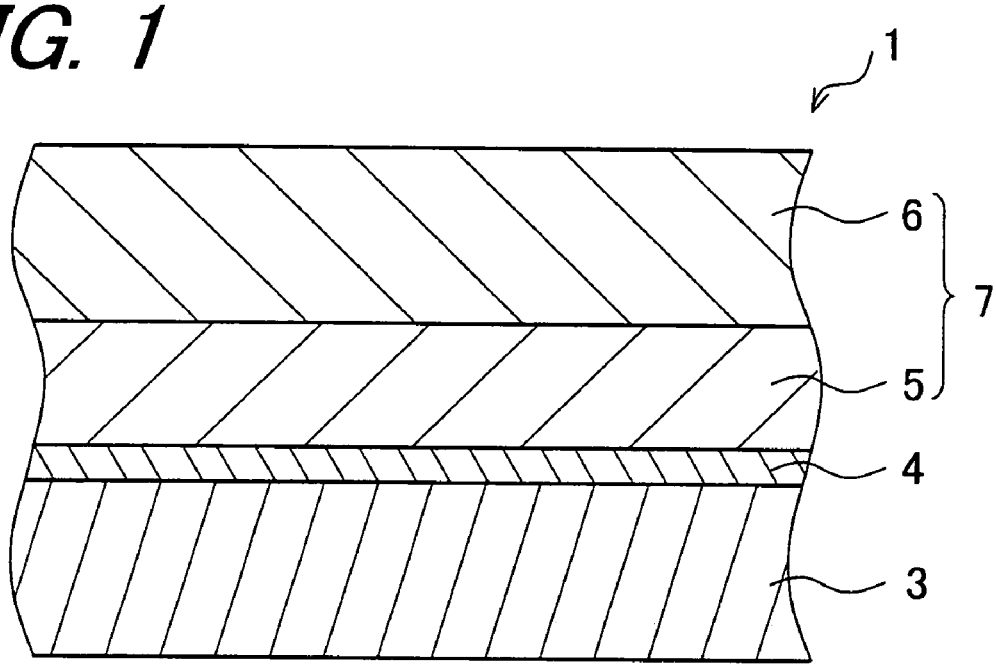
FIG. 1 is a partial cross sectional view schematically showing a constitution of an electrophotographic photoreceptor 1 according to a first embodiment of the invention.

Now referring to the drawings, preferred embodiments of the invention are described in detail below.

Figure 2:
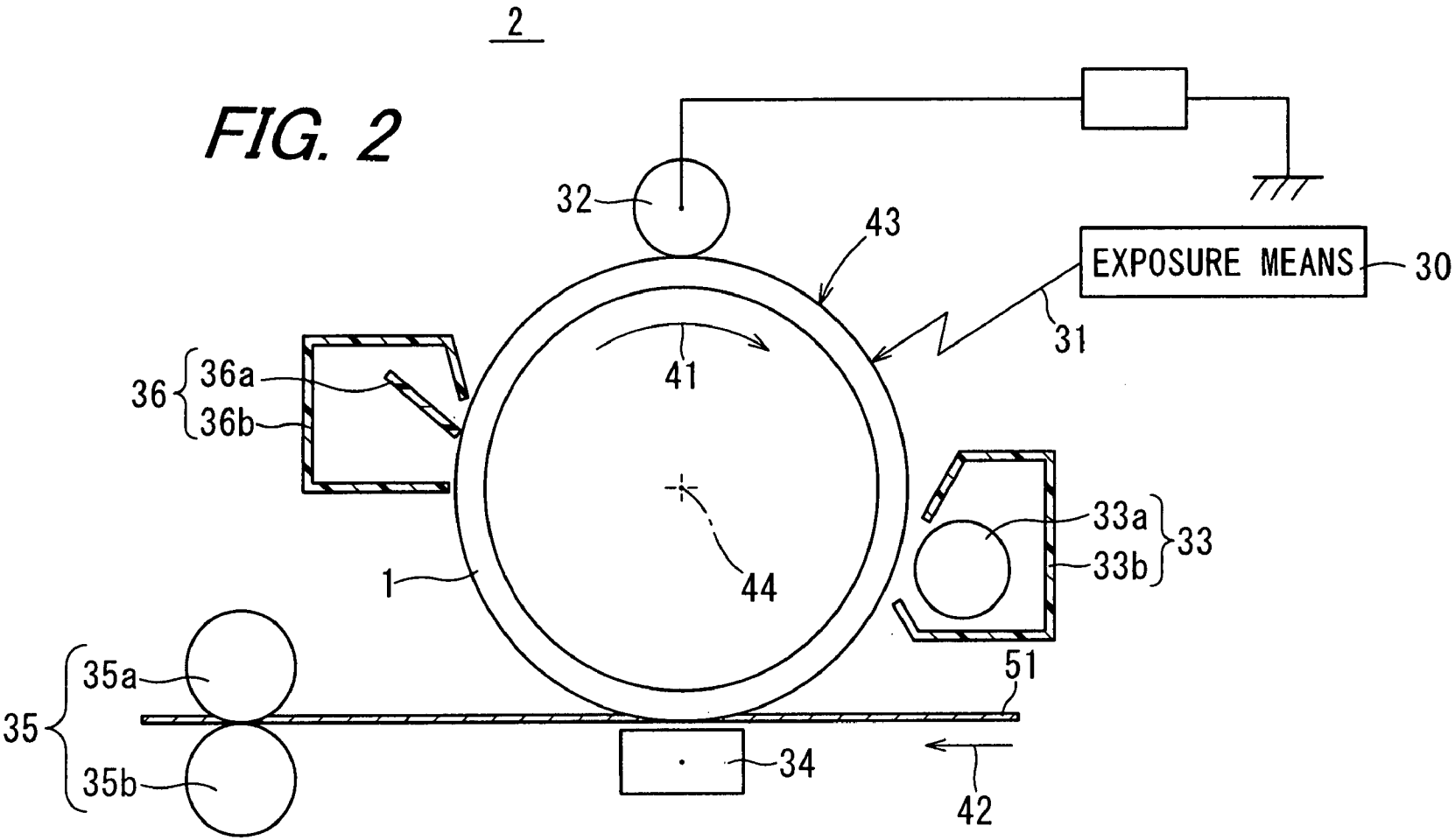
FIG. 2 is a layout side view schematically showing a constitution of an image forming apparatus 2 according to one embodiment of the invention, provided with the electrophotographic photoreceptor 1 shown in FIG. 1.

FIG. 1 is a partial cross sectional view schematically showing a constitution of an electrophotographic photorecepter 1 according to a first embodiment of the invention. FIG. 2 is a layout side view schematically showing a constitution of an image forming apparatus 2 according to one embodiment of the invention, provided with the electrophotographic photorecepter 1 shown in FIG. 1.

The electrophotographic photorecepter 1 (hereinafter abbreviated as a photoreceptor) comprises a conductive substrate 3 formed of a conductive material, an undercoat layer 4 laminated on the conductive substrate 3, a charge generating layer 5 laminated on the undercoat layer 4, containing a charge generating substance, and a charge transporting layer 6 further laminated on the charge generating layer 5, containing a charge transporting substance. The charge generating layer 5 and the charge transporting layer 6 constitute a photosensitive layer 7.

The conductive substrate 3 has a cylindrical shape and a conductivity. Preferably, the conductive substrate 3 is (a) formed of metal materials such as aluminum, stainless steel, copper, and nickel, or (b) composed of an insulating material such as polyester film, phenolic resin pipe or paper sleeve and a conductive layer formed of aluminum, copper, palladium, tin oxide, indium oxide or the like provided on a surface of the insulating material. It is preferable that the conductive substrate 3 has a volume resistance of $10^{10}$ Ω·cm or less. A surface of the conductive substrate 3 may be treated by oxidation in order to adjust the above-mentioned volume resistance. The conductive substrate 3 plays a role as an electrode of the photorecepter 1 and also functions as a support member of each of the other layers 4, 5, and 6. Note that the conductive substrate 3 is not limited to the cylindrical shape, but may be either of platy, film-like, and belt-like shapes.

The undercoat layer 4 is formed of polyamide, polyurethane, cellulose, nitrocellulose, polyvinyl alcohol, polyvinyl pyrrolidone, polyacryl amide, aluminum anodic oxide film, gelatin, starch, casein, N-methoxymethyl nylon, or the like. Further, particles of titanium oxide, tin oxide, aluminum oxide, or the like may be dispersed in the undercoat layer 4. The undercoat layer 4 is formed so as to have a film thickness of approximately 0.1 to 10 μm. This undercoat layer 4 plays a role as an adhesion layer between a conductive substrate 3 and a photosensitive layer 7 and also functions as a barrier layer for inhibiting charges from flowing from the conductive substrate 3 into the photosensitive layer 7. The undercoat layer 4 thus acts on the photorecepter 1 so as to maintain charging characteristics of the photoreceptor 1, in consequence of which a length of life of the photorecepter 1 can be extended.

The charge generating layer 5 may be constituted so as to include a heretofore known charge generating substance. As the charge generating substance, either of inorganic pigment, organic pigment, and organic dye may be used as long as it absorbs light and generates a free charge. The inorganic pigment includes selenium, alloy thereof, arsenic-selenium, cadmium sulfate, zinc oxide, amorphous silicon, and other inorganic photoconductor. The organic pigment includes a phthalocyanine-series compound, an azo-series compound, a quinacridone-series compound, a polycyclic quinone-series compound, a perylene-series compound, etc. The organic dye includes thiapyrylium salt, squarylium salt, etc. Of the above-mentioned charge generating substances, the organic photoconductive compounds such as the organic pigment and the organic dye are preferable. Furthermore, of the organic photoconductive compounds, a phthalocyanine-series compound is preferably used, and in particular, it is the most preferable to use a titanyl phthalocyanine-series compound represented by the following general formula (A), with which an enamine compound represented by a to-be-described general formula (1), preferably general formula (2), is combined so that good sensitivity characteristics, charging characteristics, and image reproducibility can be obtained.

(A)

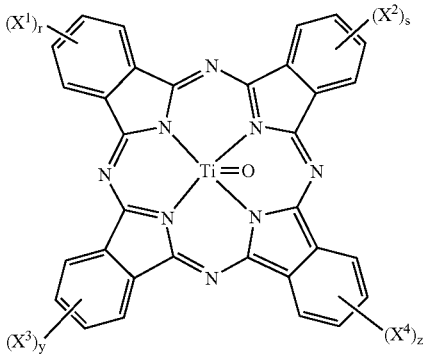

In the general formula (A), $X^1$, $X^2$, $X^3$, and $X^4$ each represent a hydrogen atom, a halogen atom, an alkyl group, and a alkoxy group, and r, s, y, and z each indicate an integer of from 0 to 4.

The titanyl phthalocyanine compound represented by the general formula (A) can be produced by heretofore known production methods such as a method described in "Phthalocyanine Compounds" written by Moser and Thomas. For example, of the titanyl phthalocyanine compounds represented by the general formula (A), the titanyl phthalocyanine of which $X^1$, $X^2$, $X^3$, and $X^4$ are all hydrogen atoms, can be obtained by heat fusion of phthalonitrile and titanium tetrachloride, or heat reaction thereof in appropriate solvents such as α-chloronaphthalene so that dichlorotitanium phthalocyanine is synthesized, and then hydrolysis with base or water. Further, titanyl phthalocyanine can be obtained also by heat reaction of isoindoline and titanium tetraalcoxide such as tetrabutoxy titanium in appropriate solvents such as N-methylpyrrolidone.

Other than the pigments and dyes listed above, chemical sensitizer or optical sensitizer may be added to the charge generating layer 5. As the chemical sensitizer, an electron-accepting substance can be cited, including cyano compounds such as tetracyanoethylene and 7,7,8,8-tetracyanoquinodimethane, a quinone group such as anthraquinone and p-benzoquinone, and nitro compounds such as 2,4,7-trinitrofluorenone and 2,4,5,7-tetranitrofluorenone. The optical sensitizer includes xanthene-series dye, thiazine dye, and triphenylmethane-series dye.

In forming the charge generating layer 5, vapor-phase deposition methods such as a vacuum deposition method, a sputtering method, and a CVD method, or a coating method, etc. can be applied. In a case where the coating method is used, the above-described charge generating substance is pulverized by a ball mill, sand grinder, paint shaker, ultrasonic dispersing machine or the like, and dispersed in an appropriate solvent and when needed, a binder resin serving as a binding agent is added to the solvent, to produce an embrocation which is applied onto the undercoat layer 4 and dried or cured by a heretofore known method so that a film of the charging generating layer 5 is formed.

The binder resin specifically includes polyarylate, polyvinyl butyral, polycarbonate, polyester, polystyrene, polyvinyl chloride, phenoxy resins, epoxy resin, silicone, and polyacrylate. The solvent includes isopropyl alcohol, cyclohexanone, cyclohexane, toluene, xylene, acetone, methyl ethyl ketone, tetrahydrofuran, dioxane, dioxolan, ethyl cellosolve, ethyl acetate, methyl acetate, dichloromethane, dichloroethane, monochlorbenzen, and ethylene glycol dimethyl ether.

Note that the solvent is not limited to the above listed substances, but any solvent series selected from alcoholic series, ketone series, amide series, ester series, ether series, hydrocarbon series, chlorinated hydrocarbon series, and aromatic series may be used alone or in combination. However, in consideration of decrease in sensitivity based on pulverization of the charge generating substance and crystalline transition upon milling, and decrease in characteristics caused by a pot life, it is preferable to use any of cyclohexanone, 1,2-dimethoxyethane, methyl ethyl ketone, and tetrahydroquinone which less easily cause the crystalline transition in the inorganic pigment and organic solvent.

As the coating method of the embrocation, in a case where the conductive substrate 3 having the undercoat layer 4 formed therein is cylindrical, a spraying method, a vertical ring method, a dip coating method, or the like may be used. Note that in a case where the shape of the conductive substrate 3 having the undercoat layer 4 formed therein is sheet-like, a baker applicator, a bar coater, casting, spin coat, or the like can be used for the coating method.

A film thickness of the charge generating layer 5 is preferably in the region of from 0.05 to 5 μm, and more preferably in the region of from 0.1 to 1 μm.

The charge transporting layer 6 may be constituted so as to include the charge transporting substance having an ability of accepting charges generated by the charge generating substance contained in the charge generating layer 5 and transporting the charges. For the charge transporting substance, an enamine compound represented by the following general formula (1) is used.

(1)

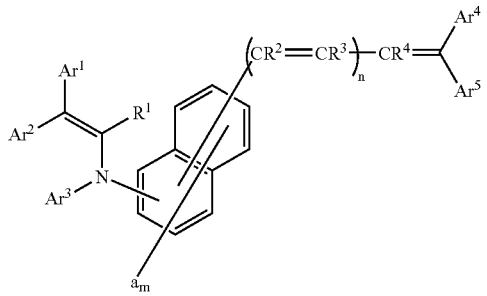

In the general formula (1), $Ar^1$ and $Ar^2$ each represent an aryl group which may have a substituent or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent.

In the general formula (1), specific examples of the aryl group represented by $Ar^1$, $Ar^2$, $Ar^3$, $Ar^4$, $Ar^5$, "a", $R^2$, $R^3$ or $R^4$ can include, for example, phenyl, naphthyl, pyrenyl and anthryl. A substituent which may be present on the aryl group described above can include, for example, alkyl groups such as methyl, ethyl, propyl and trifluoromethyl, alkenyl groups such as 2-propenyl and styryl, alkoxy groups such as methoxy, ethoxy and propoxy, amino groups such as methylamino and dimethylamino, halogeno groups such as fluoro, chloro and bromo, aryl groups such as phenyl and naphthyl, aryloxy groups such as phenoxy, and arylthio groups such as thiophenoxy. Specific examples of the aryl group having such substituents can include tolyl, methoxyphenyl, biphenylyl, terphenyl, phenoxyphenyl, p-(phenylthio)phenyl and p-styrylphenyl.

In the general formula (1), specific examples of the heterocyclic group represented by $Ar^1$, $Ar^2$, $Ar^3$, $Ar^4$, $Ar^5$, $R^2$, $R^3$ or $R^4$ can include furyl, thienyl, thiazoryl, benzofuryl, benzothiophenyl, benzothiazoryl and benzooxazoryl. A substituent which may be present on the heterocyclic group described above can include, for example, substituents similar to those which may be present on the aryl group represented by $Ar^1$ and the like described above, and specific examples of the heterocyclic group having a substituent can include N-methyl indolyl and N-ethyl carbazolyl.

In the general formula (1), specific examples of the aralkyl group of $Ar^3$, $Ar^4$, $Ar^5$, $R^2$, $R^3$ or $R^4$ can include, for example, benzyl and 1-naphthylmethyl. A substituent which may be present on the aralkyl group described above can include, for example, substituents similar to those which may be present on the aryl group represented by $Ar^1$ and the like described above, and specific examples of the aralkyl group having a substituent can include p-methoxybenzyl.

In the general formula (1), as the alkyl group represented by $Ar^3$, $Ar^4$, $Ar^5$, "a", $R^1$, $R^2$, $R^3$ or $R^4$, those having from 1 to 6 carbon atoms are preferred, and specific examples thereof can include chained alkyl groups such as methyl, ethyl, n-propyl, isopropyl and t-butyl, and cycloalkyl groups such as cyclohexyl and cyclopentyl. A substituent which may be present on the alkyl groups described above can include substituents similar to those which may be present on the aryl group represented by $Ar^1$ described above, and specific examples of the alkyl group having a substituent can include halogenated alkyl groups such as trifluoromethyl and fluoromethyl, alkoxyalkyl groups such as 1-methoxyethyl, and alkyl groups substituted with a heterocyclic group such as 2-thienylmethyl.

In the general formula (1), as the alkoxy group represented by "a", those having from 1 to 4 carbon atoms are preferred, and specific examples thereof can include methoxy, ethoxy, n-propoxy and isopropoxy. A substituent which may be present on the alkoxy group described above can include substituents similar to those which may be present on the aryl group represented by $Ar^1$ described above.

In the general formula (1), as the dialkylamino group represented by "a", those having from 1 to 4 carbon atoms substituted with an alkyl group are preferred, and specific examples thereof can include, dimethylamino, diethylamino and diisopropylamino. A substituent which may be present on the dialylamino group described above can include, for example, substituents similar to those which may be present on the aryl group represented by $Ar^1$ described above.

In the general formula (1), specific examples of the halogen atom represented by "a" or $R^1$ can include a fluorine atom and a, chlorine atom.

In the general formula (1), specific examples of the atoms for bonding $Ar^4$ and $Ar^5$ can include an oxygen atom, sulfur atom and nitrogen atom. The nitrogen atom, for example, as a bivalent group such as an imino group or N-alkylimino group, bonds $Ar^4$ and $Ar^5$. Specific examples of the atomic group for bonding $Ar^4$ and $Ar^5$ can include bivalent groups, for example, an alkylene group such as methylene, ethylene and methylmethylene, an alkenylene group such as vinylene and propenylene, an alkylene group containing a hetero atom such as oxymethylene (chemical formula: —O—$CH_2$—), and an alkenylene group containing a hetero atom such as thiovinylene (chemical formula: S—CH═CH—).

For the charge transporting substance, an enamine compound represented by the following general formula (2) is preferably used among enamine compounds represented by the general formula (1).

(2)

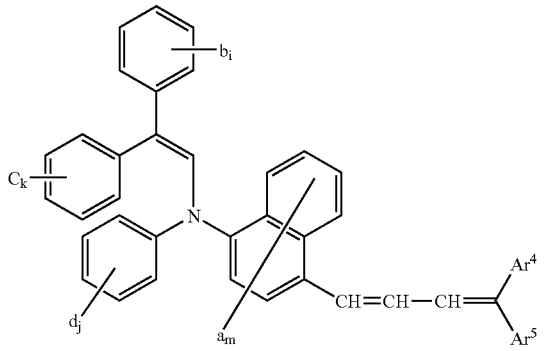

In the general formula (2), b, c and d each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

In the general formula (2), the alkyl group represented by b, c or d is preferably those having from 1 to 6 carbon atoms, and specific examples thereof can include chained alkyl groups such as methyl, ethyl, n-propyl and isopropyl, and cycloalkyl groups such as cyclohexyl and cyclopentyl. A substituent which may be present on the alkyl group described above can include, for example, substituents similar to those which may be present on the aryl group represented by $Ar^1$ and the like described above, and the specific examples of the alkyl group having a substituent can include halogenated alkyl groups such as trifluoromethyl and fluoromethyl, and alkoxyalkyl groups such as 1-methylethyl, and alkyl groups substituted with a heterocyclic group such as 2-thienylmethyl.

In the general formula (2), the alkoxy group represented by b, c, or d is preferably those having from 1 to 4 carbon atoms, and specific examples thereof can include methoxy, ethoxy, n-propoxy and isopropoxy. A substituent which may be present on the alkoxy groups described above can include, for example, substituents similar to those which may be present on the aryl group represented by $Ar^1$ and the like described above.

In the general formula (2), the dialkyl group represented by b, c or d is preferably those substituted with an alkyl group having from 1 to 4 carbon atoms, and specific examples thereof can include dimethylamino, diethylamino and diisopropylamino. A substituent which the dialkylamino groups described above can include, for example, substituents similar to those which may be present on the aryl group represented by $Ar^1$ and the like described above.

In the general formula (2), specific examples of the aryl group represented by b, c, or d can include phenyl and naphthyl. A substituent which may be present on the aryl groups described above can include, for example, substituents similar to those which may be present on the aryl group represented by $Ar^1$ and the like described above, and specific examples of the aryl group having the substituent can include tolyl and methoxyphenyl.

In the general formula (2), specific examples of the halogen atom represented by b, c, or d can include, a fluorine atom and a chlorine atom.

Enamine compounds represented by the general formula (1) have a high charge transporting ability. Further, of the enamine compounds represented by the general formula (1), enamine compounds represented by the general formula (2) have particularly high charge transporting ability. Accordingly, a photorecepter 1 having high sensitivity and excellent light responsiveness and chargeability can be obtained by incorporating the enamine compounds represented by the general formula (1), preferably, the enamine compounds represented by general formula (2) as the charge transporting substance into the charge transporting layer 6. The good electric characteristics of the photorecepter 1 are maintained even when the circumstances surrounding the photorecepter 1 are changed, or maintained without degradation even after repetitive use.

Further, since a photorecepter 1 having good electric characteristics described above can be realized with no incorporation of polysilane to the charge transporting layer 6 by use of the enamine compound represented by the general formula (1), a photorecepter 1 with no deterioration of the electric characteristics even when exposed to light can be obtained.

Further, of the enamine compounds represented by the general formula (1), the enamine compounds represented by the general formula (2) not only have particularly high charge transporting ability, but also can be produced at a reduced cost as a result of relatively easy synthesis and high production yield. Accordingly, by use of the enamine compound represented by the general formula (2) for the charge transporting substance, it is possible to produce the photorecepter 1 having particularly good light responsiveness at a low production cost.

Of the enamine compounds represented by the general formula (1), compounds having especially excellent in view of the characteristics, cost and productivity can include, for example, those in which each of $Ar^1$ and $Ar^2$ represents a phenyl group, $Ar^3$ represents a phenyl group, tolyl group, p-methoxyphenyl group, biphenylyl group, naphthyl group or thienyl group, at least one of $Ar^4$ and $Ar^5$ represents a phenyl group, p-tolyl group, p-methoxyphenyl group, naphthyl group, thienyl group or thiazolyl group, and $R^1$, $R^2$, $R^3$ and $R^4$ each represents a hydrogen atom, and n represents 1.

Specific examples of enamine compounds represented by the general formula (1) can include, for example, Exemplified Compounds No. 1 to No. 220, in Tables 1 to 32 described below, but the enamine compounds represented by the general formula (1) are not limited to those listed above. Note that, in Tables 1 to 32, each of the exemplified compounds is represented by a group corresponding to each group of the general formula (1). For example, Exemplified Compound No. 1 shown in Table 1 is an enamine compound represented by the following structural formula (1-1). In this regard, in Tables 1 to 32, in a case of exemplifying those in which $Ar^4$ and $Ar^5$ bond with each other by way of an atom or an atomic group to form a ring structure, carbon-carbon double bonds for bonding $Ar^4$ and $Ar^5$, and ring structures formed by $Ar^4$ and $Ar^5$ together with the carbon atom of the carbon-carbon double bonds are shown in the column for $Ar^4$ to the column for $Ar^5$.

TABLE 1
(1-1)
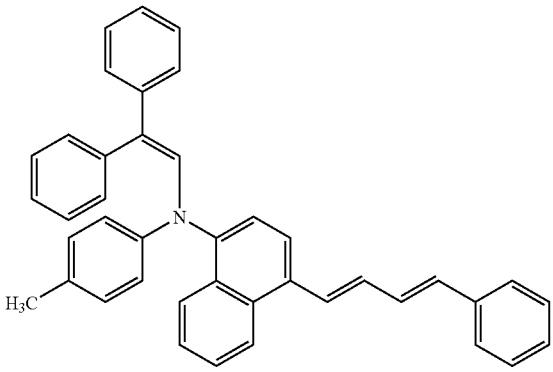
(1—1)
| Compound No. | $Ar^1$ | $Ar^2$ | $R^1$ | $Ar^3$ | 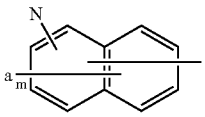 |
|---|---|---|---|---|---|
| 1 | 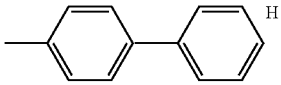 | | H | 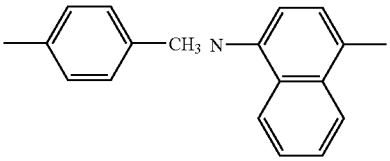 | |
| 2 | 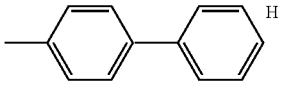 | | H | 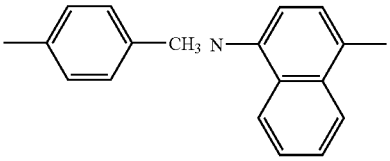 | |
| 3 | 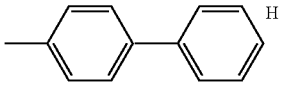 | | H | 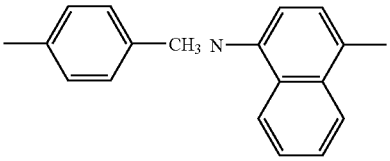 | |
| 4 | 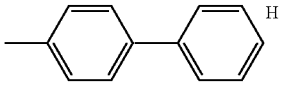 | | H | 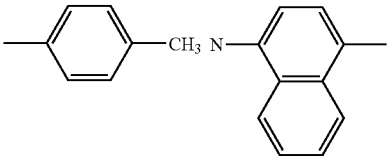 | |
| 5 | 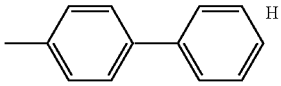 | | H | 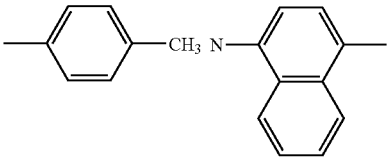 | |
| 6 | 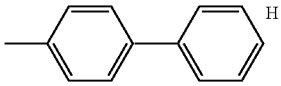 | | H | 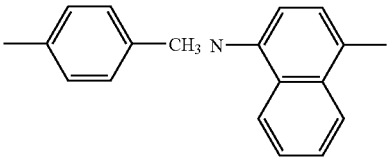 | |

TABLE 1-continued
| | | | | | | |
|---|---|---|---|---|---|---|
| 7 | 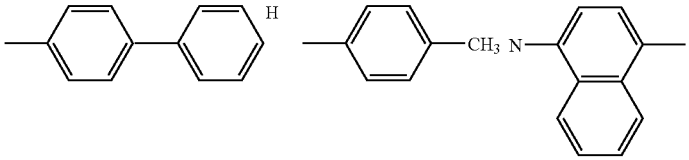 | | | | | |
| | Compound No. | n | $-(CR^2=CR^3)_n-$ | $R^4$ | $Ar^4$ | $Ar^5$ |
| | 1 | 1 | CH=CH | H | H | 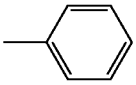 |
| | 2 | 1 | CH=CH | H | H | 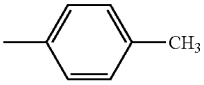 |
| | 3 | 1 | CH=CH | H | $-CH_3$ | 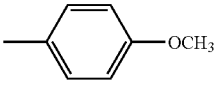 |
| | 4 | 1 | CH=CH | H | H | 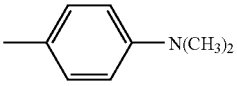 |
| | 5 | 1 | CH=CH | H | H | 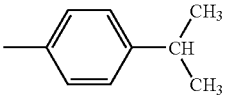 |
| | 6 | 1 | CH=CH | H | H | 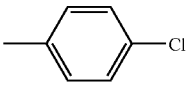 |
| | 7 | 1 | CH=CH | H | $-CH_3$ | 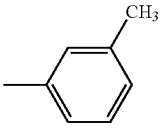 |
TABLE 2
| Compound No. | $Ar^1$ | $Ar^2$ | $R^1$ | $Ar^3$ | 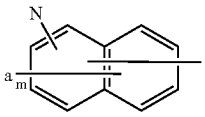 |
|---|---|---|---|---|---|
| 8 | 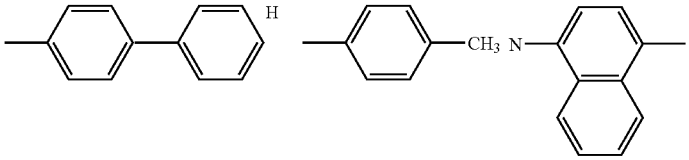 | | | | |
| 9 | 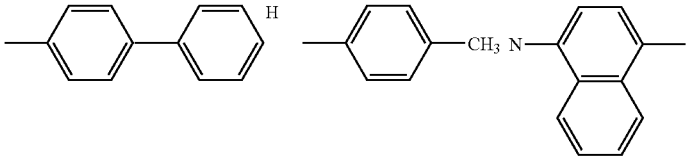 | | | | |

TABLE 2-continued
| | | | | | | |
|---|---|---|---|---|---|---|
| 10 | 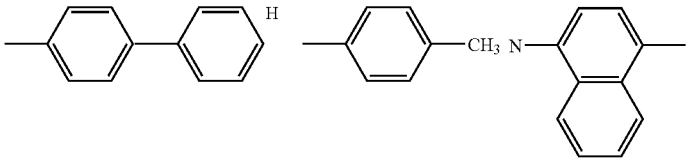 | | | | | |
| 11 | 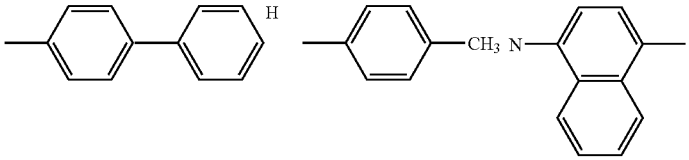 | | | | | |
| 12 | 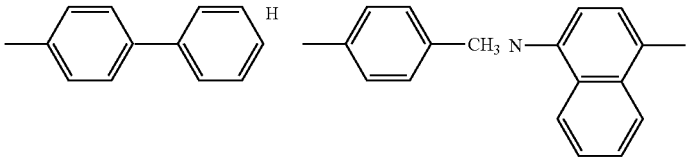 | | | | | |
| 13 | 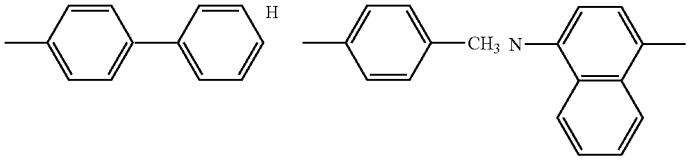 | | | | | |
| 14 | 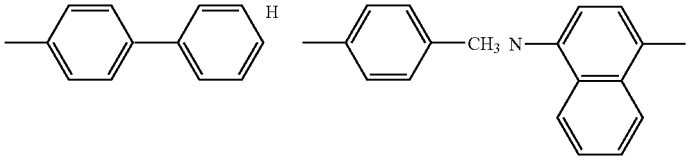 | | | | | |
| Compound No. | n | $-(CR^2=CR^3)_n-$ | $R^4$ | $Ar^4$ | $Ar^5$ | |
| 8 | 1 | CH=CH | H | H | 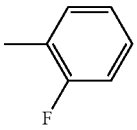 | |
| 9 | 1 | CH=CH | H | $-CH_3$ | 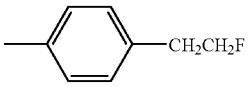 | |
| 10 | 1 | CH=CH | H | $-CH_3$ | 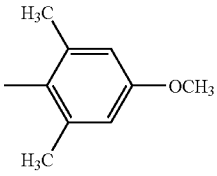 | |
| 11 | 1 | CH=CH | H | H | 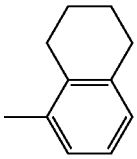 | |

TABLE 2-continued
| | | | | | |
|---|---|---|---|---|---|
| 12 | 1 | CH═CH | H | H | 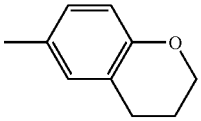 |
| 13 | 1 | CH═CH | H | H | 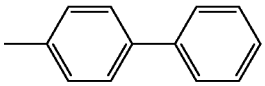 |
| 14 | 1 | CH═CH | H | H | 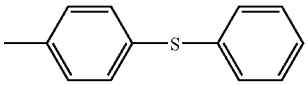 |
TABLE 3
| Compound No. | $Ar^1$ | $Ar^2$ | $R^1$ | $Ar^3$ | 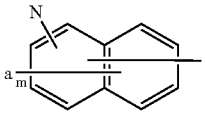 |
|---|---|---|---|---|---|
| 15 | 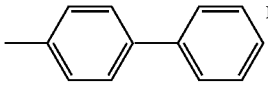 | | H | 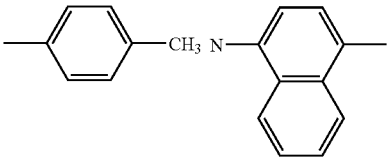 | |
| 16 | 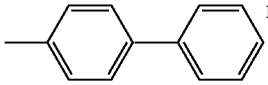 | | H | 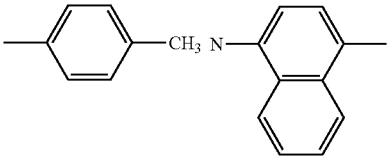 | |
| 17 | 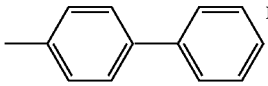 | | H | 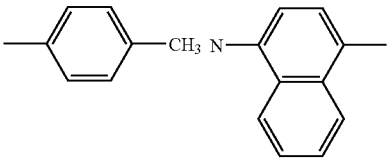 | |
| 18 | 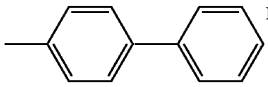 | | H | 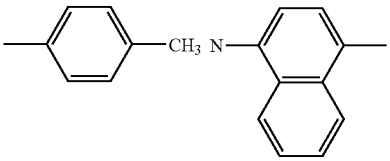 | |
| 19 | 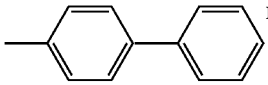 | | H | 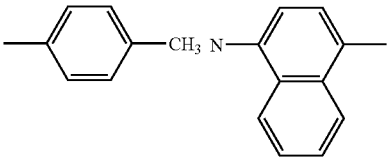 | |
| 20 | 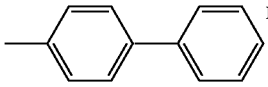 | | H | 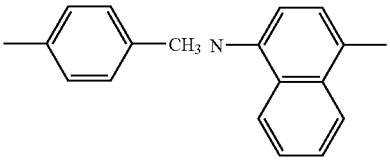 | |

TABLE 3-continued
| | | | | | | |
|---|---|---|---|---|---|---|
| 21 | 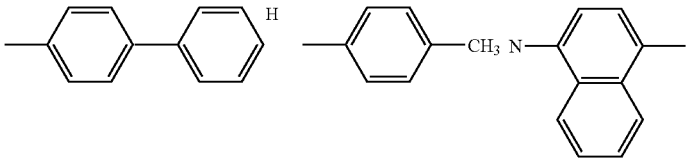 | | | | | |
| Compound No. | n | $-(CR^2=CR^3)_n-$ | $R^4$ | $Ar^4$ | $Ar^5$ |
|---|---|---|---|---|---|
| 15 | 1 | CH=CH | H | H | 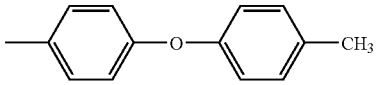 |
| 16 | 1 | CH=CH | H | $-CH_3$ | 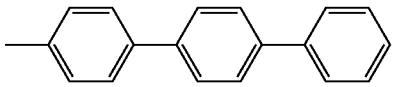 |
| 17 | 1 | CH=CH | H | H | 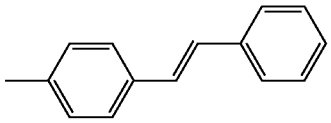 |
| 18 | 1 | CH=CH | H | $-CH_3$ | 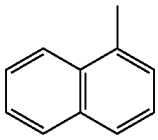 |
| 19 | 1 | CH=CH | H | H | 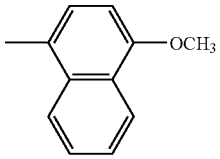 |
| 20 | 1 | CH=CH | H | H | 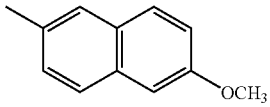 |
| 21 | 1 | CH=CH | H | H | 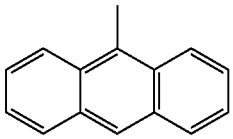 |
TABLE 4
| Compound No. | $Ar^1$ | $Ar^2$ | $R^1$ | $Ar^3$ | 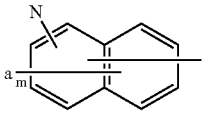 |
|---|---|---|---|---|---|
| 22 | 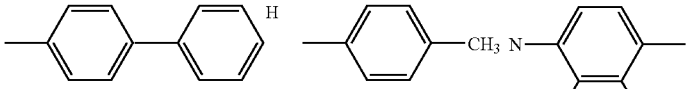 | | | | |

TABLE 4-continued
| | | | | |
|---|---|---|---|---|
| 23 | 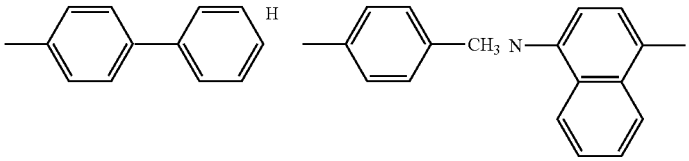 | | | |
| 24 | 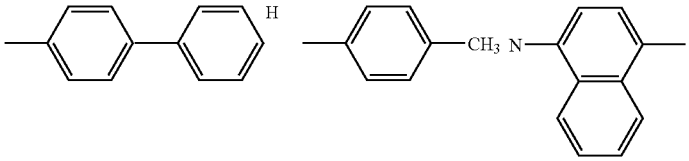 | | | |
| 25 | 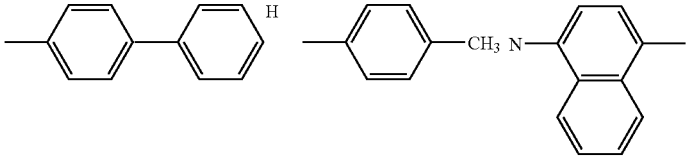 | | | |
| 26 | 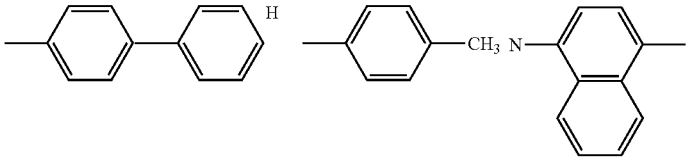 | | | |
| 27 | 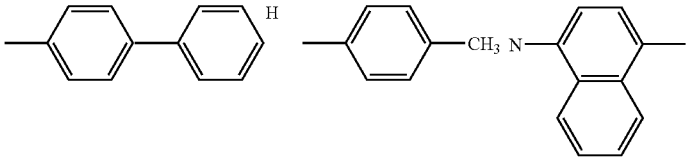 | | | |
| 28 | 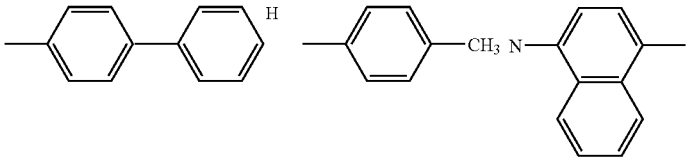 | | | |
| Compound No. | n | $-(CR^2=CR^3)_n-$ | $R^4$ | $Ar^4$ | $Ar^5$ |
|---|---|---|---|---|---|
| 22 | 1 | CH═CH | H | H | 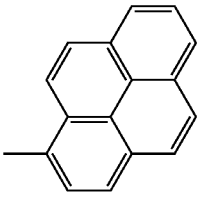 |
| 23 | 1 | CH═CH | H | —$CH_3$ | 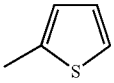 |
| 24 | 1 | CH═CH | H | —$CH_3$ | 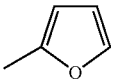 |
| 25 | 1 | CH═CH | H | H | 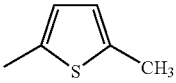 |

TABLE 4-continued
| | | | | | |
|---|---|---|---|---|---|
| 26 | 1 | CH═CH | H | H | 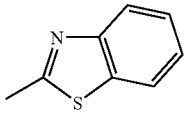 |
| 27 | 1 | CH═CH | H | H | 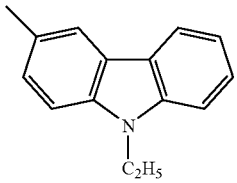 |
| 28 | 1 | CH═CH | H | 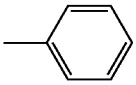 | 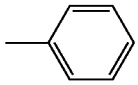 |
TABLE 5
| Compound No. | $Ar^1$ | $Ar^2$ | $R^1$ | $Ar^3$ | 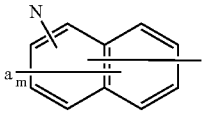 |
|---|---|---|---|---|---|
| 29 | 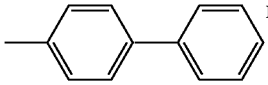 | | H | 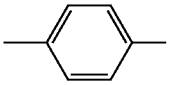 | 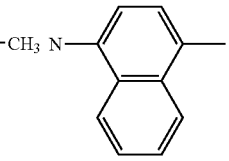 |
| 30 | 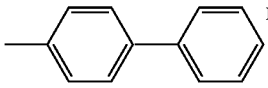 | | H | 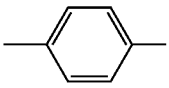 | 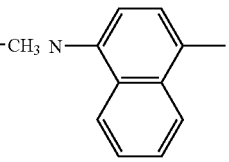 |
| 31 | 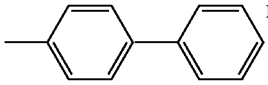 | | H | 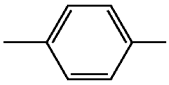 | 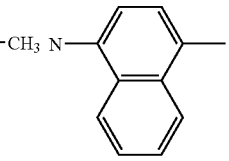 |
| 32 | 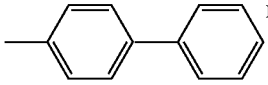 | | H | 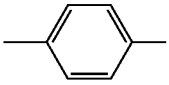 | 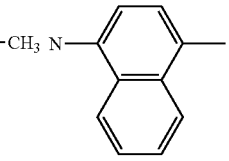 |
| 33 | 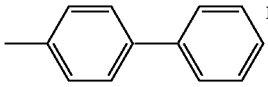 | | H | 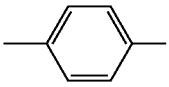 | 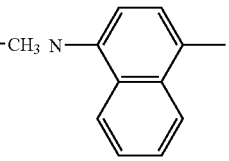 |

TABLE 5-continued
| | | |
|---|---|---|
| 34 | 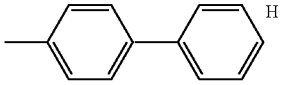 | 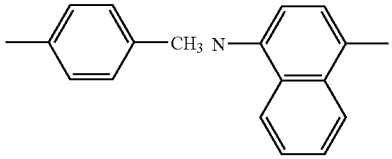 |
| 35 | 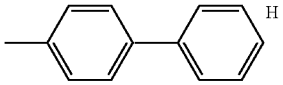 | 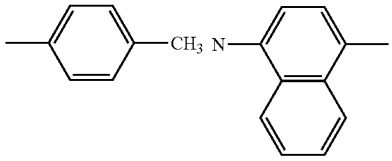 |
| Compound No. | n | $-(CR^2=CR^3)_n-$ | $R^4$ | $Ar^4$ | $Ar^5$ |
|---|---|---|---|---|---|
| 29 | 1 | CH=CH | H | 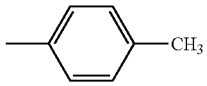 | 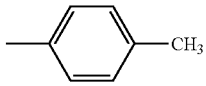 |
| 30 | 1 | CH=CH | H | 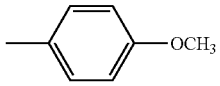 | 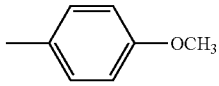 |
| 31 | 1 | CH=CH | H | 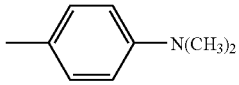 | 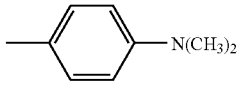 |
| 32 | 1 | CH=CH | H | 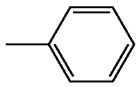 | 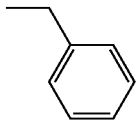 |
| 33 | 1 | CH=CH | H | 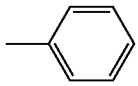 | 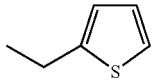 |
| 34 | 1 | CH=CH | H | 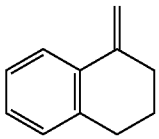 | |
| 35 | 1 | CH=CH | H | 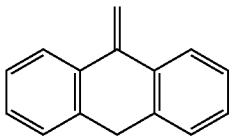 | |

TABLE 6
| Compound No. | $Ar^1$ | $Ar^2$ | $R^1$ | $Ar^3$ | 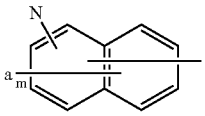 |
|---|---|---|---|---|---|
| 36 | 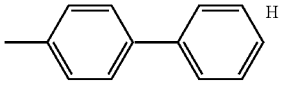 | | H | 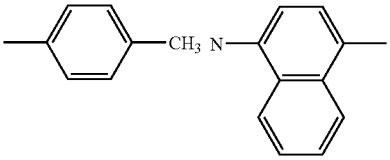 | |
| 37 | 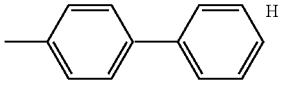 | | H | 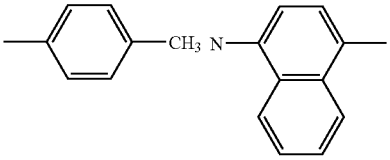 | |
| 38 | 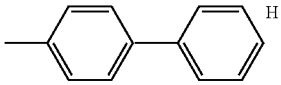 | | H | 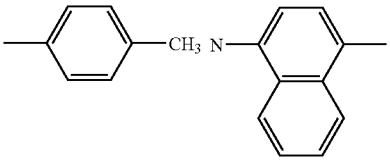 | |
| 39 | 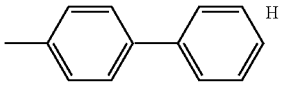 | | H | 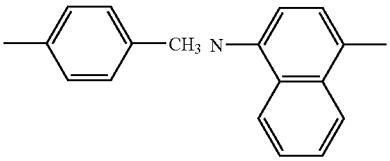 | |
| 40 | 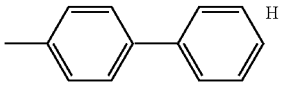 | | H | 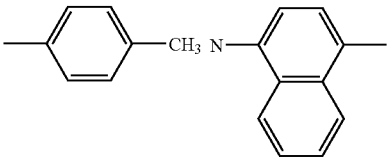 | |
| 41 | 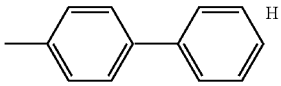 | | H | 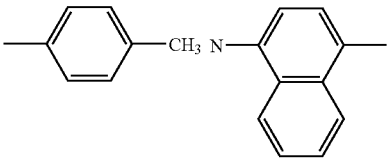 | |
| 42 | 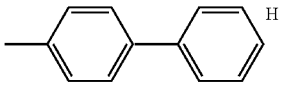 | | H | 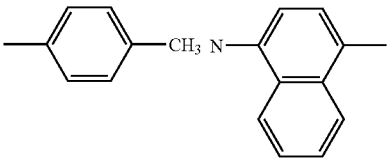 | |
| Compound No. | n | $-(CR^2=CR^3)_n-$ | $R^4$ | $Ar^4$ | $Ar^5$ |
|---|---|---|---|---|---|
| 36 | 1 | CH═CH | H | 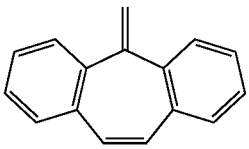 | |

TABLE 6-continued
| | | | | | |
|---|---|---|---|---|---|
| 37 | 1 | CH═CH | H | | 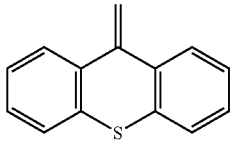 |
| 38 | 1 | CH═CH | H | | 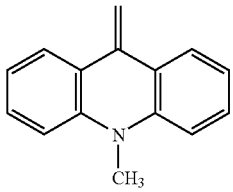 |
| 39 | 1 | CH═CH | —$CH_3$ | H | 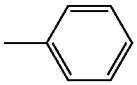 |
| 40 | 1 | CH═CH | 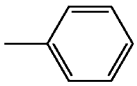 | H | 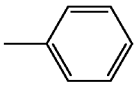 |
| 41 | 1 | 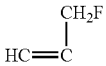 | H | H | 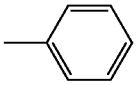 |
| 42 | 1 | 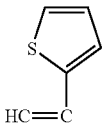 | H | H | 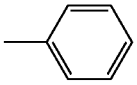 |
TABLE 7
| Compound No. | $Ar^1$ | $Ar^2$ | $R^1$ | $Ar^3$ | 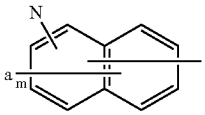 |
|---|---|---|---|---|---|
| 43 | 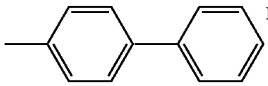 | | H | 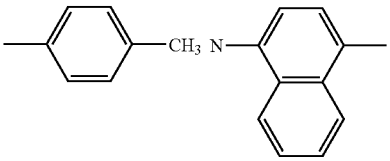 | |
| 44 | 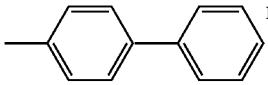 | | H | 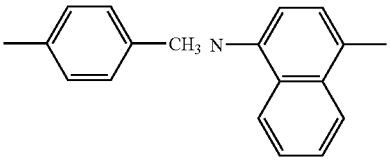 | |
| 45 | 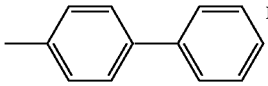 | | H | 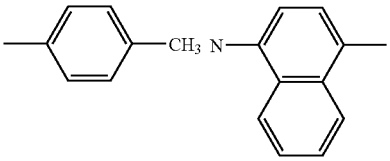 | |

TABLE 7-continued
| | | | | |
|---|---|---|---|---|
| 46 | 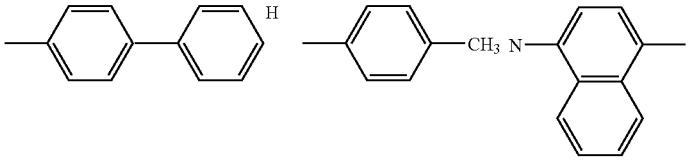 | | | |
| 47 | 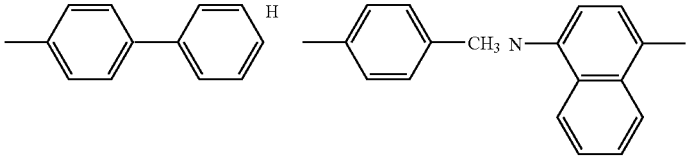 | | | |
| 48 | 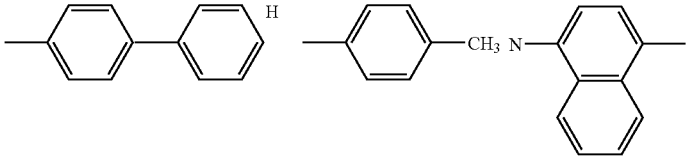 | | | |
| 49 | 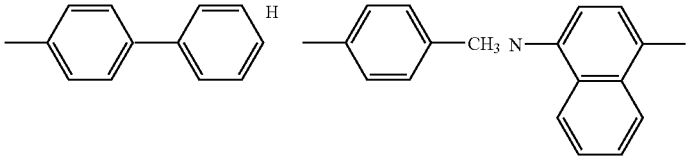 | | | |
| Compound No. | n | $-(CR^2{=}CR^3)_n-$ | $R^4$ | $Ar^4$ | $Ar^5$ |
|---|---|---|---|---|---|
| 43 | 1 | 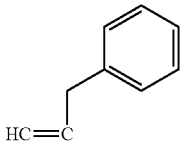 | H | H | 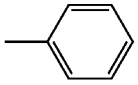 |
| 44 | 1 | $CH_3$ / C═CH | H | H | 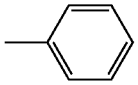 |
| 45 | 1 | $CH_3$ / HC═C | 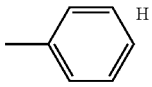 | H | 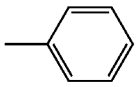 |
| 46 | 2 | CH═CH—CH═CH | H | H | 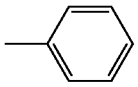 |
| 47 | 2 | CH═CH—CH═CH | H | H | 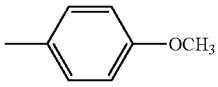 $OCH_3$ |
| 48 | 2 | CH═CH—CH═CH | H | $—CH_3$ | 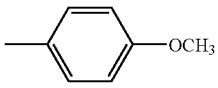 $OCH_3$ |
| 49 | 2 | CH═CH—CH═CH | H | $—CH_3$ | 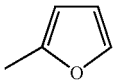 |

TABLE 8

| Compound No. | $Ar^1$ | $Ar^2$ | $R^1$ | $Ar^3$ | |
|---|---|---|---|---|---|
| 50 | | | H | | |
| 51 | | | H | | |
| 52 | | | H | | |
| 53 | | | H | | |
| 54 | | | H | | |
| 55 | | | H | | |
| 56 | | | H | | |

TABLE 8-continued

| Compound No. | n | $-(CR^2=CR^3)_n-$ | $R^4$ | $Ar^4$ | $Ar^5$ |
|---|---|---|---|---|---|
| 50 | 2 | CH=CH—CH=CH | H | $-CH_3$ | |
| 51 | 2 | CH=CH—CH=CH | H | $-CH_3$ | |
| 52 | 2 | $HC=C(CH_3)-CH=CH$ | H | H | |
| 53 | 2 | $HC=C(CH_3)-C(CH_2OCH_3)=CH$ | H | H | |
| 54 | 3 | $-(HC=CH)_3-$ | H | H | |
| 55 | 1 | CH=CH | H | H | |
| 56 | 1 | CH=CH | H | H | |

TABLE 9

| Compound No. | $Ar^1$ | $Ar^2$ | $R^1$ | $Ar^3$ | |
|---|---|---|---|---|---|
| 57 | | | H | $CH_3$ | |
| 58 | | | H | $CH_3$ | |
| 59 | | | H | $CH_3$ | |

TABLE 9-continued
| | | | |
|---|---|---|---|
| 60 | 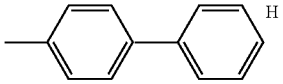 | 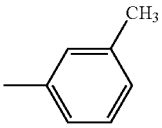 | 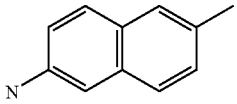 |
| 61 | 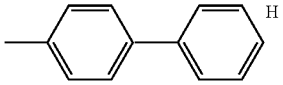 | 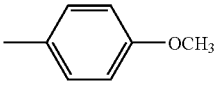 | 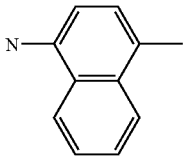 |
| 62 | 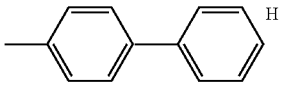 | 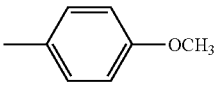 | 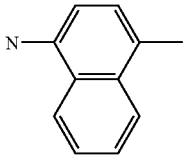 |
| 63 | 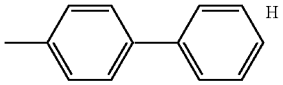 | 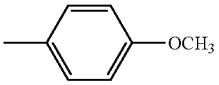 | 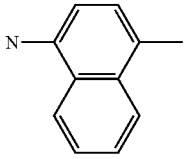 |
| Compound No. | n | $-(CR^2=CR^3)_n-$ | $R^4$ | $Ar^4$ | $Ar^5$ |
|---|---|---|---|---|---|
| 57 | 1 | CH=CH | H | H | 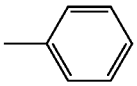 |
| 58 | 1 | CH=CH | H | H | 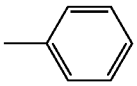 |
| 59 | 1 | CH=CH | H | H | 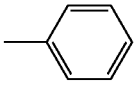 |
| 60 | 1 | CH=CH | H | H | 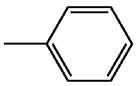 |
| 61 | 1 | CH=CH | H | H | 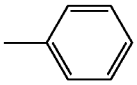 |
| 62 | 1 | CH=CH | H | H | 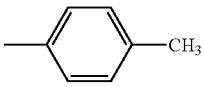 |
| 63 | 1 | CH=CH | H | $-CH_3$ | 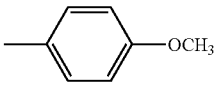 |

TABLE 10

| Compound No. | $Ar^1$ | $Ar^2$ | $R^1$ | $Ar^3$ | |
|---|---|---|---|---|---|
| 64 | | | H | $OCH_3$ | |
| 65 | | | H | $OCH_3$ | |
| 66 | | | H | $OCH_3$ | |
| 67 | | | H | $OCH_3$ | |
| 68 | | | H | $OCH_3$ | |
| 69 | | | H | $OCH_3$ | |
| 70 | | | H | $OCH_3$ | |

| Compound No. | n | $-(CR^2=CR^3)_n-$ | $R^4$ | $Ar^4$ | $Ar^5$ |
|---|---|---|---|---|---|
| 64 | 1 | CH=CH | H | H | |
| 65 | 1 | CH=CH | H | H | |

TABLE 10-continued
| | | | | | |
|---|---|---|---|---|---|
| 66 | 1 | CH═CH | H | —$CH_3$ | 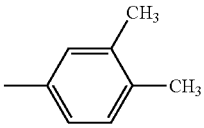 |
| 67 | 1 | CH═CH | H | H | 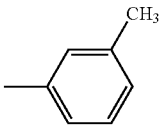 |
| 68 | 1 | CH═CH | H | H | 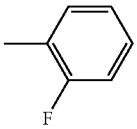 |
| 69 | 1 | CH═CH | H | H | 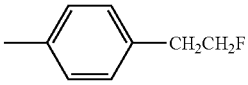 |
| 70 | 1 | CH═CH | H | H | 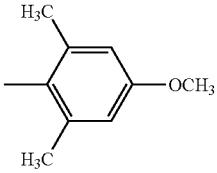 |
TABLE 11
| Compound No. | $Ar^1$ | $Ar^2$ | $R^1$ | $Ar^3$ | 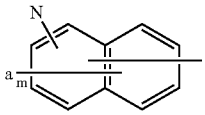 |
|---|---|---|---|---|---|
| 71 | 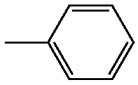 | 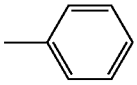 | H | 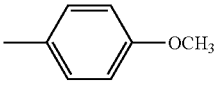 | 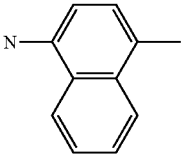 |
| 72 | 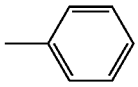 | 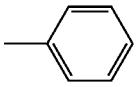 | H | 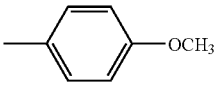 | 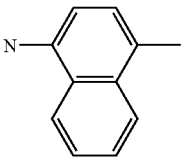 |
| 73 | 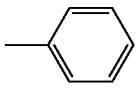 | 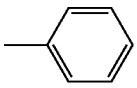 | H | 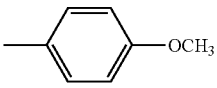 | 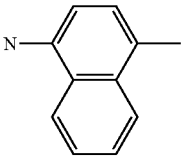 |
| 74 | 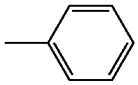 | 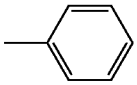 | H | 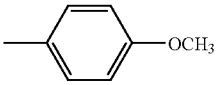 | 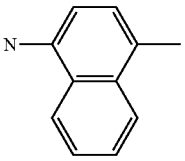 |

TABLE 11-continued
| | | | | |
|---|---|---|---|---|
| 75 | 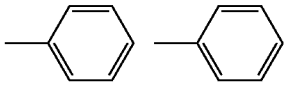 | H | 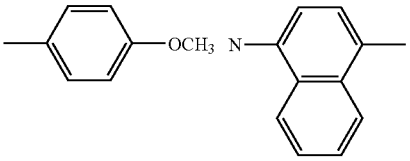 | |
| 76 | 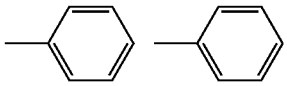 | H | 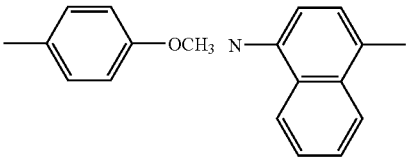 | |
| 77 | 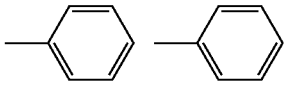 | H | 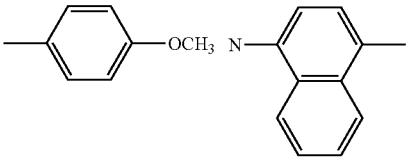 | |
| Compound No. | n | $-(CR^2=CR^3)_n-$ | $R^4$ | $Ar^4$ | $Ar^5$ |
|---|---|---|---|---|---|
| 71 | 1 | CH=CH | H | H | 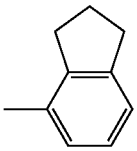 |
| 72 | 1 | CH=CH | H | H | 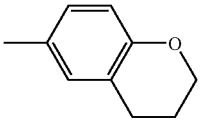 |
| 73 | 1 | CH=CH | H | H | 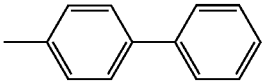 |
| 74 | 1 | CH=CH | H | H | 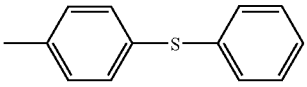 |
| 75 | 1 | CH=CH | H | H | 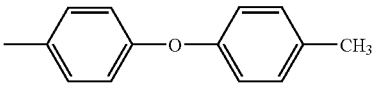 |
| 76 | 1 | CH=CH | H | H | 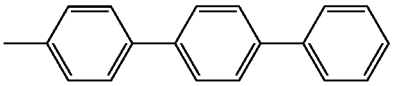 |
| 77 | 1 | CH=CH | H | H | 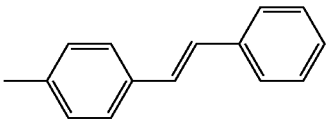 |

TABLE 12
| Compound No. | $Ar^1$ | $Ar^2$ | $R^1$ | $Ar^3$ | 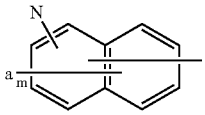 |
|---|---|---|---|---|---|
| 78 | 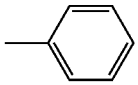 | 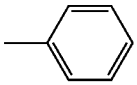 | H | 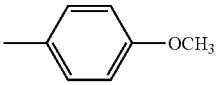 $OCH_3$ | N 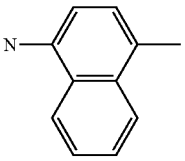 |
| 79 | 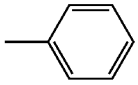 | 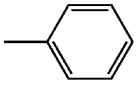 | H | 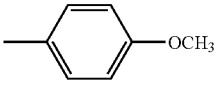 $OCH_3$ | N 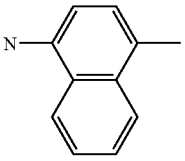 |
| 80 | 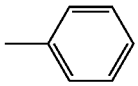 | 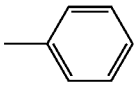 | H | 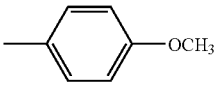 $OCH_3$ | N 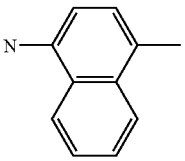 |
| 81 | 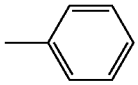 | 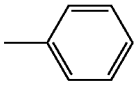 | H | 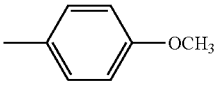 $OCH_3$ | N 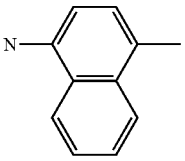 |
| 82 | 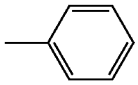 | 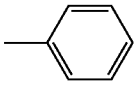 | H | 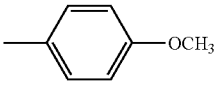 $OCH_3$ | N 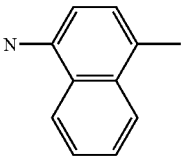 |
| 83 | 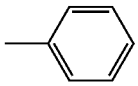 | 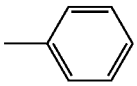 | H | 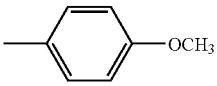 $OCH_3$ | N 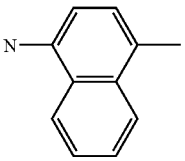 |
| 84 | 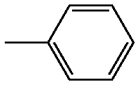 | 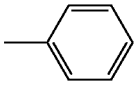 | H | 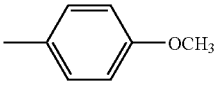 $OCH_3$ | N 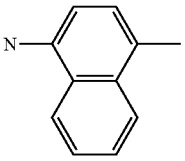 |
| Compound No. | n | $-(CR^2=CR^3)_n-$ | $R^4$ | $Ar^4$ | $Ar^5$ |
|---|---|---|---|---|---|
| 78 | 1 | CH=CH | H | H | 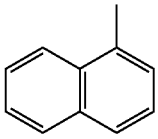 |

TABLE 12-continued
| | | | | | |
|---|---|---|---|---|---|
| 79 | 1 | CH=CH | H | H | 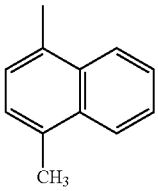 |
| 80 | 1 | CH=CH | H | H | 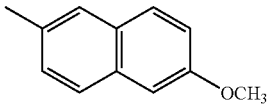 |
| 81 | 1 | CH=CH | H | H | 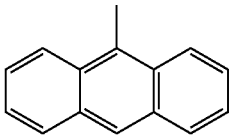 |
| 82 | 1 | CH=CH | H | H | 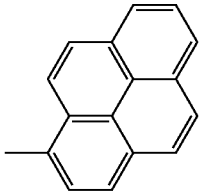 |
| 83 | 1 | CH=CH | H | H | 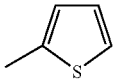 |
| 84 | 1 | CH=CH | H | H | 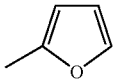 |
TABLE 13
| Compound No. | $Ar^1$ | $Ar^2$ | $R^1$ | $Ar^3$ | 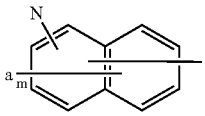 |
|---|---|---|---|---|---|
| 85 | 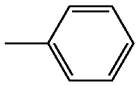 | 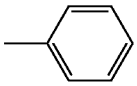 | H | 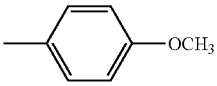 | 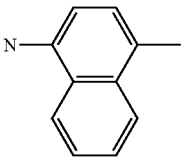 |
| 86 | 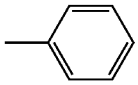 | 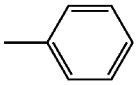 | H | 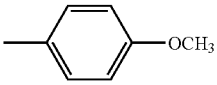 | 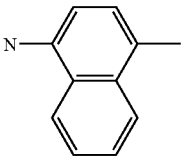 |
| 87 | 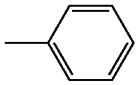 | 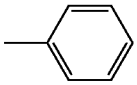 | H | 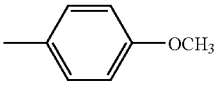 | 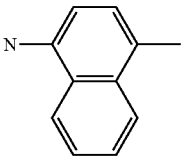 |

TABLE 13-continued
| | | | | |
|---|---|---|---|---|
| 88 | 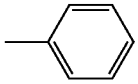 | 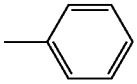 | H | 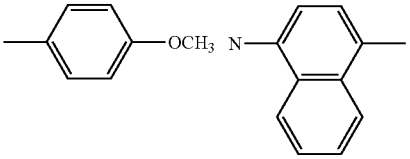 |
| 89 | 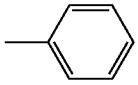 | 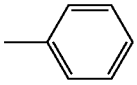 | H | 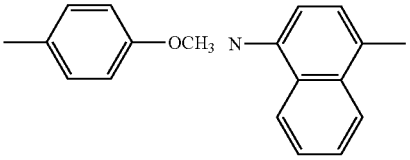 |
| 90 | 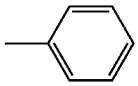 | 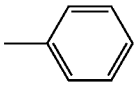 | H | 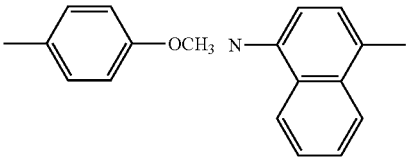 |
| 91 | 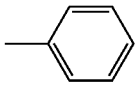 | 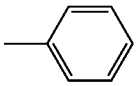 | H | 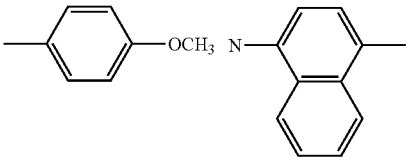 |
| Compound No. | n | $-(CR^2=CR^3)_n-$ | $R^4$ | $Ar^4$ | $Ar^5$ |
|---|---|---|---|---|---|
| 85 | 1 | CH=CH | H | $-CH_3$ | 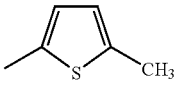 |
| 86 | 1 | CH=CH | H | $-CH_3$ | 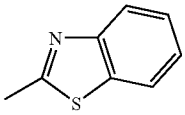 |
| 87 | 1 | CH=CH | H | $-CH_3$ | 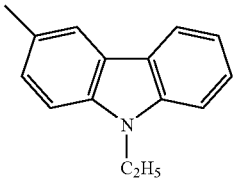 |
| 88 | 1 | CH=CH | H | 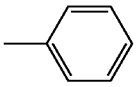 | 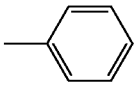 |
| 89 | 1 | CH=CH | H | 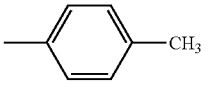 | 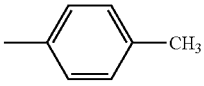 |
| 90 | 1 | CH=CH | H | 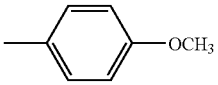 | 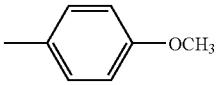 |

TABLE 13-continued
| | | | | |
|---|---|---|---|---|
| 91 | 1 | CH═CH | H | 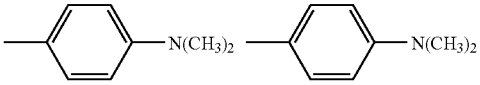 |
TABLE 14
| Compound No. | $Ar^1$ | $Ar^2$ | $R^1$ | $Ar^3$ | 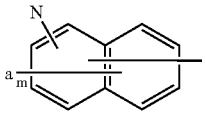 |
|---|---|---|---|---|---|
| 92 | 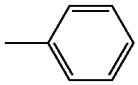 | 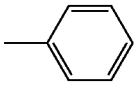 | H | 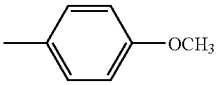 | 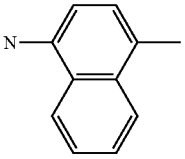 |
| 93 | 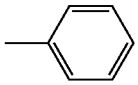 | 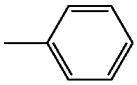 | H | 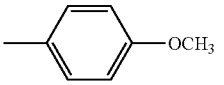 | 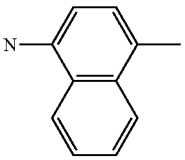 |
| 94 | 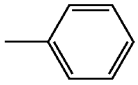 | 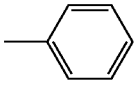 | H | 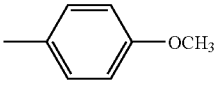 | 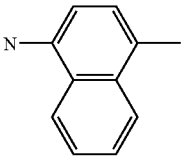 |
| 95 | 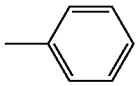 | 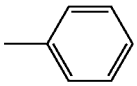 | H | 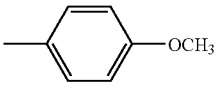 | 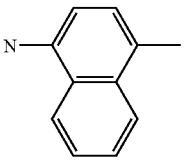 |
| 96 | 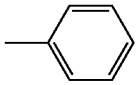 | 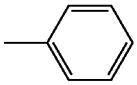 | H | 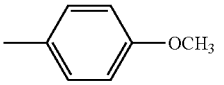 | 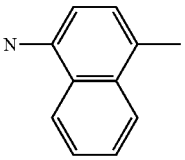 |
| 97 | 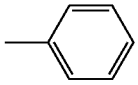 | 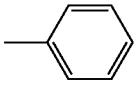 | H | 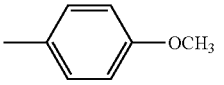 | 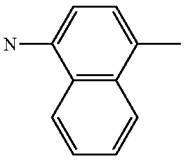 |
| 98 | 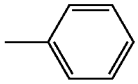 | 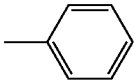 | H | 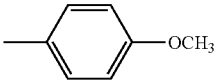 | 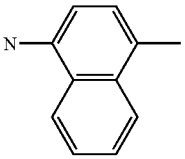 |

TABLE 14-continued
| Compound No. | n | $-(CR^2=CR^3)_n-$ | $R^4$ | $Ar^4$ | $Ar^5$ |
|---|---|---|---|---|---|
| 92 | 1 | CH=CH | H | 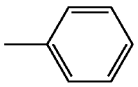 | 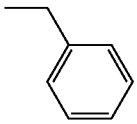 |
| 93 | 1 | CH=CH | H | 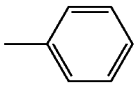 | 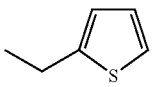 |
| 94 | 1 | CH=CH | H | 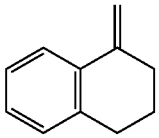 | |
| 95 | 1 | CH=CH | H | 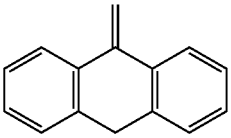 | |
| 96 | 1 | CH=CH | H | 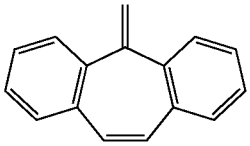 | |
| 97 | 1 | CH=CH | H | 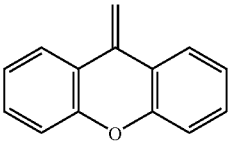 | |
| 98 | 1 | CH=CH | H | 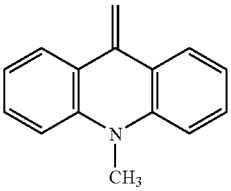 | |
TABLE 15
| Compound No. | $Ar^1$ | $Ar^2$ | $R^1$ | $Ar^3$ | 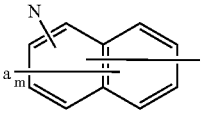 |
|---|---|---|---|---|---|
| 99 | 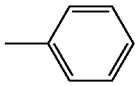 | 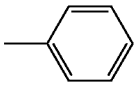 | H | 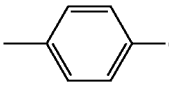 $OCH_3$ | 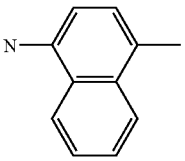 |

TABLE 15-continued
| | | | | | |
|---|---|---|---|---|---|
| 100 | 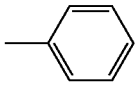 | 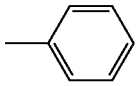 | H | 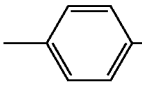 $OCH_3$ | N 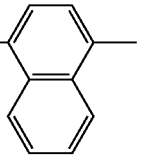 |
| 101 | 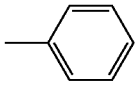 | 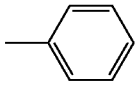 | H | 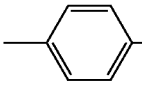 $OCH_3$ | N 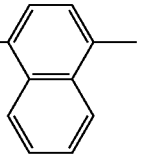 |
| 102 | 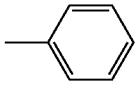 | 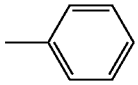 | H | 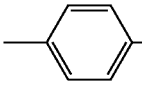 $OCH_3$ | N 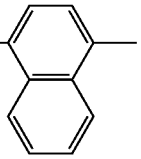 |
| 103 | 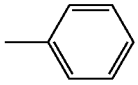 | 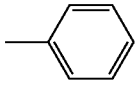 | H | 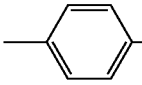 $OCH_3$ | N 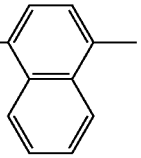 |
| 104 | 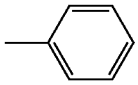 | 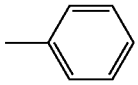 | H | 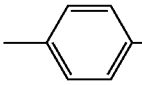 $OCH_3$ | N 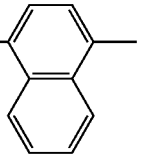 |
| 105 | 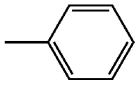 | 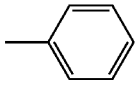 | H | 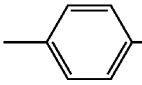 $OCH_3$ | N 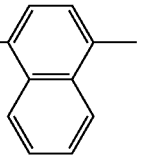 |
| Compound No. | n | $-(CR^2=CR^3)_n-$ | $R^4$ | $Ar^4$ | $Ar^5$ |
|---|---|---|---|---|---|
| 99 | 1 | CH=CH | $-CH_3$ | H | 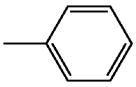 |
| 100 | 1 | CH=CH | 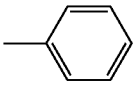 | H | 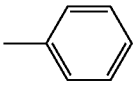 |
| 101 | 1 | 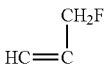 | H | H | 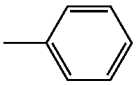 |
| 102 | 1 | 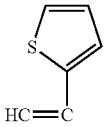 | H | H | 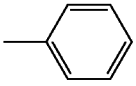 |

TABLE 15-continued

| | | | | | |
|---|---|---|---|---|---|
| 103 | 1 | HC═C | H | H | |
| 104 | 1 | $CH_3$ C═CH | H | H | |
| 105 | 1 | $CH_3$ HC═C | | H | |

TABLE 16

| Compound No. | $Ar^1$ | $Ar^2$ | $R^1$ | $Ar^3$ | |
|---|---|---|---|---|---|
| 106 | | | H | $OCH_3$ | N |
| 107 | | | H | $OCH_3$ | N |
| 108 | | | H | $OCH_3$ | N |
| 109 | | | H | $OCH_3$ | N |
| 110 | | | H | $OCH_3$ | N |
| 111 | | | H | $OCH_3$ | N |

TABLE 16-continued
| | | | | | |
|---|---|---|---|---|---|
| 112 | 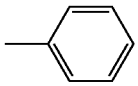 | 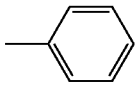 | H | 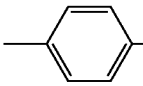 $OCH_3$ | N 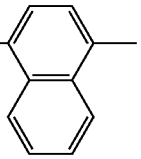 |
| Compound No. | n | $-(CR^2=CR^3)_n-$ | $R^4$ | $Ar^4$ | $Ar^5$ |
|---|---|---|---|---|---|
| 106 | 2 | CH=CH—CH=CH | H | H | 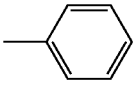 |
| 107 | 2 | CH=CH—CH=CH | H | H | 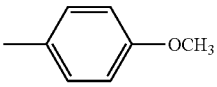 $OCH_3$ |
| 108 | 2 | CH=CH—CH=CH | H | $—CH_3$ | 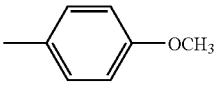 $OCH_3$ |
| 109 | 2 | CH=CH—CH=CH | H | $—CH_3$ | 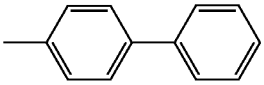 |
| 110 | 2 | CH=CH—CH=CH | H | $—CH_3$ | 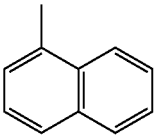 |
| 111 | 2 | CH=CH—CH=CH | H | $—CH_3$ | 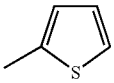 S |
| 112 | 2 | CH=CH—CH=CH | H | H | 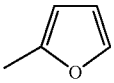 O |
TABLE 17
| Compound No. | $Ar^1$ | $Ar^2$ | $R^1$ | $Ar^3$ | 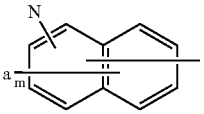 |
|---|---|---|---|---|---|
| 113 | 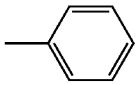 | 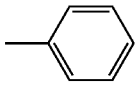 | H | 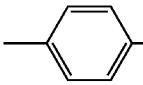 $OCH_3$ | N 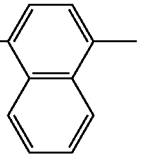 |
| 114 | 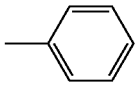 | 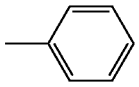 | H | 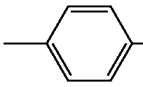 $OCH_3$ | N 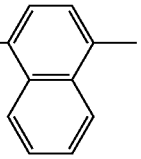 |

TABLE 17-continued
| | | | | |
|---|---|---|---|---|
| 115 | 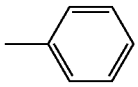 | 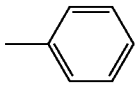 | H | 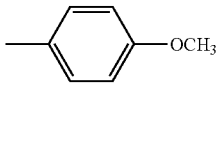 |
| 116 | 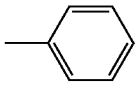 | 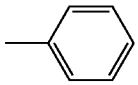 | H | 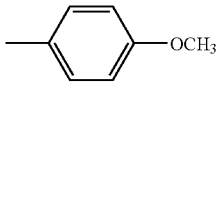 |
| 117 | 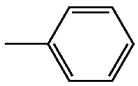 | 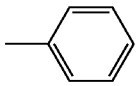 | H | 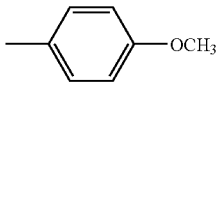 |
| 118 | 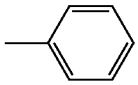 | 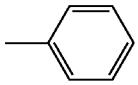 | H | 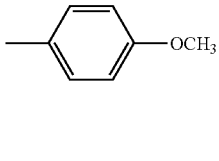 |
| 119 | 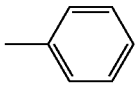 | 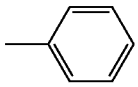 | H | 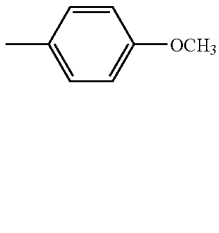 |
| Compound No. | n | $-(CR^2{=}CR^3)_n-$ | $R^4$ | $Ar^4$ | $Ar^5$ |
|---|---|---|---|---|---|
| 113 | 2 | 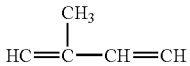 | H | H | 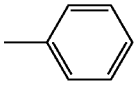 |
| 114 | 2 | 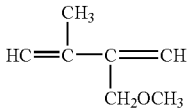 | H | H | 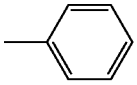 |
| 115 | 3 | $-(HC{=}CH)_3-$ | H | H | 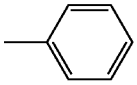 |
| 116 | 1 | CH═CH | H | H | 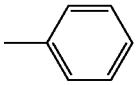 |
| 117 | 1 | CH═CH | H | H | 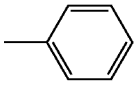 |

TABLE 17-continued
| | | | | | |
|---|---|---|---|---|---|
| 118 | 1 | CH═CH | H | H | 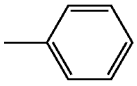 |
| 119 | 1 | CH═CH | H | H | 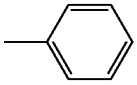 |
TABLE 18
| Compound No. | $Ar^1$ | $Ar^2$ | $R^1$ | $Ar^3$ | 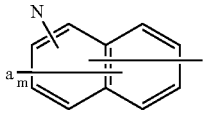 |
|---|---|---|---|---|---|
| 120 | 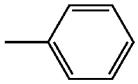 | 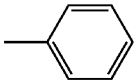 | H | 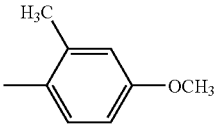 | 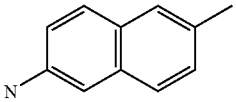 |
| 121 | 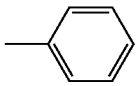 | 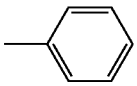 | H | 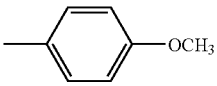 | 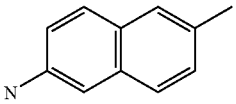 |
| 122 | 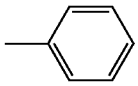 | 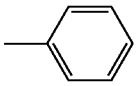 | H | 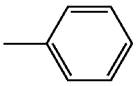 | 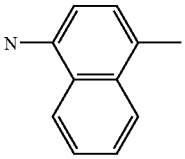 |
| 123 | 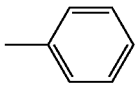 | 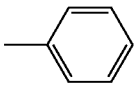 | H | 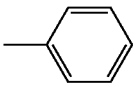 | 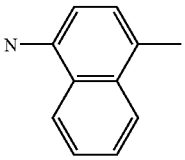 |
| 124 | 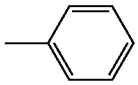 | 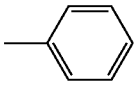 | H | 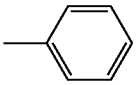 | 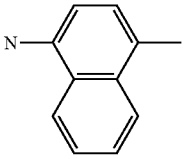 |
| 125 | 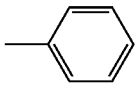 | 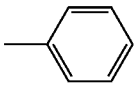 | H | 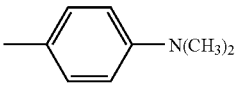 | 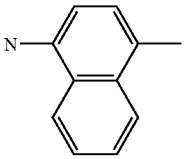 |
| 126 | 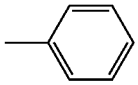 | 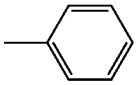 | H | 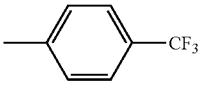 | 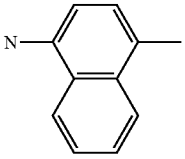 |

TABLE 18-continued
| Compound No. | n | $-(CR^2=CR^3)_n-$ | $R^4$ | $Ar^4$ | $Ar^5$ |
|---|---|---|---|---|---|
| 120 | 1 | CH=CH | H | H | 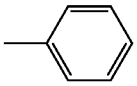 |
| 121 | 1 | CH=CH | H | H | 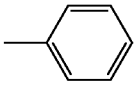 |
| 122 | 1 | CH=CH | H | H | 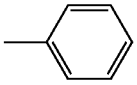 |
| 123 | 1 | CH=CH | H | $-CH_3$ | 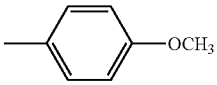 |
| 124 | 1 | CH=CH | H | 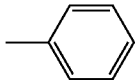 | 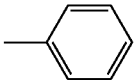 |
| 125 | 1 | CH=CH | H | H | 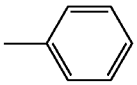 |
| 126 | 1 | CH=CH | H | H | 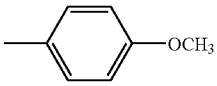 |
TABLE 19
| Compound No. | $Ar^1$ | $Ar^2$ | $R^1$ | $Ar^3$ | 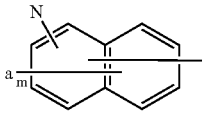 |
|---|---|---|---|---|---|
| 127 | 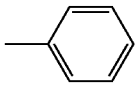 | 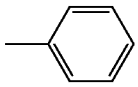 | H | 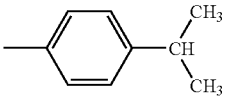 | 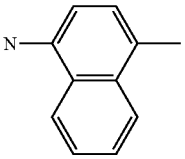 |
| 128 | 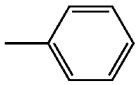 | 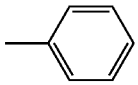 | H | 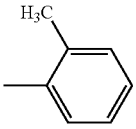 | 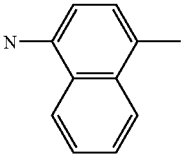 |
| 129 | 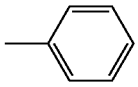 | 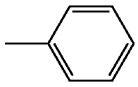 | H | 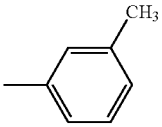 | 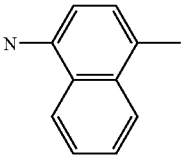 |

TABLE 19-continued
| | | | | |
|---|---|---|---|---|
| 130 | 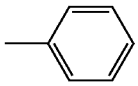 | 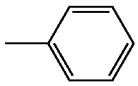 | H 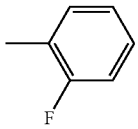 | 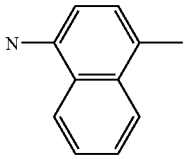 |
| 131 | 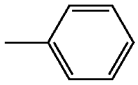 | 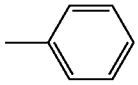 | H 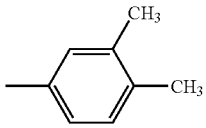 | 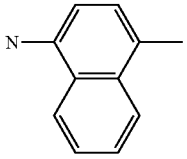 |
| 132 | 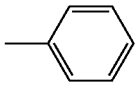 | 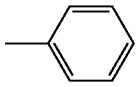 | H 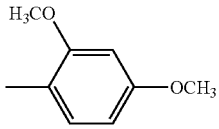 | 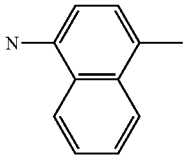 |
| 133 | 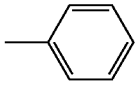 | 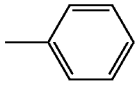 | H 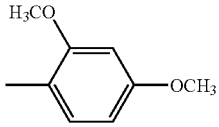 | 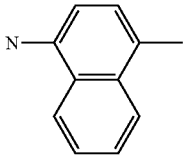 |
| Compound No. | n | $-(CR^2=CR^3)_n-$ | $R^4$ | $Ar^4$ | $Ar^5$ |
|---|---|---|---|---|---|
| 127 | 1 | CH=CH | H | 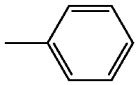 | 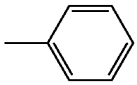 |
| 128 | 1 | CH=CH | H | H | 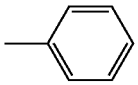 |
| 129 | 1 | CH=CH | H | H | 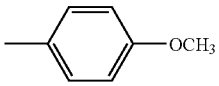 |
| 130 | 1 | CH=CH | H | 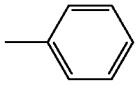 | 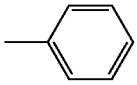 |
| 131 | 1 | CH=CH | H | H | 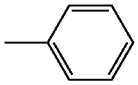 |
| 132 | 1 | CH=CH | H | $-CH_3$ | 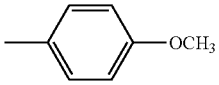 |
| 133 | 1 | CH=CH | H | 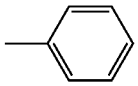 | 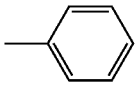 |

TABLE 20
| Compound No. | $Ar^1$ | $Ar^2$ | $R^1$ | $Ar^3$ | 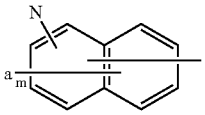 |
|---|---|---|---|---|---|
| 134 | 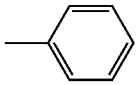 | 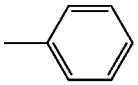 | H | 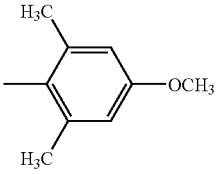 | 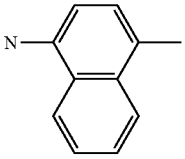 |
| 135 | 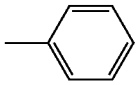 | 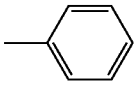 | H | 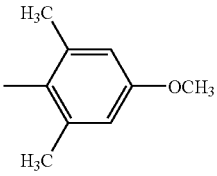 | 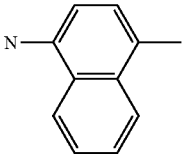 |
| 136 | 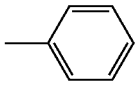 | 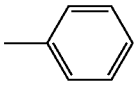 | H | 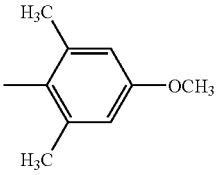 | 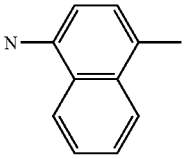 |
| 137 | 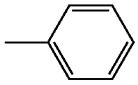 | 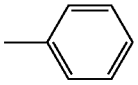 | H | 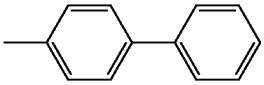 | 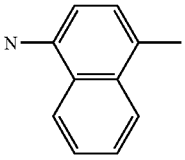 |
| 138 | 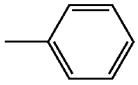 | 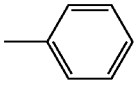 | H | 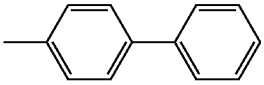 | 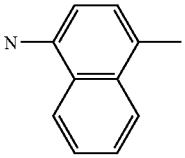 |
| 139 | 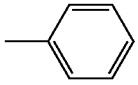 | 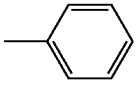 | H | 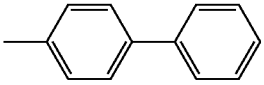 | 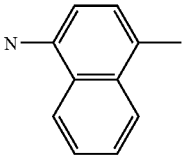 |
| 140 | 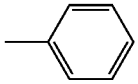 | 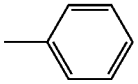 | H | 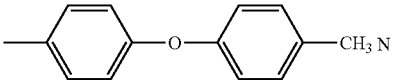 | 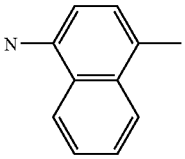 |
| Compound No. | n | $-(CR^2=CR^3)_n-$ | $R^4$ | $Ar^4$ | $Ar^5$ |
|---|---|---|---|---|---|
| 134 | 1 | CH=CH | H | H | 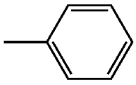 |

TABLE 20-continued
| | | | | | |
|---|---|---|---|---|---|
| 135 | 1 | CH═CH | H | H | 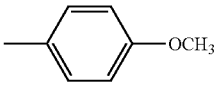 |
| 136 | 1 | CH═CH | H | 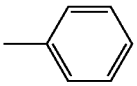 | 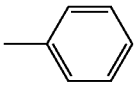 |
| 137 | 1 | CH═CH | H | H | 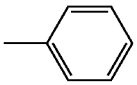 |
| 138 | 1 | CH═CH | H | —$CH_3$ | 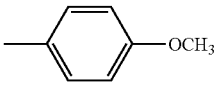 |
| 139 | 1 | CH═CH | H | 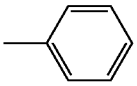 | 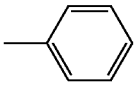 |
| 140 | 1 | CH═CH | H | H | 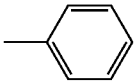 |
TABLE 21
| Compound No. | $Ar^1$ | $Ar^2$ | $R^1$ | $Ar^3$ | 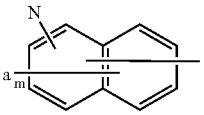 |
|---|---|---|---|---|---|
| 141 | 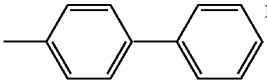 | | H | 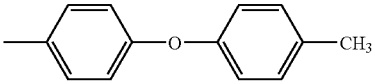 | 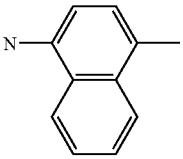 |
| 142 | 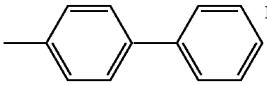 | | H | 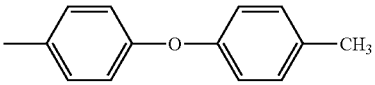 | 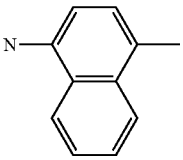 |
| 143 | 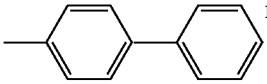 | | H | 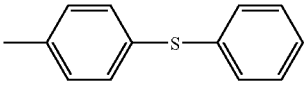 | 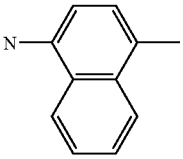 |
| 144 | 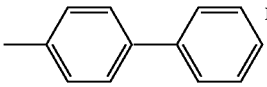 | | H | 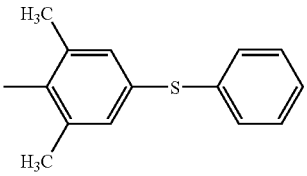 | 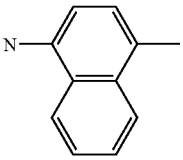 |

TABLE 21-continued
| | | | |
|---|---|---|---|
| 145 | 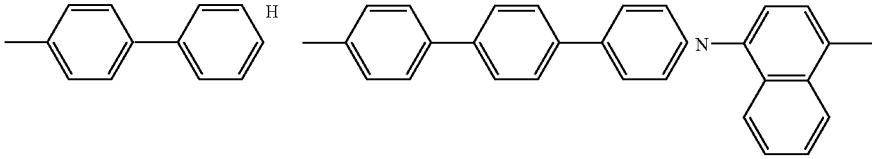 | | |
| 146 | 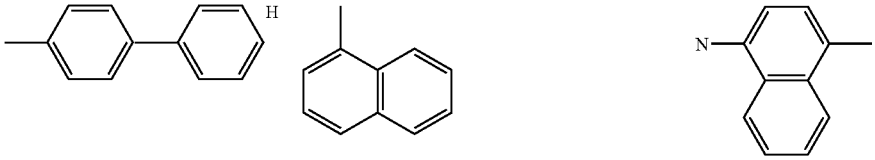 | | |
| 147 | 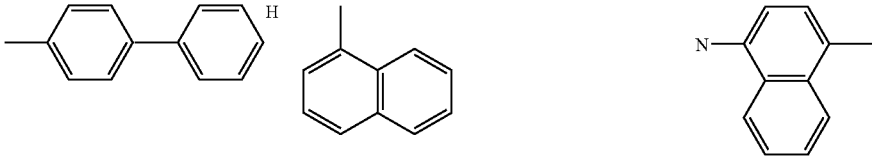 | | |
| Compound No. | n | —(CR²=CR³)ₙ— | R⁴ | Ar⁴ | Ar⁵ |
|---|---|---|---|---|---|
| 141 | 1 | CH=CH | H | H | 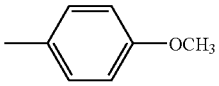 |
| 142 | 1 | CH=CH | H | —$CH_3$ | 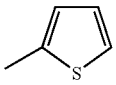 |
| 143 | 1 | CH=CH | H | H | 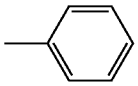 |
| 144 | 1 | CH=CH | H | —$CH_3$ | 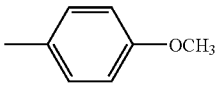 |
| 145 | 1 | CH=CH | H | —$CH_3$ | 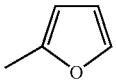 |
| 146 | 1 | CH=CH | H | H | 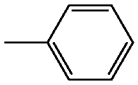 |
| 147 | 1 | CH=CH | H | —$CH_3$ | 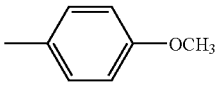 |

TABLE 22
| Compound No. | $Ar^1$ | $Ar^2$ | $R^1$ | $Ar^3$ | |
|---|---|---|---|---|---|
| 148 | 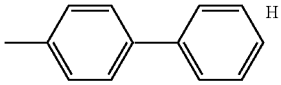 | | H | 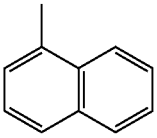 | 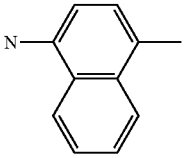 |
| 149 | 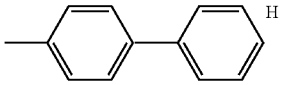 | | H | 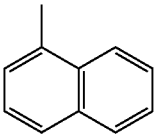 | 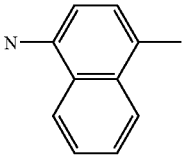 |
| 150 | 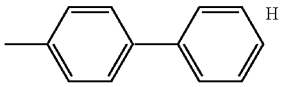 | | H | 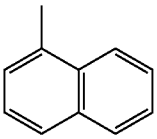 | 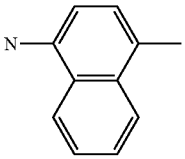 |
| 151 | 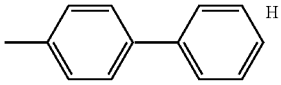 | | H | 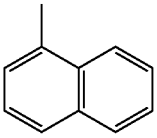 | 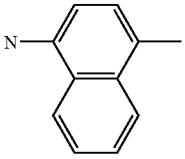 |
| 152 | 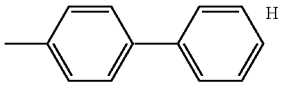 | | H | 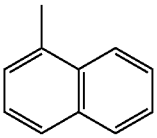 | 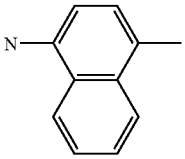 |
| 153 | 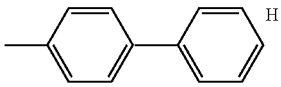 | | H | 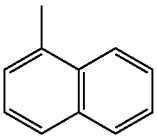 | 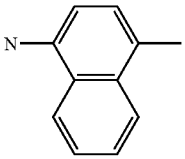 |
| 154 | 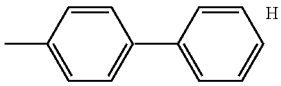 | | H | 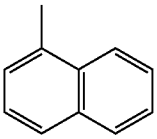 | 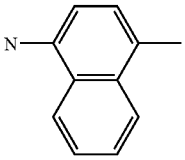 |
| Compound No. | n | $-(CR^2=CR^3)_n-$ | $R^4$ | $Ar^4$ | $Ar^5$ |
|---|---|---|---|---|---|
| 148 | 1 | CH=CH | H | H | 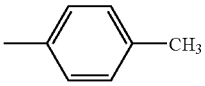 |
| 149 | 1 | CH=CH | H | $-CH_3$ | 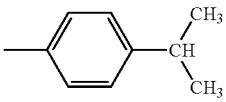 |

TABLE 22-continued
| | | | | | |
|---|---|---|---|---|---|
| 150 | 1 | CH═CH | H | H | 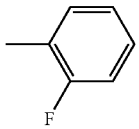 |
| 151 | 1 | CH═CH | H | —$CH_3$ | 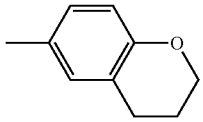 |
| 152 | 1 | CH═CH | H | —$CH_3$ | 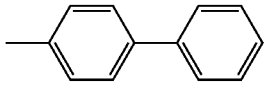 |
| 153 | 1 | CH═CH | H | —$CH_3$ | 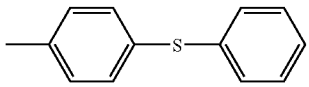 |
| 154 | 1 | CH═CH | H | H | 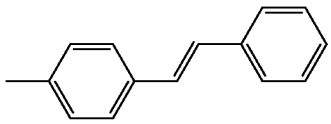 |
TABLE 23
| Compound No. | $Ar^1$ | $Ar^2$ | $R^1$ | $Ar^3$ | 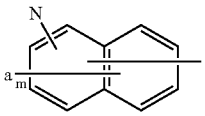 |
|---|---|---|---|---|---|
| 155 | 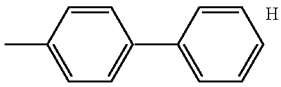 | | H | 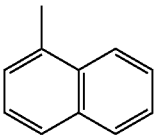 | 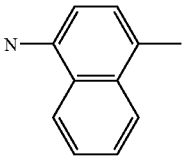 |
| 156 | 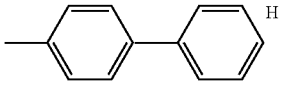 | | H | 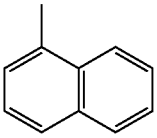 | 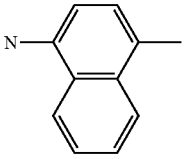 |
| 157 | 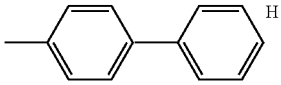 | | H | 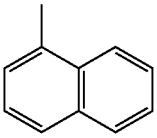 | 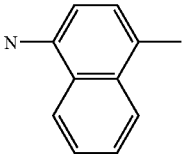 |
| 158 | 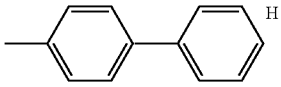 | | H | 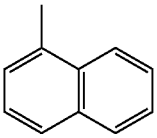 | 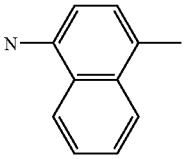 |

TABLE 23-continued
| | | | |
|---|---|---|---|
| 159 | 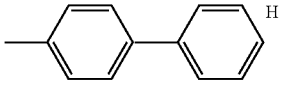 H | 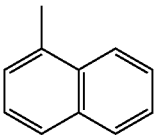 | N 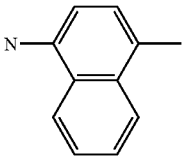 |
| 160 | 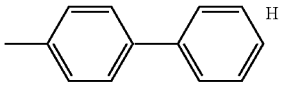 H | 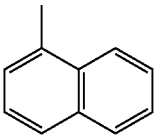 | N 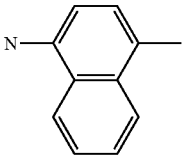 |
| 161 | 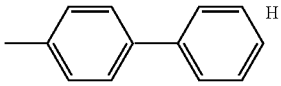 H | 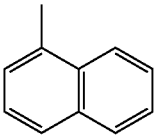 | N 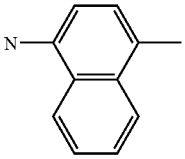 |
| Compound No. | n | $-(CR^2=CR^3)_n-$ | $R^4$ | $Ar^4$ | $Ar^5$ |
|---|---|---|---|---|---|
| 155 | 1 | CH═CH | H | $-CH_3$ | 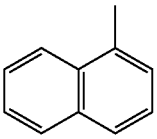 |
| 156 | 1 | CH═CH | H | $-CH_3$ | 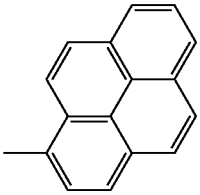 |
| 157 | 1 | CH═CH | H | $-CH_3$ | 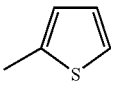 |
| 158 | 1 | CH═CH | H | H | 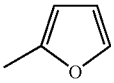 |
| 159 | 1 | CH═CH | H | 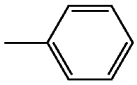 | 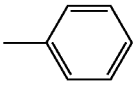 |
| 160 | 1 | CH═CH | H | 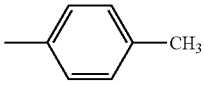 $CH_3$ | 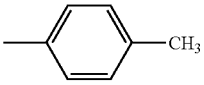 $CH_3$ |
| 161 | 1 | CH═CH | H | 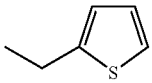 | 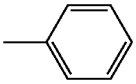 |

TABLE 24
| Compound No. | $Ar^1$ | $Ar^2$ | $R^1$ | $Ar^3$ | 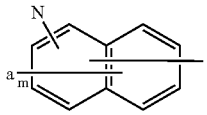 |
|---|---|---|---|---|---|
| 162 | 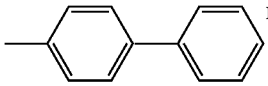 | | H | 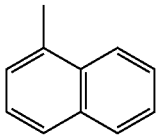 | 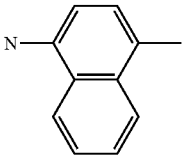 |
| 163 | 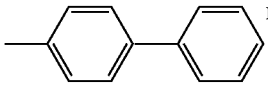 | | H | 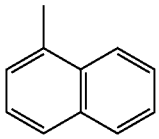 | 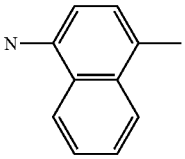 |
| 164 | 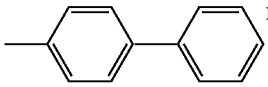 | | H | 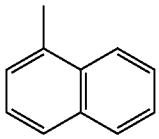 | 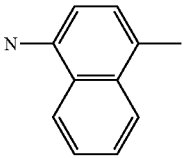 |
| 165 | 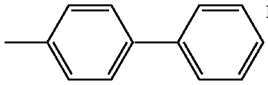 | | H | 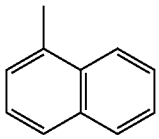 | 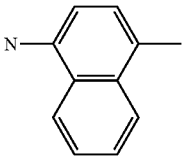 |
| 166 | 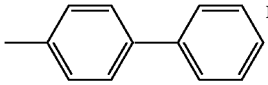 | | H | 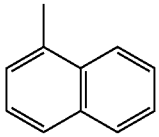 | 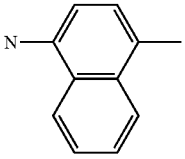 |
| 167 | 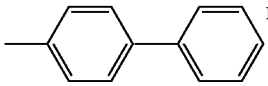 | | H | 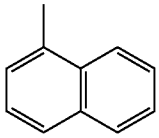 | 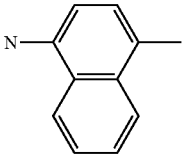 |
| 168 | 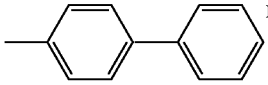 | | H | 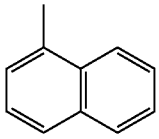 | 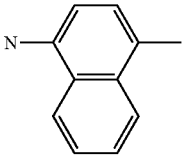 |
| Compound No. | n | $-(CR^2=CR^3)_n-$ | $R^4$ | $Ar^4$ | $Ar^5$ |
|---|---|---|---|---|---|
| 162 | 1 | CH=CH | H | | 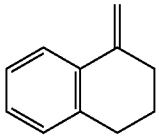 |

TABLE 24-continued
| | | | | | |
|---|---|---|---|---|---|
| 163 | 1 | CH═CH | H | | 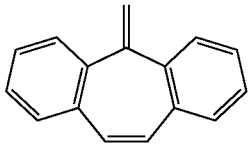 |
| 164 | 1 | CH═CH | H | | 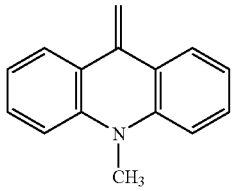 |
| 165 | 2 | CH═CH—CH═CH | H | H | 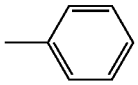 |
| 166 | 2 | CH═CH—CH═CH | H | —$CH_3$ | 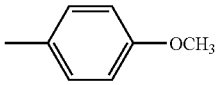 |
| 167 | 2 | CH═CH—CH═CH | H | —$CH_3$ | 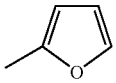 |
| 168 | 3 | $-(HC{=}CH)_3-$ | H | H | 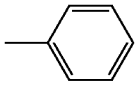 |
TABLE 25
| Compound No. | $Ar^1$ | $Ar^2$ | $R^1$ | $Ar^3$ | 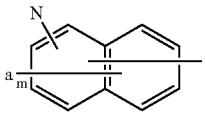 |
|---|---|---|---|---|---|
| 169 | 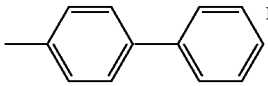 | | H | 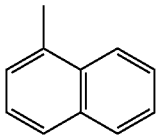 | 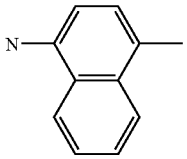 |
| 170 | 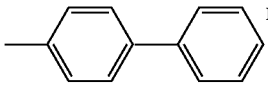 | | H | 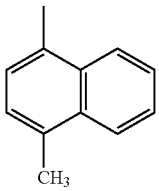 | 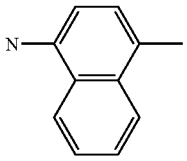 |
| 171 | 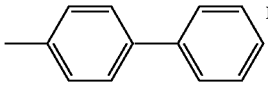 | | H | 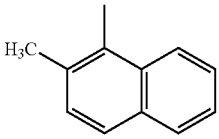 | 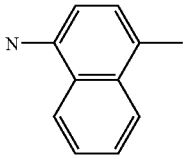 |

TABLE 25-continued
| | | | |
|---|---|---|---|
| 172 | 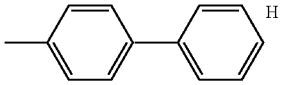 | 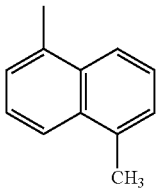 | 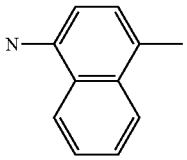 |
| 173 | 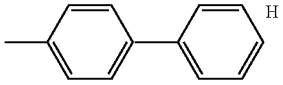 | 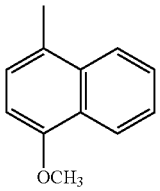 | 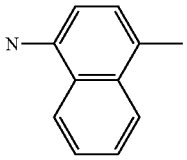 |
| 174 | 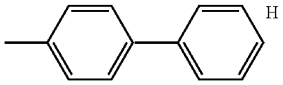 | 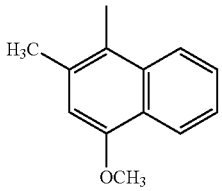 | 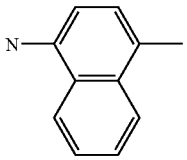 |
| 175 | 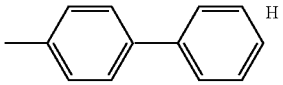 | 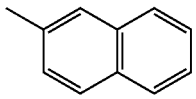 | 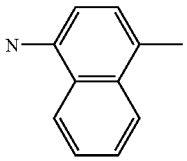 |
| Compound No. | n | $-(CR^2=CR^3)_n-$ | $R^4$ | $Ar^4$ | $Ar^5$ |
|---|---|---|---|---|---|
| 169 | 1 | CH=CH | H | H | 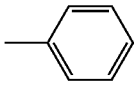 |
| 170 | 1 | CH=CH | H | H | 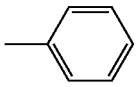 |
| 171 | 1 | CH=CH | H | H | 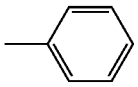 |
| 172 | 1 | CH=CH | H | H | 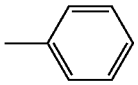 |
| 173 | 1 | CH=CH | H | H | 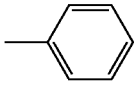 |
| 174 | 1 | CH=CH | H | H | 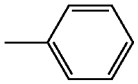 |
| 175 | 1 | CH=CH | H | H | 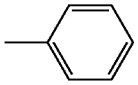 |

TABLE 26
| Compound No. | $Ar^1$ | $Ar^2$ | $R^1$ | $Ar^3$ | 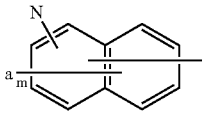 |
|---|---|---|---|---|---|
| 176 | 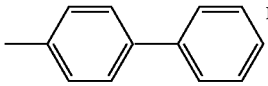 | | H | 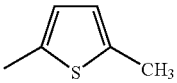 | 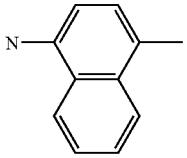 |
| 177 | 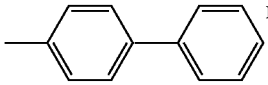 | | H | 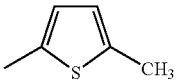 | 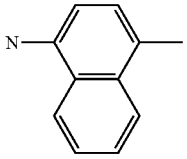 |
| 178 | 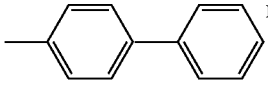 | | H | 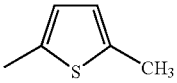 | 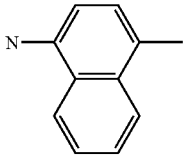 |
| 179 | 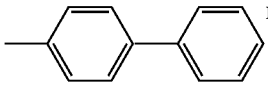 | | H | 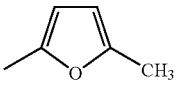 | 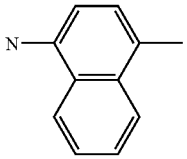 |
| 180 | 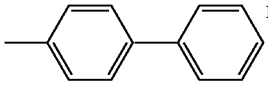 | | H | 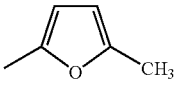 | 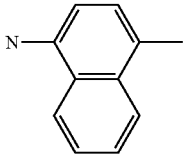 |
| 181 | 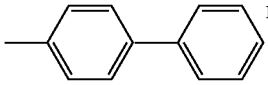 | | H | 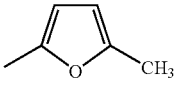 | 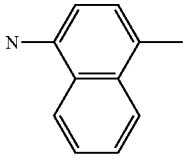 |
| 182 | 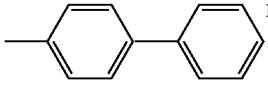 | | H | 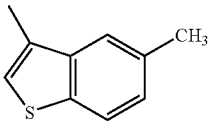 | 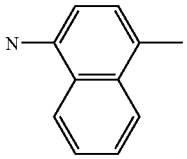 |
| Compound No. | n | $-(CR^2{=}CR^3)_n-$ | $R^4$ | $Ar^4$ | $Ar^5$ |
|---|---|---|---|---|---|
| 176 | 1 | CH═CH | H | H | 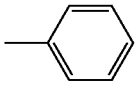 |
| 177 | 1 | CH═CH | H | H | 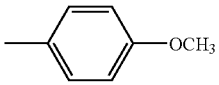 |

TABLE 26-continued

| | | | | | |
|---|---|---|---|---|---|
| 178 | 1 | CH═CH | H | | |
| 179 | 1 | CH═CH | H | H | |
| 180 | 1 | CH═CH | H | —$CH_3$ | $OCH_3$ |
| 181 | 1 | CH═CH | H | | |
| 182 | 1 | CH═CH | H | H | |

TABLE 27

| Compound No. | $Ar^1$ | $Ar^2$ | $R^1$ | $Ar^3$ | |
|---|---|---|---|---|---|
| 183 | | | H | N, S, $CH_3$ | N |
| 184 | | | H | $CH_3$, N, $C_2H_5$ | N |
| 185 | | | H | | N |
| 186 | | | H | $OCH_3$ | N |
| 187 | | | H | | N |

TABLE 27-continued
| | | | | |
|---|---|---|---|---|
| 188 | 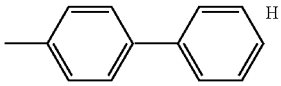 H | 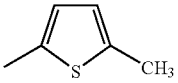 | 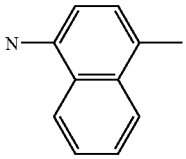 | |
| 189 | 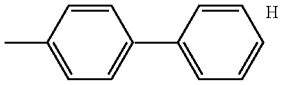 H | 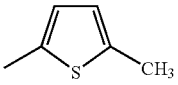 | 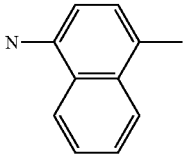 | |
| Compound No. | n | $-(CR^2=CR^3)_n-$ | $R^4$ | $Ar^4$ | $Ar^5$ |
|---|---|---|---|---|---|
| 183 | 1 | CH=CH | H | $-CH_3$ | 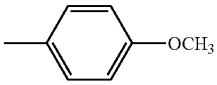 |
| 184 | 1 | CH=CH | H | 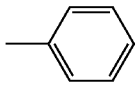 | 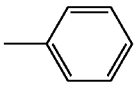 |
| 185 | 1 | CH=CH | H | H | 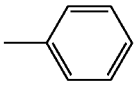 |
| 186 | 1 | CH=CH | H | H | 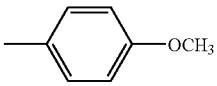 |
| 187 | 1 | CH=CH | H | 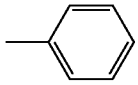 | 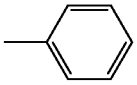 |
| 188 | 0 | — | H | H | 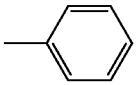 |
| 189 | 0 | — | H | H | 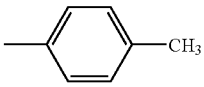 |
TABLE 28
| Compound No. | $Ar^1$ | $Ar^2$ | $R^1$ | $Ar^3$ | 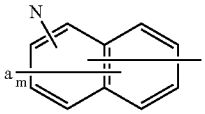 |
|---|---|---|---|---|---|
| 190 | 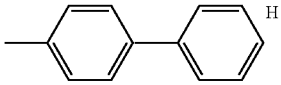 | H | 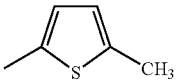 | | 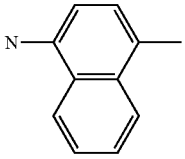 |

TABLE 28-continued
| | | | |
|---|---|---|---|
| 191 | 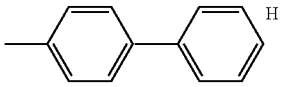 | 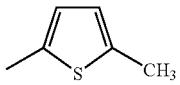 | 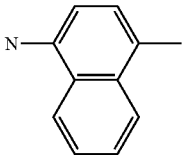 |
| 192 | 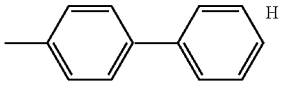 | 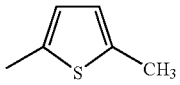 | 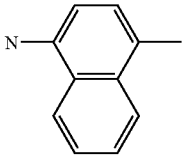 |
| 193 | 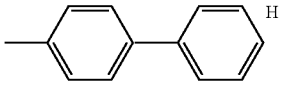 | 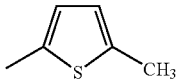 | 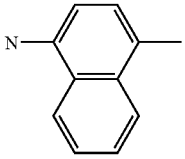 |
| 194 | 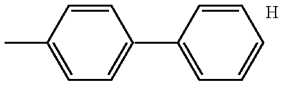 | 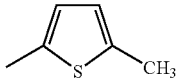 | 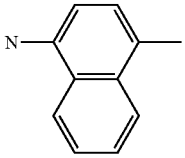 |
| 195 | 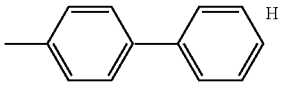 | 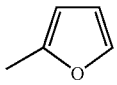 | 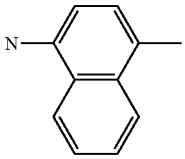 |
| 196 | 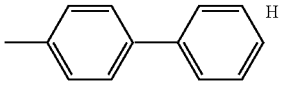 | 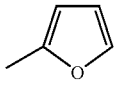 | 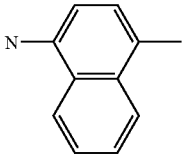 |
| Compound No. | n | $-(CR^2=CR^3)_n-$ | $R^4$ | $Ar^4$ | $Ar^5$ |
|---|---|---|---|---|---|
| 190 | 0 | — | H | H | 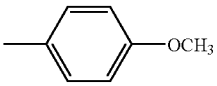 |
| 191 | 0 | — | H | H | 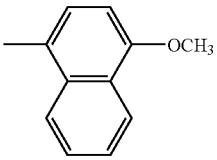 |
| 192 | 0 | — | H | H | 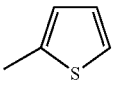 |
| 193 | 0 | — | H | H | 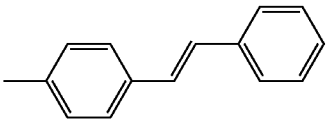 |

TABLE 28-continued

| | | | | | |
|---|---|---|---|---|---|
| 194 | 0 | — | H | | |
| 195 | 0 | — | H | H | |
| 196 | 0 | — | H | H | $CH_3$ |

TABLE 29

| Compound No. | $Ar^1$ | $Ar^2$ | $R^1$ | $Ar^3$ | |
|---|---|---|---|---|---|
| 197 | | | H | O | N |
| 198 | | | H | O | N |
| 199 | | | H | O | N |
| 200 | | | H | O | N |
| 201 | | | H | O | N |
| 202 | | | H | O $CH_3$ | N |

TABLE 29-continued
| | | | | | |
|---|---|---|---|---|---|
| 203 | 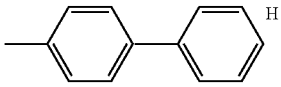 | H | 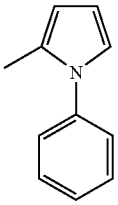 | | 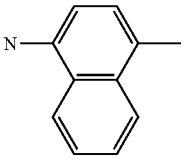 |
| Compound No. | n | —(CR²=CR³)ₙ— | R⁴ | Ar⁴ | Ar⁵ |
|---|---|---|---|---|---|
| 197 | 0 | — | H | H | 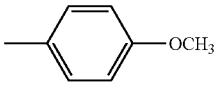 |
| 198 | 0 | — | H | H | 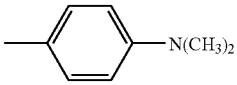 |
| 199 | 0 | — | H | H | 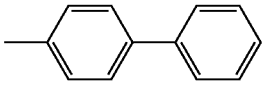 |
| 200 | 0 | — | H | H | 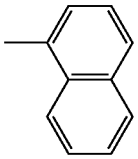 |
| 201 | 0 | — | H | 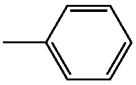 | 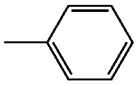 |
| 202 | 0 | — | H | H | 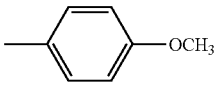 |
| 203 | 0 | — | H | H | 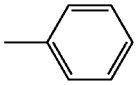 |
TABLE 30
| Compound No. | Ar¹ | Ar² | R¹ | Ar³ | 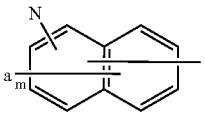 |
|---|---|---|---|---|---|
| 204 | 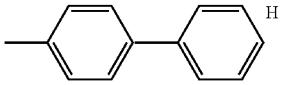 | | H | 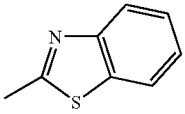 | 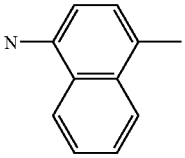 |
| 205 | 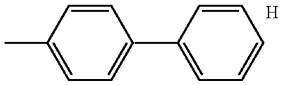 | | H | 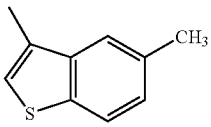 | 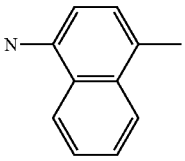 |

TABLE 30-continued
| | | | |
|---|---|---|---|
| 206 | 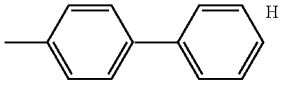 H | 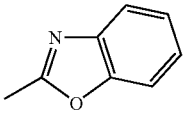 | 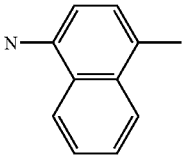 |
| 207 | 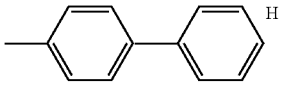 H | 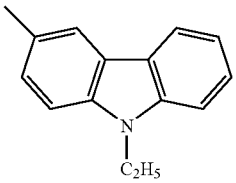 | 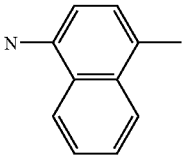 |
| 208 | 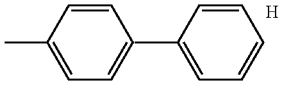 H | 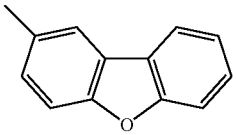 | 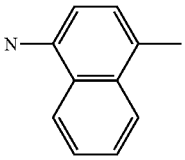 |
| 209 | 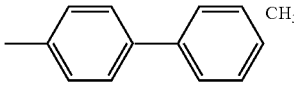 $CH_3$ | 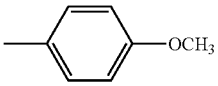 $OCH_3$ | 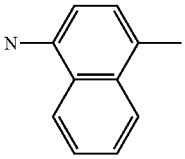 |
| 210 | 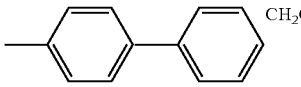 $CH_2CF_3$ | 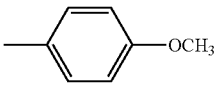 $OCH_3$ | 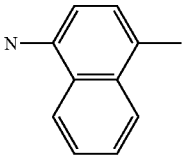 |
| Compound No. | n | $-(CR^2=CR^3)_n-$ | $R^4$ | $Ar^4$ | $Ar^5$ |
|---|---|---|---|---|---|
| 204 | 0 | — | H | H | 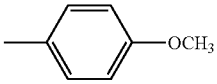 $OCH_3$ |
| 205 | 0 | — | H | 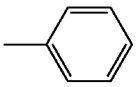 | 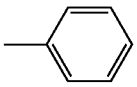 |
| 206 | 0 | — | H | H | 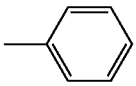 |

TABLE 30-continued
| | | | | | | |
|---|---|---|---|---|---|---|
| 207 | 0 | — | H | H | | 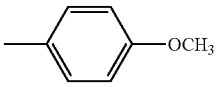 |
| 208 | 0 | — | H | 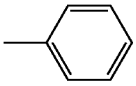 | | 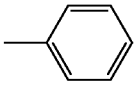 |
| 209 | 1 | CH═CH | H | H | | 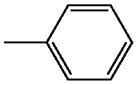 |
| 210 | 1 | CH═CH | H | H | | 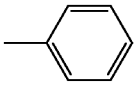 |

TABLE 31
| Compound No. | $Ar^1$ | $Ar^2$ | $R^1$ | $Ar^3$ | 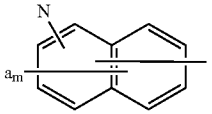 | n | $-(CR^2{=}CR^3)_n-$ | $R^4$ | $Ar^4$ | $Ar^5$ |
|---|---|---|---|---|---|---|---|---|---|---|
| 211 | 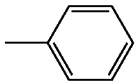 | 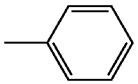 | $CH(CH_3)_2$ | 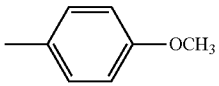 | 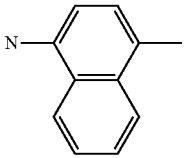 | 1 | CH═CH | H | H | 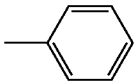 |
| 212 | 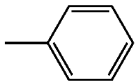 | 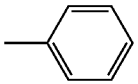 | F | 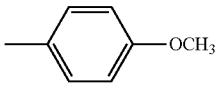 | 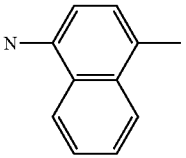 | 1 | CH═CH | H | H | 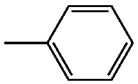 |
| 213 | 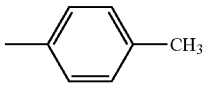 | 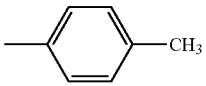 | H | 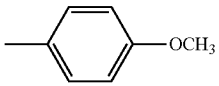 | 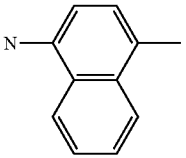 | 1 | CH═CH | H | H | 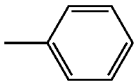 |
| 214 | 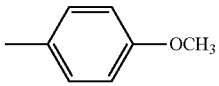 | 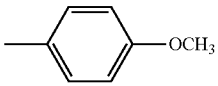 | H | 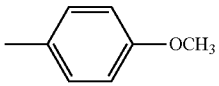 | 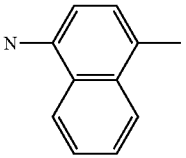 | 1 | CH═CH | H | H | 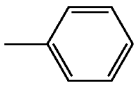 |

TABLE 31-continued
| Compound No. | $Ar^1$ | $Ar^2$ | $R^1$ | $Ar^3$ | 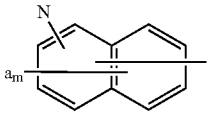 | n | $-(CR^2{=}CR^3)_n-$ | $R^4$ | $Ar^4$ | $Ar^5$ |
|---|---|---|---|---|---|---|---|---|---|---|
| 215 | 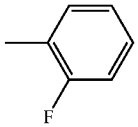 | 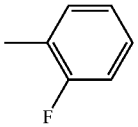 | H | 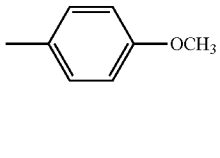 | | 1 | CH═CH | H | H | 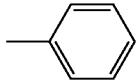 |
| 216 | 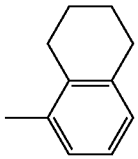 | 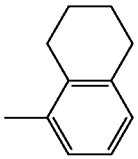 | H | 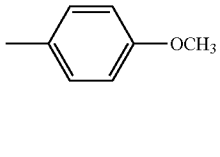 | | 1 | CH═CH | H | H | 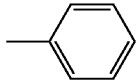 |
| 217 | 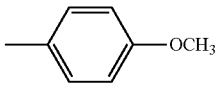 | 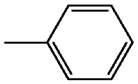 | H | 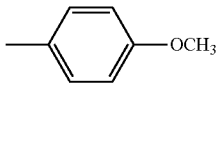 | | 1 | CH═CH | H | H | 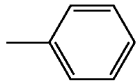 |

TABLE 32
| Compound No. | $Ar^1$ | $Ar^2$ | $R^1$ | $Ar^3$ | 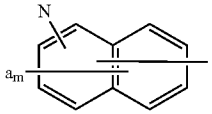 | n | $-(CR^2{=}CR^3)_n-$ | $R^4$ | $Ar^4$ | $Ar^5$ |
|---|---|---|---|---|---|---|---|---|---|---|
| 218 | 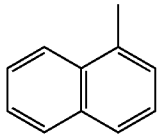 | 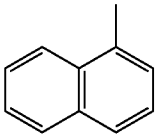 | H | 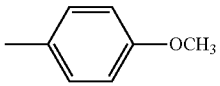 | 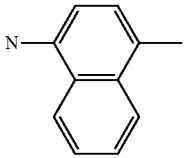 | 1 | CH═CH | H | H | 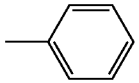 |
| 219 | 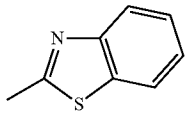 | 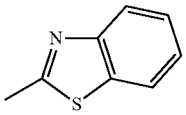 | H | 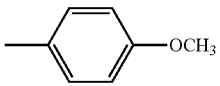 | 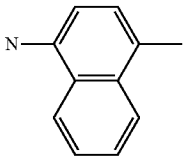 | 1 | CH═CH | H | H | 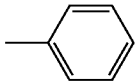 |
| 220 | 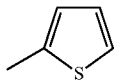 | 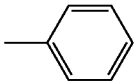 | H | 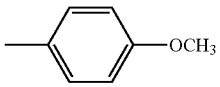 | 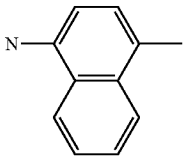 | 1 | CH═CH | H | H | 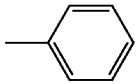 |

The enamine compound represented by formula (1) may be produced, for example, as follows.

First, an aldehyde compound or a ketone compound represented by the following formula (3) is reacted with a secondary amine compound represented by the following formula (4) through dehydrating condensation to give an enamine intermediate represented by the following formula (5).

(3)

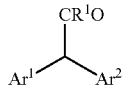

(wherein $Ar^1$, $Ar^2$ and $R^1$ are the same as those defined in the general formula (1).)

(4)

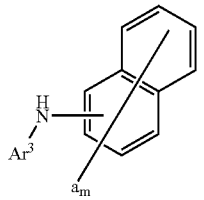

(wherein $Ar^3$, "a" and "m" represent the same as those defined in the general formula (1).)

(5)

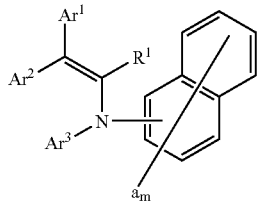

(wherein $Ar^1$, $Ar^2$, $Ar^3$, $R^1$, "a" and "m" represent the same as those defined in the general formula (1).)

The dehydrating condensation is effected, for example, as follows. An aldehyde or ketone compound represented by the general formula (3) and a secondary amine compound represented by the general formula (4) are, approximately in a ratio of 1/1 by mol, dissolved in a solvent of, for example, aromatic solvents, alcohols or ethers to prepare a solution. Specific examples of the usable solvent are toluene, xylene, chlorobenzene, butanol and diethylene glycol dimethyl ether. To the thus-prepared solution, added is a catalyst, for example, an acid catalyst such as p-toluenesulfonic acid, camphorsulfonic acid or pyridinium-p-toluenesulfonate acid, and reacted under heat. The amount of the catalyst to be added is preferably in a ratio by molar equivalent of from 1/10 to 1/1000 to the amount of the aldehyde or ketone compound represented by formula (3), more preferably from 1/25 to 1/500, most preferably from 1/50 to 1/200. During the reaction, water is formed, thereby interfering with the reaction. Therefore, the water formed is removed out of the system through azeotropic evaporation with the solvent used. As a result, the enamine intermediate represented by the general formula (5) is produced at high yield.

The enamine intermediate represented by the general formula (5) is formylated through Vilsmeier reaction or is acylated through Friedel-Crafts reaction to give an enamine-carbonyl intermediate of the following general formula (6). At this time, the formylation through Vilsmeier reaction gives an enamine-aldehyde intermediate, a type of the enamine-carbonyl intermediate represented by the general formula (6) where $R^5$ is a hydrogen atom; and the acylation through Friedel-Crafts reaction gives an enamine-keto intermediate, a type of the enamine-carbonyl intermediate represented by the general formula (6) where $R^5$ is a group except hydrogen atom.

(6)

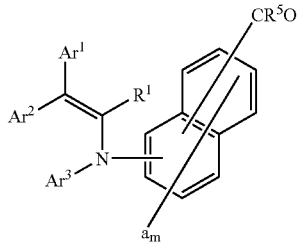

(wherein $R^5$ is $R^4$ when n in the general formula (1) is 0, but is $R^2$ when n is 1, 2 or 3; and $Ar^1$, $Ar^2$, $Ar^3$, $R^1$, $R^2$, $R^4$ a, m and n are the same as those defined in the general formula (1).)

The Vilsmeier reaction is effected, for example, as follows. Phosphorus oxychloride and N,N-dimethylformamide (abbreviated as DMF), or phosphorus oxychloride and N-methyl-N-phenylformamide, or phosphorus oxychloride and N,N-diphenylformamide are added to a solvent such as N,N-dimethylformamide or 1,2-dichloroethane to prepare a Vilsmeier reagent. 1.0 equivalent of an enamine intermediate represented by the general formula (5) is added to from 1.0 to 1.3 equivalents of the thus-prepared Vilsmeier reagent, and stirred for 2 to 8 hours under heat at 60 to 110° C. Next, this is hydrolyzed with an aqueous alkaline solution such as 1 to 8 N aqueous sodium hydroxide or potassium hydroxide solution. This gives an enamine-aldehyde intermediate, a type of enamine-carbonyl intermediate represented by the general formula (6) where $R^5$ is a hydrogen atom, at high yield.

The Friedel-Crafts reaction is effected, for example, as follows. From 1.0 to 1.3 equivalents of a reagent prepared from aluminum chloride and an acid chloride, and 1.0 equivalent of an enamine intermediate represented by the general formula (5) are added to a solvent such as 1,2-dichloroethane, and stirred for 2 to 8 hours at −40 to 80° C. As the case may be, the reaction system is heated. Next, this is hydrolyzed with an aqueous alkaline solution such as 1 to 8 N aqueous sodium hydroxide or potassium hydroxide solution. This gives an enamine-keto intermediate, a type of enamine-carbonyl intermediate represented by the general formula (6) where $R^5$ is a group except hydrogen atom, at high yield.

Finally, the enamine-carbonyl intermediate represented by the general formula (6) is processed with a Wittig reagent of the following general formula (7-1) or (7-2) through Wittig-Horner reaction under basic condition to obtain an enamine compound represented by the general formula (1). In this step, when a Wittig reagent represented by the following general formula (7-1) is used, it gives an enamine compound represented by the general formula (1) where n is 0; and when a Wittig reagent represented by the following general formula (7-2) is used, it gives an enamine compound represented by general formula (1) where n is 1, 2 or 3.

(7-1)

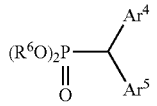

(wherein $R^6$ represents an alkyl group which may have a substituent or an aryl group which may have a substituent; and $Ar^4$ and $Ar^5$ are the same as those defined in the general formula (1).)

(7-2)

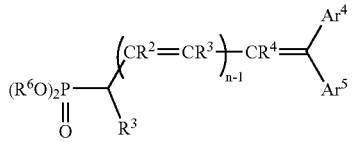

(wherein $R^6$ represents an alkyl group which may have a substituent or an aryl group which may have a substituent; n indicates an integer of from 1 to 3; and $Ar^4$, $Ar^5$, $R^2$, $R^3$ and $R^4$ are the same as those defined in the general formula (1).)

The Wittig-Horner reaction is effected, for example, as follows. To a solvent such as toluene, xylene, diethyl ether, tetrahydrofuran (abbreviated as THF), ethylene glycol dimethyl ether, N,N-dimethylformamide or dimethylsulfoxide, added is 1.0 equivalent of an enamine-carbonyl intermediate represented by the general formula (6), from 1.0 to 1.20 equivalents of a Wittig reagent represented by the general formula (7-1) or (7-2), and from 1.0 to 1.5 equivalents of a metal alkoxide base such as potassium t-butoxide, sodium ethoxide or sodium methoxide, and the solvent is stirred for 2 to 8 hours at room temperature or under heat at 30 to 60° C. This gives an enamine compound represented by the general formula (1) at high yield.

As the enamine compound represented by the general formula (1), for example, one or more of materials selected from the group consisting of the exemplified compounds shown in Table 1 to Table 32 is used alone or as a mixture.

The enamine compound represented by the general formula (1) may also be used with other charge transporting substance as a mixture. Other charge transporting substance to be used in admixture with the enamine compound represented by the general formula (1) can include, for example, carbazole derivatives, oxazole derivatives, oxadiazole derivatives, thiazole derivatives, thiadiazole derivatives, triazole derivatives, imidazole derivatives, imidazolone compound, imidazolidine derivatives, bisimidazolidine derivatives, styryl derivatives, hydrazone compound, polycyclic aromatic compound, indole derivatives, pyrazoline derivatives, oxazolone derivatives, benzimidazole derivatives, quinazoline derivatives, benzofuran derivatives, acrydine derivatives, phenadine derivatives, aminostylbene derivatives, triarylamine derivatives, triarylmethane derivatives, phenylene diamine derivatives, stylbene derivatives and benzidine derivatives. In addition, a polymer having a group generated from those compounds in a main chain or a side chain, for example, poly(N-vinylcarbazole), poly(1-vinylpyrene) and poly(9-vinylanthracene) and the like are included.

In a case of using the enamine compound represented by the general formula (1) with other charge transporting substances as a mixture, when the ratio of the charge transporting substance other than the enamine compound represented by the general formula (1) is excessive, the charge transporting ability of the charge transporting layer 6 may become insufficient so that the sensitivity and the light responsiveness of the photorecepter 1 can not be obtained sufficiently. Thus, it is preferred to use a mixture containing the enamine compound represented by the general formula (1) as a main component for the charge transporting substance.

The binder resin for constituting the charge transporting layer 6 may include any material which has compatibility with the charge transporting material, for example, polycarbonate and polycarbonate copolymer, polyarylate, polyvinyl butyral, polyamide, polyester, epoxy resin, polyurethane, polyketone, polyvinyl ketone, polystyrene, polyacrylamide, phenol resin, phenoxy resin, polysulfone resin, and a copolymer resin containing two or more repetitive units constituting them. The resins may be used alone or two or more of them may be used as a mixture. Of the resins described above, a resin such as polystyrene, polycarbonate and polycarbonate copolymer, polyarylate, or polyester is preferably used because of its excellent electric insulation property having a volume resistance of $10^{13}$ Ω·cm or more, as well as excellent film-forming property and potential characteristics.

Further, by incorporating one or more electron-accepting substance or dye in the charge transporting layer 6, the sensitivity may be enhanced so that an increase in a residual potential and fatigue during the repetitive use are suppressed. The electron-accepting substance includes acid anhydrides such as succinic anhydride, maleic anhydride, phthalic anhydride, and 4-chlornaphthalic anhydride, cyano compounds such as tetracyanoethylene and terephthalic malondinitryl, an aldehyde group such as 4-nitrobenzaldehyde, an anthraquinone group such as 1-nitroanthraquinone, and polycyclic or heterocyclic nitro compounds such as 2,4,7-trinitrofluorenone and 2,4,5,7-tetranitrofluorenone. These electron-accepting substances can be used as chemical sensitizer.

The dye includes organic photoconductive compounds such as xanthene-series pigment, thiazine dye, triphenylmethane-series dye, quinoline-series dye, copper phthalocyanine. These dyes can be used as optical sensitizer.

The charge transporting layer 6 can be formed by the above-described coating method used for the formation of the charge generating layer 5 and other methods. An embrocation for charge transporting layer for forming the charge transporting layer 6 is prepared by dissolving a binder resin in an appropriate solvent to form a binder resin solution which the charge transporting substance containing the enamine compound represented by the general formula (1) is dissolved in and when needed, additives such as the above-described electron-accepting substance and dyes are added to.

As the above-described solvent for dissolving the binder resin, applicable are alcohols such as methanol and ethanol; ketones such as acetone, methyl ethyl ketone, and cyclohexanone; ethers such as ethyl ether, tetrahydrofuran, dioxane, and dioxolan; aliphatic halogenated hydrocarbons such as chloroform, dichloromethane, and dichloroethane; and aromatic hydrocarbons such as benzene, chlorobenzene, and toluene. These solvents may be used alone or two or more of them may be used as a mixture.

The embrocation for charge transporting layer is applied onto the charge generating layer 5 in the same manner of applying the embrocation for forming the charge generating layer 5 onto the undercoat layer 4 as described above.

It is preferable that a ratio of the charge transporting substance in the charge transporting layer 6 fall within a range of from 30% by weight to 80% by weight. A film thickness of the charge transporting layer 6 is preferably from 10 to 50 μm, and more preferably from 15 to 40 μm.

By laminating the charge generating layer 5 and the charge transporting layer 6 thus formed, a photosensitive layer 7 is constituted. Thus allotting a charge generating function and a charge transporting function on separate layers makes it possible to select an optimal material for each of the charge generating function and the charge transporting function as a material constituting each layer, so that the photorecepter 1 having particularly good sensitivity characteristics, charging characteristics, and image reproducibility can be obtained.

Note that in the embodiment, the photosensitive layer 7 is constituted by lamination of the charge generating layer 5 and the charge transporting layer 6 in this order on the under coat layer 4, however the constitution is not limited to this and the photosensitive layer 7 may be constituted by lamination of the charge transporting layer 6 and the charge generating layer 5 in this order on the undercoat layer 4.

Into each of the layers 5 and 6 of the photosensitive layer 7, a heretofore known plasticizer may be further incorporated in order to enhance formability, flexibility, and mechanical strength. The plasticizer includes dibasic acid ester, fatty acid ester, phosphoric acid ester, phthalic acid ester, chlorinated paraffin, and epoxy plasticizer. Moreover, into each of the layers 5 and 6 of the photosensitive layer 7 may be incorporated leveling agents for prevention of orange peel such as polysiloxane, antioxidants for enhancement of durability such as a phenol-series compound, a hydroquinone-series compound, a tocopherol-series compound and an amine-series compound, and an ultraviolet absorber.

A surface film property of the photorecepter 1 constituted as described above, that is, a surface film property of the photosensitive layer 7 which is to be formed into a film-like shape is set so that in a case where a maximum indentation load of 30 mN is put on a surface for 5 seconds under circumstances of temperature of 25° C. and relative humidity of 50%, $C_{IT}$ is 2.70% or more and 5.00% or less, more preferably 3.00% or more and 5.00% or less and Hplast of the surface is 220 N/mM$^2$ or more and 275 N/mm$^2$ or less.

Figure 3:
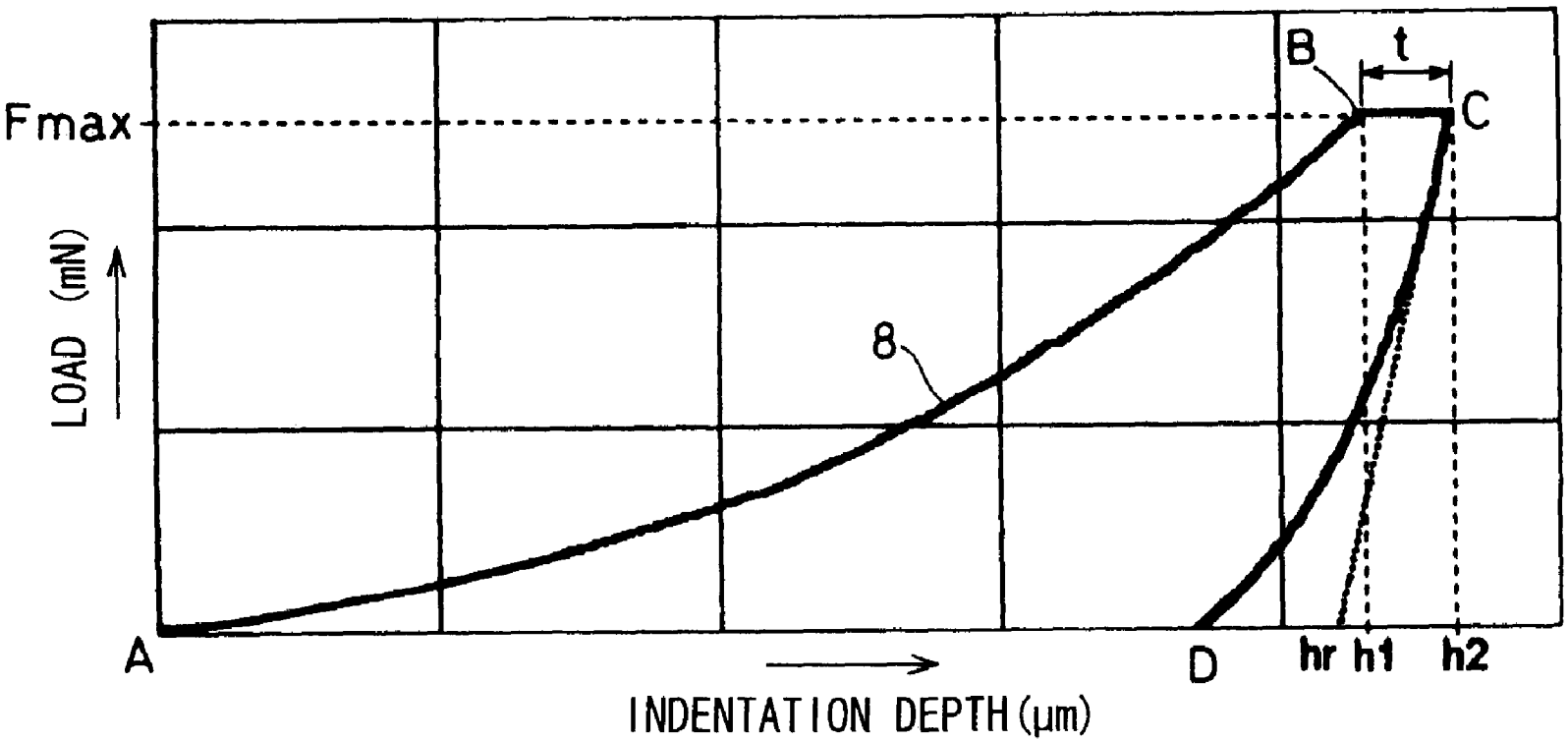
FIG. 3 is a view for explaining a method of obtaining $C_{IT}$ and Hplast of the photoreceptor.

Descriptions will be given to $C_{IT}$ hereinbelow. Generally, even when the load is relatively small, a solid material undergoes a sequential deformation phenomenon, a so-called creep, gradually over the course of load-holding time, and in particular, the creep appears prominently in the organic polymer material. The creep includes a delayed elastic deformation component and a plastic deformation component when classified roughly, and is used as an indicator of flexibility of material. FIG. 3 is a view for explaining a method of obtaining $C_{IT}$ and Hplast of a photoreceptor. $C_{IT}$ is a changing amount of indentation amount of an indenter in a state where a predetermined load is given to the surface of the photoreceptor via the indenter for a certain length of time, that is, a parameter for evaluating an alleviated degree of the photoreceptor surface film against the indentation load.

A hysteresis line 8 shown in FIG. 3 shows a record of deformation (indentation depth change) through an indentation process (A→B) from beginning of putting the indentation load on the surface of the photorecepter 1 until attainment of the predetermined indentation maximum load Fmax, a load holding process (B→C) for holding the state under the indentation maximum load Fmax for a certain length of time t, and a load removing process (C→D) from beginning of removing the load until attainment of load zero (0) indicating completion of removing the load. $C_{IT}$ is given by the changing amount of indentation amount in the load holding process (B→C).

In the embodiment, $C_{IT}$ was measured on a condition that a loaded state under the indentation maximum load Fmax=30 mN was held for a certain length of time t=5 seconds while a diamond indenter (Vickers indenter) was used as an indenter under circumstances of temperature of 25° C. and relative humidity of 50%. $C_{IT}$ is specifically given by a formula (I).

$$C_{IT}=100\times(h2-h1)/h1 \quad \text{(I)}$$

wherein h1 represents an indentation depth at a time point (B) that the maximum load 30 mN is attained, and h2 represents an indentation depth at a time point (C) that the state under the maximum load 30 mN is held for a length of time t.

Such $C_{IT}$ can be obtained, for example, by a fisherscope H100 (manufactured by Fisher Instrumentation Ltd.).

A reason why $C_{IT}$ of the surface of the photorecepter 1 is limited will be described. Although the surface of the photorecepter 1 is deformed by energy given at a time when a cleaning member or the like is pressed, $C_{IT}$ is set to 2.70% or more to give flexibility to the photoreceptor 1, thereby alleviating (dispersing) internal energy caused by the deformation so that progress of abrasion is hindered. In other words, the photoreceptor has improved life duration of abrasion resistance. In a case where $C_{IT}$ is less than 2.70%, the flexibility of the photoreceptor surface is deteriorated, and abrasion resistance against rubbing of the photoreceptor with the cleaning member or the like becomes low, and thus life duration of the photoreceptor becomes short. Further, in a case where $C_{IT}$ exceeds 5.00%, the photoreceptor surface may become too flexible, in a consequence whereof, for example, the indentation changing amount at the time of rubbing with the cleaning member is large so that sufficient cleaning effect may not be obtained. Accordingly, $C_{IT}$ was set to 2.70% or more and 5.00% or less.

Next, Hplast will be described. Hplast includes both of the plastic component and the elastic component, and serves as an indicator mainly for evaluating plasticity of materials. Hplast in the embodiment is obtained by an intercept hr and the indentation maximum load :Fmax, the intercept hr which indicates an intersection of a tangent line at a point C to a load removing curve obtained in the load removing process (C→D) of the hysteresis line 8 at the time of obtaining $C_{IT}$ as described above with an axis of indentation depth. Hplast is specifically obtained by a formula (II).

$$H\text{plast}=F\max/A(hr) \quad \text{(II)}$$

wherein A(hr) indicates an indentation surface area at the above-described intercept hr, which is called as a rebound indentation depth, and is given by A(hr)=26.43×hr$^2$. This Hplast can be obtained, as in the above-described case of $C_{IT}$, by the fisherscope H100, for example.

A reason why a range of Hplast of the surface of the photorecepter 1 is limited will be described. In a case where Hplast is less than 220 N/mm$^2$, the mechanical strength of the surface is not sufficient as a photoreceptor to be used for electrophotographic system. Further, in a case where Hplast exceeds 275 N/mm$^2$, fragility of the photoreceptor surface is exposed so that an increased number of flaws are generated on the photoreceptor surface and as a result, durability is deteriorated. Accordingly, Hplast is set to 220 N/mm2 or more and 275 N/mm$^2$ or less.

In the photorecepter 1 having $C_{IT}$ and Hplast set in the above-described specific range, flexibility of a film which forms a surface of the photoreceptor 1, that is, the photosensitive layer 7, is maintained while the film does not have too soft plasticity nor expose fragility. Accordingly, even on use for a long period of time that charging, exposure, development, transfer, cleaning, and charge elimination for the image formation are conducted repetitively, a film loss is reduced and moreover, a reduced number of flaws are generated on the film so that smoothness of the photoreceptor surface is maintained, thereby preventing flaws and density unevenness from being generated on a to-be-formed image.

Adjustment of $C_{IT}$ and Hplast of the surface of the photorecepter 1 is realized by controlling kind and compounding ratio of the charge transporting substance and binder resin which constitute the photosensitive layer 7, a laminated structure of the photosensitive layer 7, for example, a combination of a thickness of the charge generating layer 5 and a thickness of the charge transporting layer 6, and moreover, a drying condition after coating of the charge generating layer 5 and the charge transporting layer 6, and other matters. By forming the photosensitive layer 7 into a lamination type that plural layers are laminated as described above, the degree of freedom for the materials constituting each of the layers and the combination thereof is increased, so that it becomes easier to set $C_{IT}$ and Hplast of the photorecepter 1 within the desired range.

Note that in a case where a surface protective layer formed of resin or the like is provided on the photosensitive layer 7 according to need, the adjustment of $C_{IT}$ and Hplast of the surface of the photorecepter 1 can be realized by controlling a kind or layer thickness of the resin serving as a main component of the surface protective layer, and the drying condition after the coating of an embrocation for surface protective layer.

Brief descriptions will be given to an electrostatic latent image forming operation in the photorecepter 1 hereinbelow. The photosensitive layer 7 formed on the photorecepter 1 is uniformly charged, for example, negatively by a charger or other devices, and in the charged state, the charge generating layer 5 is irradiated with light having an absorption wavelength and then, charges of electron and hole are generated inside the charge generating layer 5. The hole is made to move to the surface of the photorecepter 1 by the charge transporting substance contained in the charge transporting layer 6, and neutralizes negative charges of the surface while the electron inside the charge generating layer 5 moves toward the conductive substrate 3 having positive charges induced, and neutralizes positive charges. As described above, in the photosensitive layer 7, a difference is made between a charged amount of an exposed portion and a charged amount of a non-exposed portion so that an electrostatic latent image is formed.

Next, with reference to FIG. 2, descriptions will be given to a constitution of the image forming apparatus 2 provided with the above-described photoreceptor 1, and an image forming operation.

The image forming apparatus 2 comprises the above-described photorecepter 1 rotatably supported by an apparatus main body (not shown), and driving means (not shown) for rotating the photorecepter 1 in an arrow sign 41 direction about a rotational shaft line 44. The driving means comprises a motor, for example, as a power source, and rotates the photorecepter 1 at a predetermined peripheral velocity by imparting power from the motor to a support which constitutes a core body of the photoreceptor 1, via a gear (not shown).

Around the photoreceptor 1, a charger 32, exposure means 30, a developing device 33, a transfer device 34, and a cleaner 36 are provided in this order from an upstream side to a downstream side in a rotation direction of the photorecepter 1 shown by an arrow sign 41. The cleaner 36 is provided together with a charge-eliminating lamp (not shown).

The charger 32 is charging means for uniformly charging a surface 43 of the photorecepter 1 to a predetermined negative or positive potential. The charger 32 is charging means of contact type, such as a charging roller.

The exposure means 30 comprises a semiconductor laser, for example, as a light source, and the surface 43 of the charged photorecepter 1 is exposed to light 31, for example, a laser beam, outputted from the light source according to image information so that an electrostatic latent image is formed on the surface 43 of the photoreceptor 1.

The developing device 33 is developing means for forming a toner image which is a visible image, by developing the electrostatic latent image formed on the surface 43 of the photorecepter 1 by use of a developer, and comprises a developing roller 33*a* provided so as to face the photoreceptor 1, for supplying a toner to the surface 43 of the photoreceptor 1, and a casing 33*b* which rotatably supports the developing roller 33*a* about a rotational shaft line in parallel with the rotational shaft line 44 of the photoreceptor 1, for containing the developer including the toner in an internal space of the casing 33*b*.

The transfer device 34 is transfer means for transferring the toner image formed on the surface 43 of the photorecepter 1 from the surface 43 of the photorecepter 1 onto a recording paper 51 which is a transfer member. The transfer device 34 comprises charging means such as a corona discharger, and serves as transfer means of non-contact type, for transferring the toner image onto the recording paper 51 by giving to the recording paper 51 charges having an opposite polarity to that of the toner.

The cleaner 36 is cleaning means for cleaning the surface of the photorecepter 1 on which the toner image has been transferred, and comprises a cleaning blade 36*a* pressed on the photoreceptor surface 43, for peeling off from the surface 43 foreign objects such as toner and paper powder remained on the surface 43 of the photorecepter 1 after the transfer operation through the transfer device 34, and a collecting casing 36*b* for recovering the foreign objects such as the toner peeled off by the cleaning blade 36*a*. Not all the toner for forming the toner image on the surface 43 of the photorecepter 1 may be transferred onto the recording paper 51 so that a small amount of the toner may remain on the surface 43 of the photoreceptor 1. The toner remained on the photoreceptor surface 43 is called as a residual toner, and since existence of the residual toner leads to deterioration in quality of a to-be-formed image, the residual toner is cleaned away from the surface of the photorecepter 1 together with other foreign objects such as paper powder by the above-mentioned cleaning blade 36*a* pressed on the photoreceptor surface 43.

Further, in a direction that the recording paper 51 is conveyed after passed between the photorecepter 1 and the transfer device 34, a fixing device 35 serving as fixing means for fixing a transferred image is provided. The fixing device 35 comprises a heating roller 35*a* having heating means (not shown), and a pressure roller 35*b* provided so as to face the heating roller 35*a*, for forming a contact portion by being pressed on the heating roller 35*a*.

The image forming operation through the image forming apparatus 2 will be described. In response to a command from a control unit (not shown), the photorecepter 1 is rotated in an arrow sign 41 direction by the driving means so that the surface 43 of the photorecepter 1 is uniformly charged to a predetermined positive or negative potential by the charger 32 which is provided upstream of an imaging point of the light 31 from the exposure means 30 in the rotation direction of the photoreceptor 1.

Subsequently, in response to a command from the control unit, the exposure means 30 irradiates the surface 43 of the charged photorecepter 1 with the light 31. On the basis of the image information, the photorecepter 1 is repeatedly scanned in a longitudinal direction thereof which is a main scanning direction, with the light 31 from the light source. By rotating the photorecepter 1 and scanning the photorecepter 1 with the light 31 from the light source on the basis of the image information, exposure corresponding to the image information can be performed for the surface 43 of the photoreceptor 1. Through this exposure, surface charges on a portion irradiated with the light 31 are eliminated, and a difference is made between the portion irradiated with the light 31 and a portion not irradiated with the light 31 so that the electrostatic latent image is formed on the surface 43 of the photoreceptor 1. Further, in synchronization with the exposure of the photoreceptor 1, the recording paper 51 is supplied in an arrow sign 42 direction to a transfer position between the transfer device 34 and the photorecepter 1 by conveying means.

Subsequently, from the developing roller 33*a* of the developing device 33 provided downstream of the imaging point of the light 31 from the light source in the rotation direction of the photoreceptor 1, the toner is supplied to the surface 43 of the photorecepter 1 on which the electrostatic latent image has been formed. As a result, the electrostatic latent image is developed so that the toner image which is a visible image is formed on the surface 43 of the photoreceptor 1. When the recording paper 51 is supplied between the photoreceptor 1 and the transfer device 34, charges having an opposite polarity to that of the toner are given to the recording paper 51 by the transfer device 34 so that the toner image formed on the surface 43 of the photorecepter 1 is transferred onto the recording paper 51.

The recording paper 51 onto which the toner image has been transferred is conveyed to the fixing device 35 by the conveying means, and heated and pressurized when passing through the contact portion between the heating roller 35*a* and pressure roller 35*b* of the fixing device 35. By so doing, the toner image on the recording paper 51 is fixed onto the recording paper 51 to be a solid image. The recording paper 51 on which the image has been thus formed is discharged to outside of the image forming apparatus 2 by the conveying means.

In the meantime, after the toner image has been transferred to the recording paper 51, the surface 43 of the photorecepter 1 which further rotates in the arrow sign 41 direction is cleaned by abrasion with the cleaning blade provided in the cleaner 36. The surface 43 of the photorecepter 1 from which the foreign objects such as the toner are thus removed, is charge-eliminated by light from a charge-eliminating lamp and as a result, the electrostatic latent image on the surface 43 of the photorecepter 1 disappears. After that, the photoreceptor is further rotated, and a series of operations starting from charging of the photorecepter 1 are repeated again. As described above, the images are sequentially formed.

Since the photorecepter 1 provided in the image forming apparatus 2 contains the enamine compound represented by the general formula (1), preferably represented by the general formula (2), in the photosensitive layer 7 as described above, the photorecepter 1 has excellent electric characteristics such as sensitivity characteristic, light responsiveness, and chargeability, and these electric characteristics are not deteriorated even by change of the circumstances nor repetitive use. Furthermore, since the photorecepter 1 is excellent in flexibility of a film which forms the photosensitive layer 7 and moreover, the film does not have too soft plasticity nor expose fragility, a film loss is reduced and moreover, a reduced number of flaws are generated on the film so that smoothness of the surface of the photorecepter 1 is maintained. Accordingly, a highly reliable image forming apparatus 2 is realized, which can provide images of good quality without flaws and density unevenness for a long period of time under various circumstances. Moreover, as described above, the electric characteristics of the photoreceptor 1 are not deteriorated even when exposed to light, so that deterioration of image quality caused by exposure of the photorecepter 1 to the light at the time of maintenance or the like is suppressed.

Note that in the image forming apparatus 2 of the embodiment, the charger 32 is charging means of contact type, but not limited to this type and may be charging means of non-contact type such as a corona discharger. Moreover, the transfer device 34 is transfer means of non-contact type which carries out a transfer without using a press force, but not limited to this and may be transfer means of contact type which carries out the transfer by use of the press force. As the transfer means of contact type, it is possible to use transfer means, for example, which comprises a transfer roller, and presses the transfer roller onto the photorecepter 1 from an opposite face of an abutment face of the recording paper 51 in abutment with the surface 43 of the photoreceptor 1, and in a state of press-contacting the photorecepter 1 and the recording paper 51, applies a voltage to the transfer roller so that the toner image is transferred onto the recording paper 51.

Figure 4:
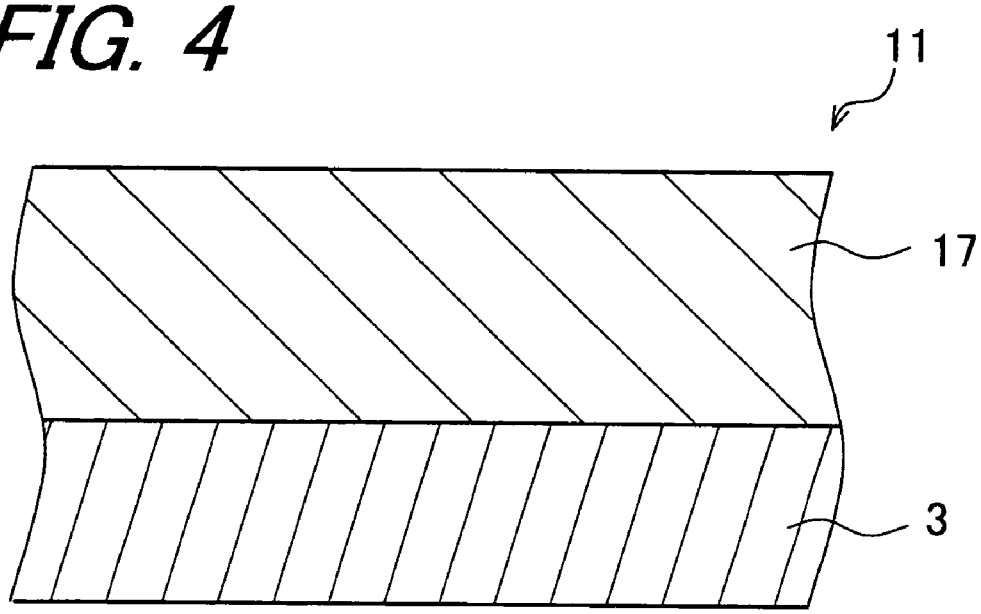
FIG. 4 is a partial cross sectional view schematically showing a constitution of a photoreceptor 11 according to a second embodiment of the invention.

FIG. 4 is a partial cross sectional view schematically showing a constitution of a photoreceptor 11 according to a second embodiment of the invention. The photoreceptor 11 in the embodiment is similar to the photorecepter 1 in the first embodiment of the invention, so that corresponding parts are denoted by the same reference numerals, and descriptions thereof will be omitted. It is notable in the photoreceptor 11 that a photosensitive layer 17 composed of a single layer is formed on the conductive substrate 3.

The photosensitive layer 17 is formed by use of a charge generating substance, a charge transporting substance containing the enamine compound represented by the general formula (1), and a binder resin which are similar to those used for the photorecepter 1 in the first embodiment of the invention. By use of an embrocation for photosensitive layer which is prepared by dispersing the charge generating substance and the charge transporting substance in a solution having the binder resin dissolved therein or by dispersing the charge generating substance in a form of pigment particles in the binder resin containing the charge transporting substance, the photosensitive layer 17 composed of a single layer is formed on the conductive substrate in the same manner of forming the charge generating layer 5 in the photorecepter 1 in the first embodiment of the invention. Since the photosensitive layer 17 to be coated is only one layer, the photoreceptor 11 of single layer type in the embodiment is excellent in manufacturing cost and yield ratio, compared to a photoreceptor of laminated layer type which is constituted by lamination of the charge generating layer and the charge transporting layer.

Further, a surface film property of the photoreceptor 11 is set so that $C_{IT}$ and Hplast fall within the above-described specific range as in the case of the surface film property of the photorecepter 1 in the first embodiment of the invention. Accordingly, as in the case of the photorecepter 1 in the first embodiment of the invention, realized is a highly reliable photoreceptor 11 having high sensitivity and excellent light responsiveness and chargeability which are electric characteristics, the electric characteristics being not deteriorated even by any of exposure to light and change of circumstance nor by repetitive use, with an excellent life duration of abrasion resistance so that no flaw and density unevenness are generated on a to-be-formed image for a long period of time.

Brief descriptions will be given to an electrostatic latent image forming operation in the photoreceptor 11 hereinbelow. The photosensitive layer 17 formed on the photoreceptor 11 is uniformly charged, for example, positively by a charger or other devices, and in the charged state, the charge generating substance is irradiated with light having an absorption wavelength and then, charges of electron and hole are generated in a vicinity of the surface of the photosensitive layer 17. The electron neutralizes positive charges on the surface while the hole moves toward the conductive substrate 3 having negative charges induced by the charge transporting substance, and neutralizes negative charges. As described above, in the photosensitive layer 17, a difference is made between a charged amount of an exposed portion and a charged amount of a non-exposed portion so that an electrostatic latent image is formed.

EXAMPLES

The invention will be hereinbelow described in further detail by use of examples. Note that the invention is not restricted to these examples.

Production Example

Production Example 1

Production of Exemplified Compound No. 1

(Production Example 1-1) Production of Enamine Intermediate 23.3 g (1.0 equivalent) of N-(p-tolyl)-α-naphthylamine represented by the following structural formula (8), 20.6 g (1.05 equivalents) of diphenylacetaldehyde represented by the following structural formula (9), and 0.23 g (0.01 equivalents) of DL-10-camphorsulfonic acid were added to 100 ml of toluene and heated, and these were reacted for 6 hours while the by-product water was removed out of the system through azeotropic distillation with toluene. After completion of the reaction, the reaction solution was concentrated to about 1/10, and gradually dribbled into 100 ml of hexane that was vigorously stirred so that a crystal was produced. The produced crystal was taken out through filtration, and washed with cold ethanol, thereby obtaining 36.2 g of a pale yellow powdery compoud.

(8)

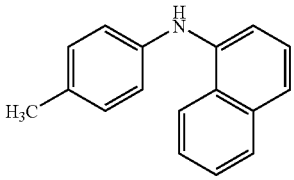

(9)

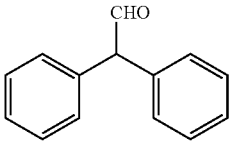

The obtained compound was analyzed through liquid chromatography-mass spectrometry (abbreviated as LC-MS), which gave a peak at 412.5 corresponding to the molecular ion $[M+H]^+$ of an enamine intermediate (calculated molecular weight: 411.20) represented by the following structural formula (10) with a proton added thereto. This confirmed that the obtained compound was the enamine intermediate represented by formula (10) (yield: 88%). In addition, the analysis of LC-MS further confirmed that the purity of the obtained enamine intermediate was 99.5%.

(10)

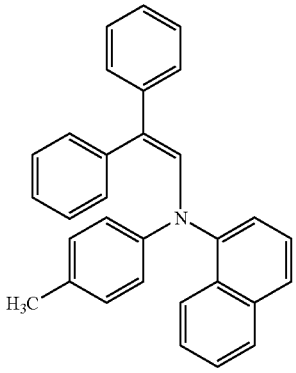

As described above, the dehydrating condensation of N-(p-tolyl)-α-naphthylamine which is a secondary amine represented by the structural formula (8), and diphenylacetaldehyde which is an aldehyde compound represented by the structural formula (9) gave the enamine intermediate represented by the structural formula (10).

(Production Example 1-2) Production of Enamine-Aldehyde Intermediate 9.2 g (1.2 equivalents) of phosphorus oxychloride was gradually added to 100 ml of anhydrous N,N-dimethylformamide (DMF) and stirred for about 30 minutes to prepare a Vilsmeier reagent. 20.6 g (1.0 equivalent) of the enamine intermediate obtained in Production Example 1-1, which is represented by the structural formula (10), was gradually added to the solution while cooled with ice. Next, this was gradually heated up to 80° C., and stirred for 3 hours while heated so as to keep 80° C. After completion of the reaction, the reaction solution was left cooled, and then this was gradually added to 800 ml of cold 4 N aqueous sodium hydroxide solution to form a precipitate. The formed precipitate was collected through filtration, and well washed with water, and then recrystallized from a mixed solvent of ethanol and ethyl acetate so that 20.4 g of an yellow powdery compound was obtained.

The obtained compound was analyzed through LC-MS, which gave a peak at 440.5 corresponding to the molecular ion $[M+H]^+$ of an enamine-aldehyde intermediate (calculated molecular weight: 439.19) represented by the following structural formula (11) with a proton added thereto. This confirmed that the obtained compound was the enamine-aldehyde intermediate represented by the following structural formula (11) (yield: 93%). In addition, the analysis of LC-MS further confirmed that the purity of the obtained enamine-aldehyde intermediate was 99.7%.

(11)

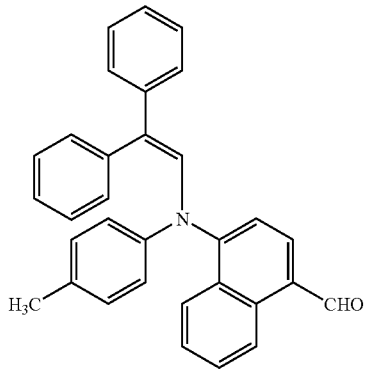

As described above, the formylation of the enamine intermediate represented by the structural formula (10) through Vilsmeier reaction gave the enamine-aldehyde intermediate represented by the structural formula (11).

(Production Example 1-3) Production of Exemplified Compound No. 1

8.8 g (1.0 equivalent) of the enamine-aldehyde intermediate obtained in Production Example 1-2, which is represented by the structural formula (11), and 6.1 g of diethyl cinnamylphosphonate of the following structural formula (12) were dissolved in 80 ml of anhydrous DMF, and 2.8 g (1.25 equivalents) of potassium t-butoxide was gradually added to the solution at room temperature, then heated up to 50° C., and stirred for 5 hours while heated so as to keep 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. The taken-out organic layer was dried with magnesium sulfate. Solid matter was removed from the thus-dried organic layer, which was then concentrated and subjected to silica gel column chromatography so that 10.1 g of an yellow crystal was obtained.

(12)

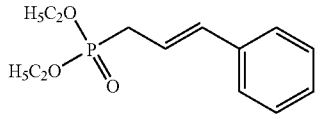

The obtained crystal was analyzed through LC-MS, which gave a peak at 540.5 corresponding to the molecular ion $[M+H]^+$ of the intended enamine compound which is an Exemplified Compound No. 1 shown in Table 1 (calculated molecular weight: 539.26) with a proton added thereto.

Figure 5:
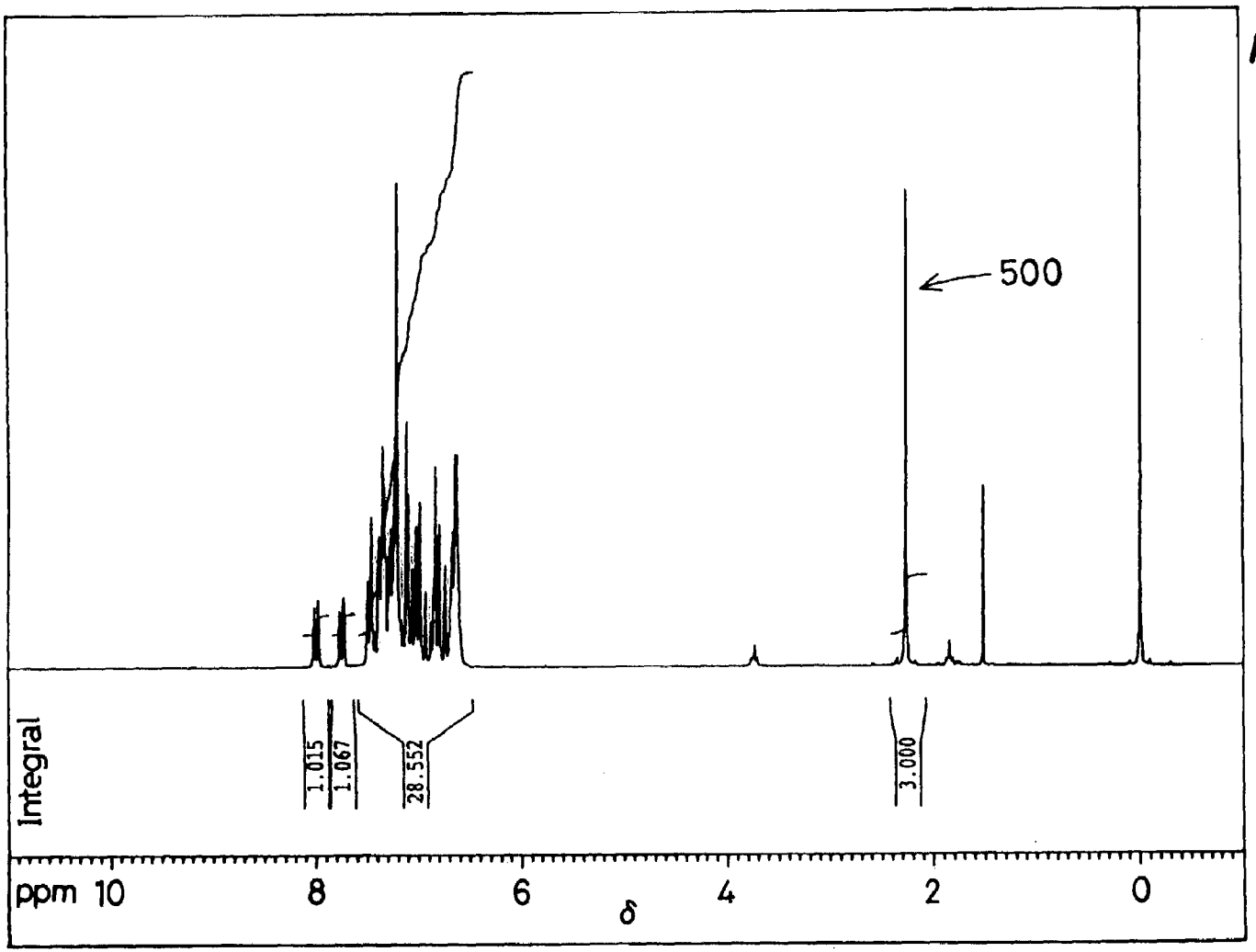
FIG. 5 is a $^{1}$H-NMR spectrum of a product in Production Examples 1-3.
Figure 6:
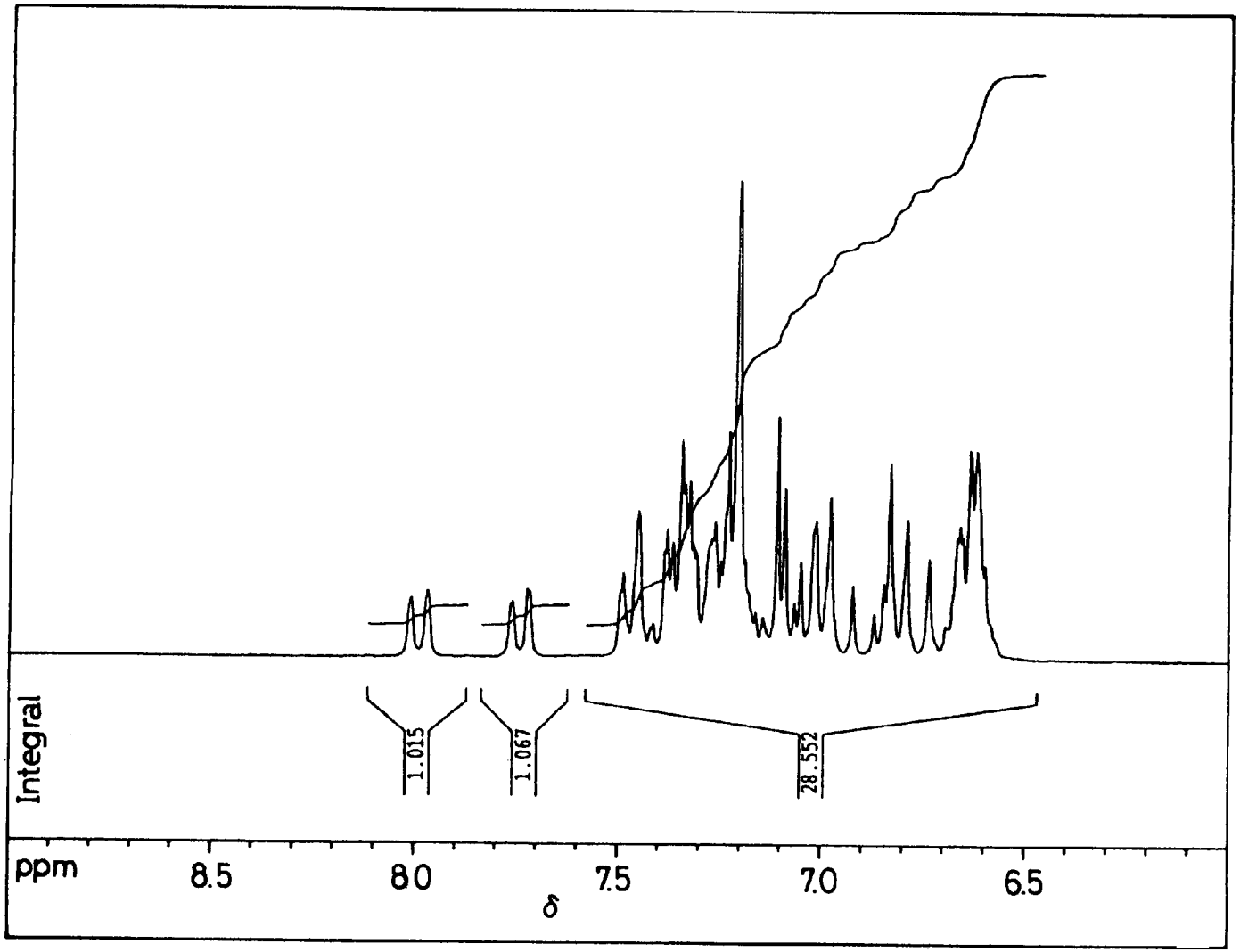
FIG. 6 is an enlarged view of the spectrum of FIG. 5 in the range of from 6 ppm to 9 ppm.
Figure 7:
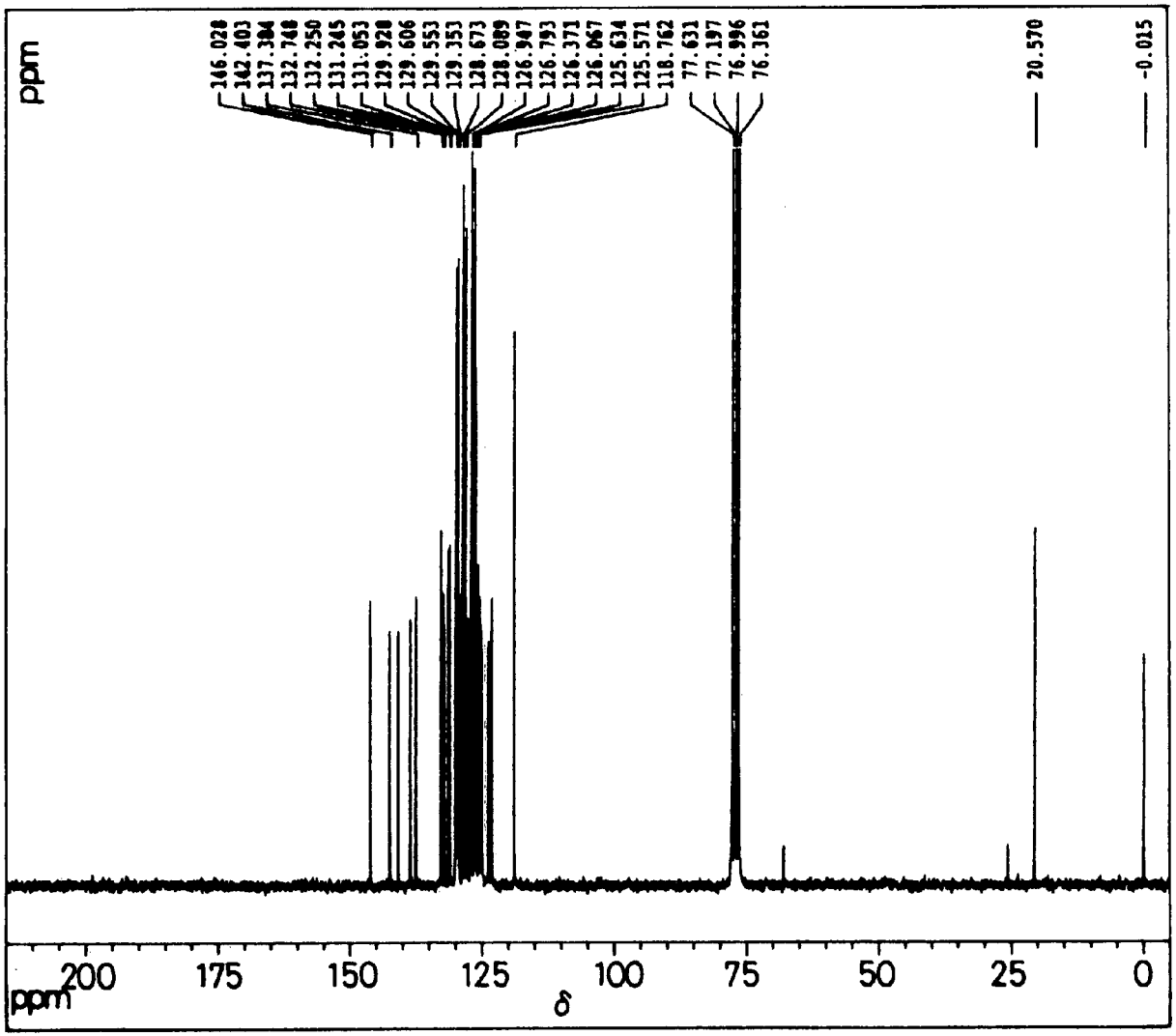
FIG. 7 is a $^{13}$C-NMR spectrum in ordinary measurement of the product in Production Examples 1-3.
Figure 8:
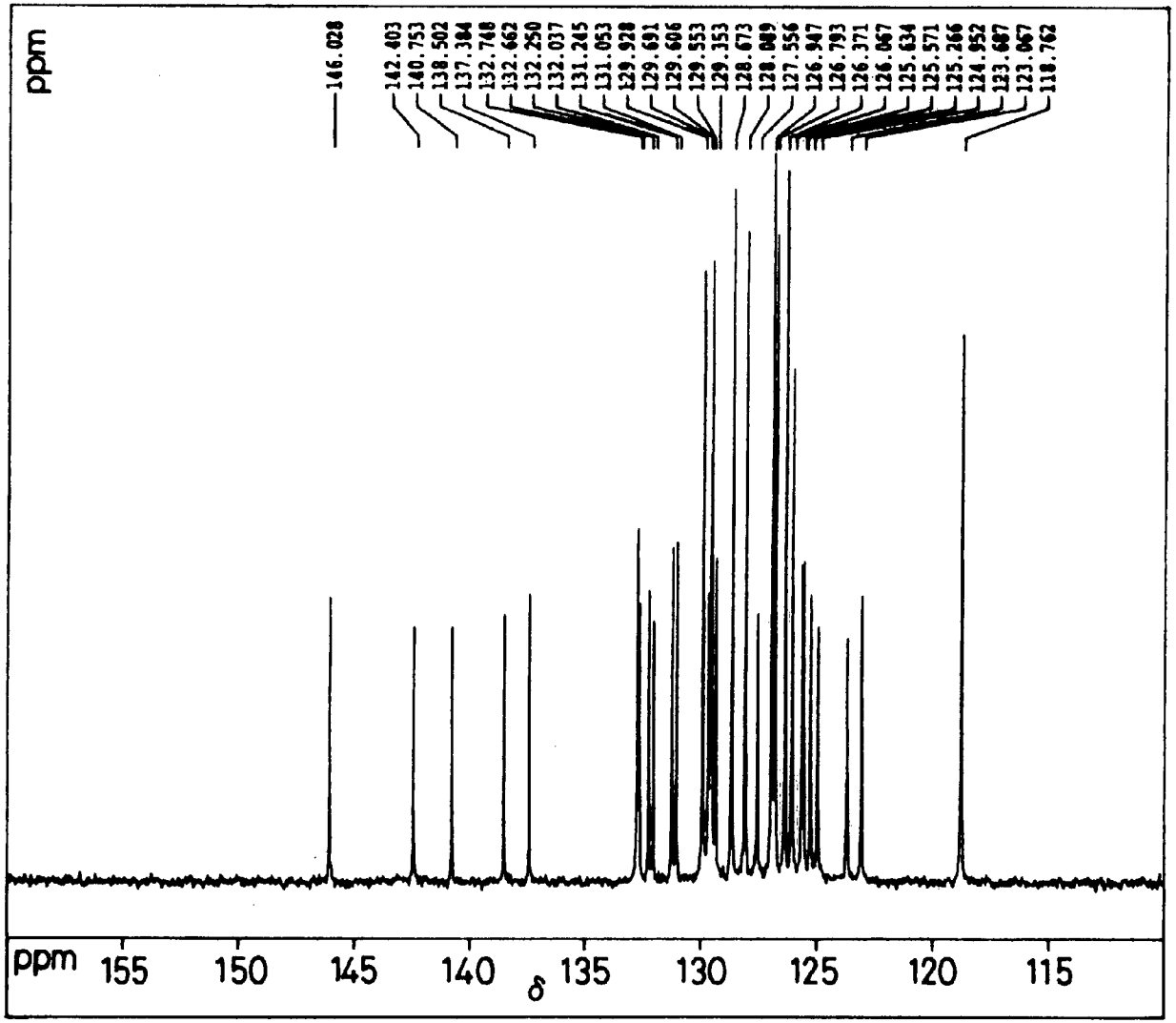
FIG. 8 is an enlarged view of the spectrum of FIG. 7 in the range of from 110 ppm to 160 ppm.
Figure 9:
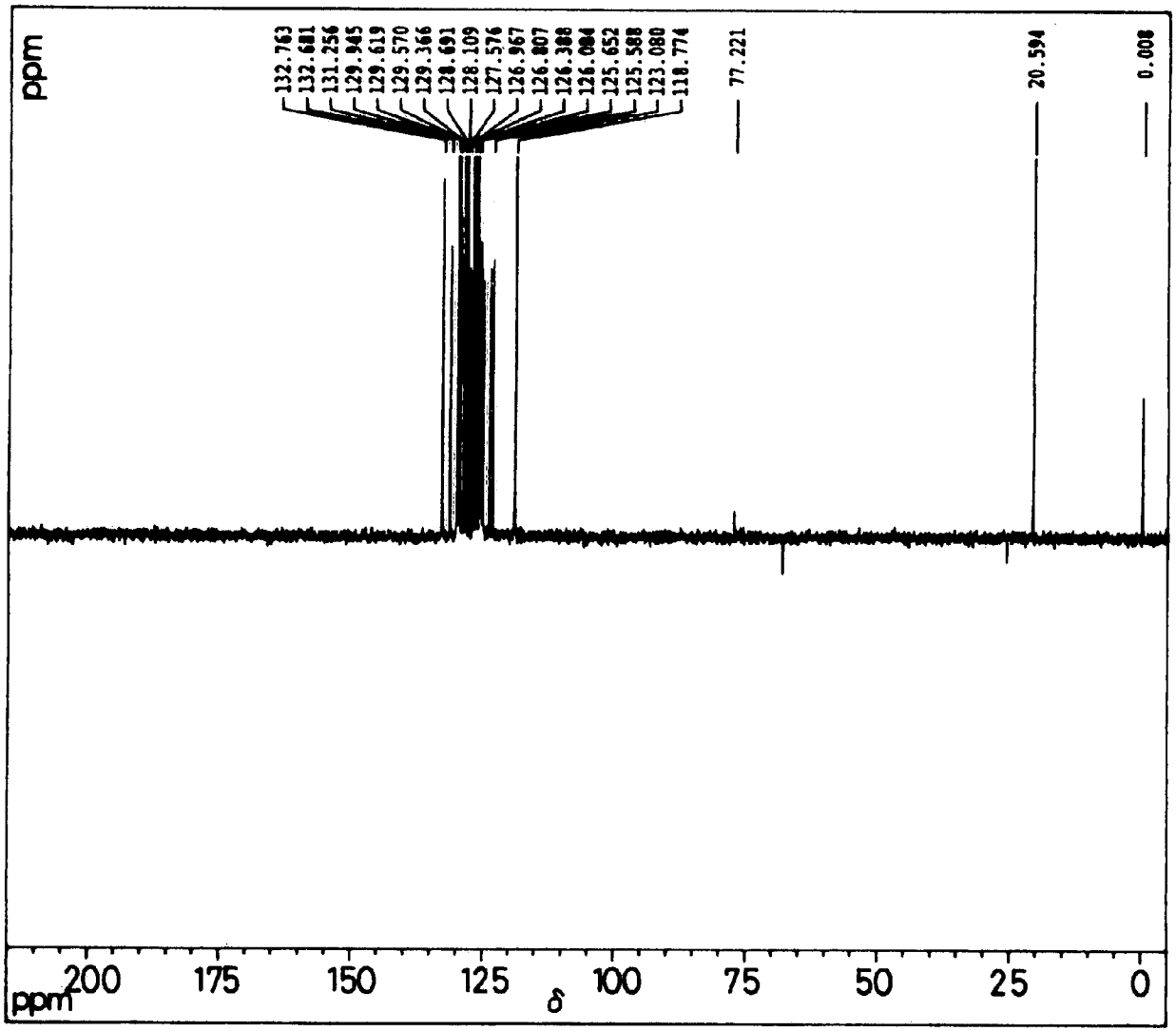
FIG. 9 is a $^{13}$C-NMR spectrum in DEPT135 measurement of the product in Production Examples 1-3.
Figure 10:
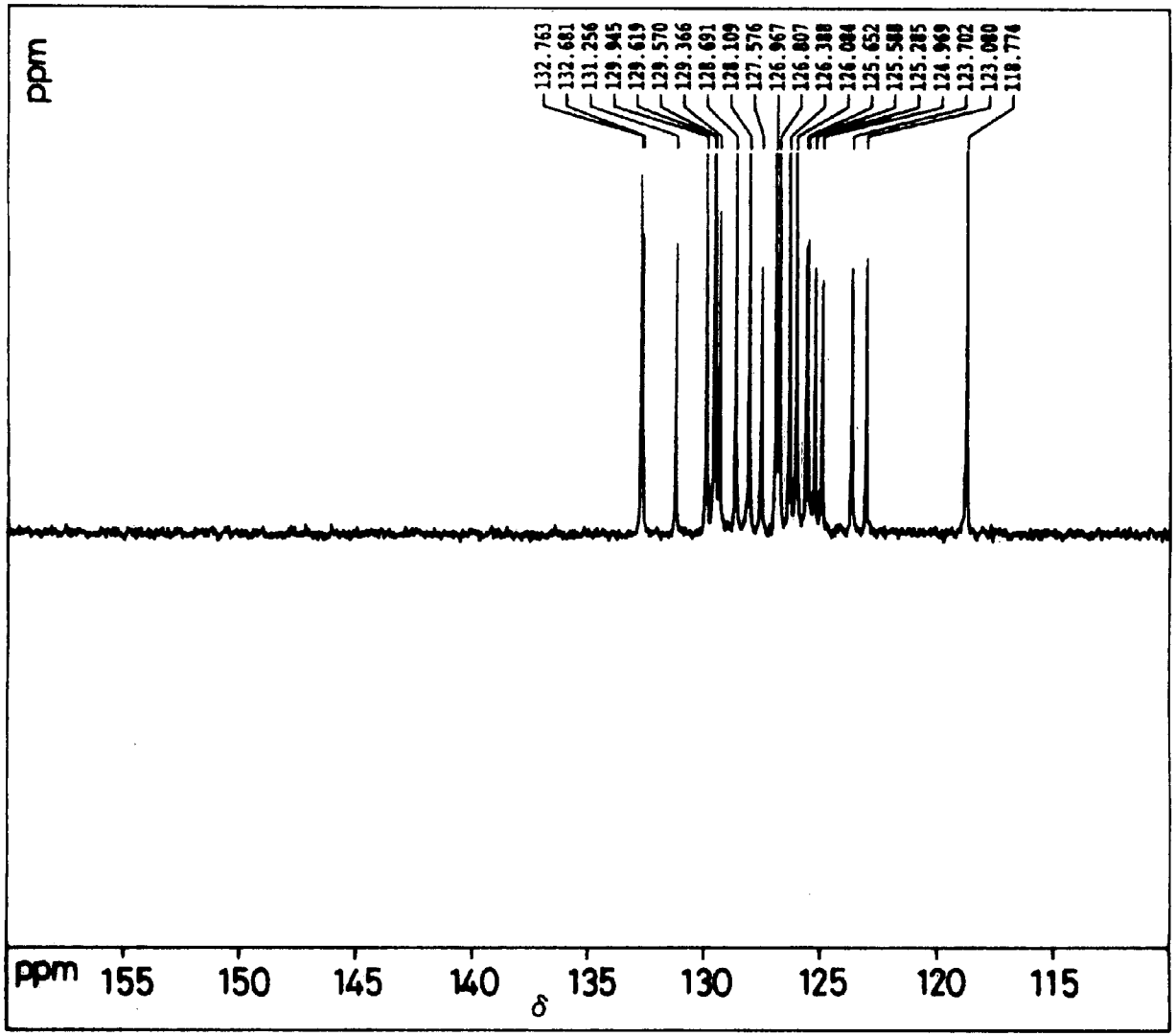
FIG. 10 is an enlarged view of the spectrum of FIG. 9 in the range of from 110 ppm to 160 ppm.

The nuclear magnetic resonance (abbreviated as NMR) spectrum of the obtained crystal in heavy chloroform (chemical formula: $CDCl_3$) was measured, and this spectrum supports the structure of the enamine compound, the Exemplified Compound No. 1. FIG. 5 is the $^1$H-NMR spectrum of the product in Production Example 1-3, and FIG. 6 is an enlarged view of the spectrum of FIG. 5 in the range of from 6 ppm to 9 ppm. FIG. 7 is the $^{13}$C-NMR spectrum in ordinary measurement of the product in Production Example 1-3, and FIG. 8 is an enlarged view of the spectrum of FIG. 7 in the range of from 110 ppm to 160 ppm. FIG. 9 is the $^{13}$C-NMR spectrum in DEPT135 measurement of the product in Production Example 1-3, and FIG. 10 is an enlarged view of the spectrum of FIG. 9 in the range of from 110 ppm to 160 ppm. Note that in FIG. 5 to FIG. 10, the horizontal axis indicates the chemical shift δ (ppm). Further, in FIG. 5 and FIG. 6, the data written between the signals and the horizontal axis are relative integral values of the signals based on the integral value, 3, of the signal indicated by the reference numeral 500 in FIG. 5.

The analysis of LC-MS and the NMR spectrometry confirmed that the obtained crystal was the enamine compound, the Exemplified Compound No. 1 (yield: 94%). In addition, the analysis of LC-MS further confirmed that the purity of the obtained enamine compound, the Exemplified Compound No. 1 was 99.8%.

As described above, the Wittig-Horner reaction of the enamine-aldehyde intermediate represented by the structural formula (11) and diethyl cinnamylphosphonate which is the Wittig reagent, represented by the structural formula (12) gave the enamine compound, the Exemplified Compound No. 1 shown in Table 1.

Production Example 2

Production of Exemplified Compound No. 61

In the same manner as in Production Example 1 except that 4.9 g (1.0 equivalent) of N-(p-methoxyphenyl)-α-naphthylamine was used in place of 23.3 g (1.0 equivalent) of N-(p-tolyl)-α-naphthylamine represented by the structural formula (8), an enamine intermediate was produced (yield: 94%) through dehydrating condensation and an enamine-aldehyde intermediate was produced (yield: 85%) through Vilsmeier reaction, and this was further subjected to Wittig-Horner reaction so that 7.9 g of an yellow powdery compound was obtained. The equivalent relationship between the reagent and the base body used in each reaction was the same as that in Production Example 1.

The obtained compound was analyzed through LC-MS, which gave a peak at 556.7 corresponding to the molecular ion $[M+H]^+$ of the intended enamine compound which is an Exemplified Compound No. 61 shown in Table 9 (calculated molecular weight: 555.26) with a proton added thereto.

Figure 11:
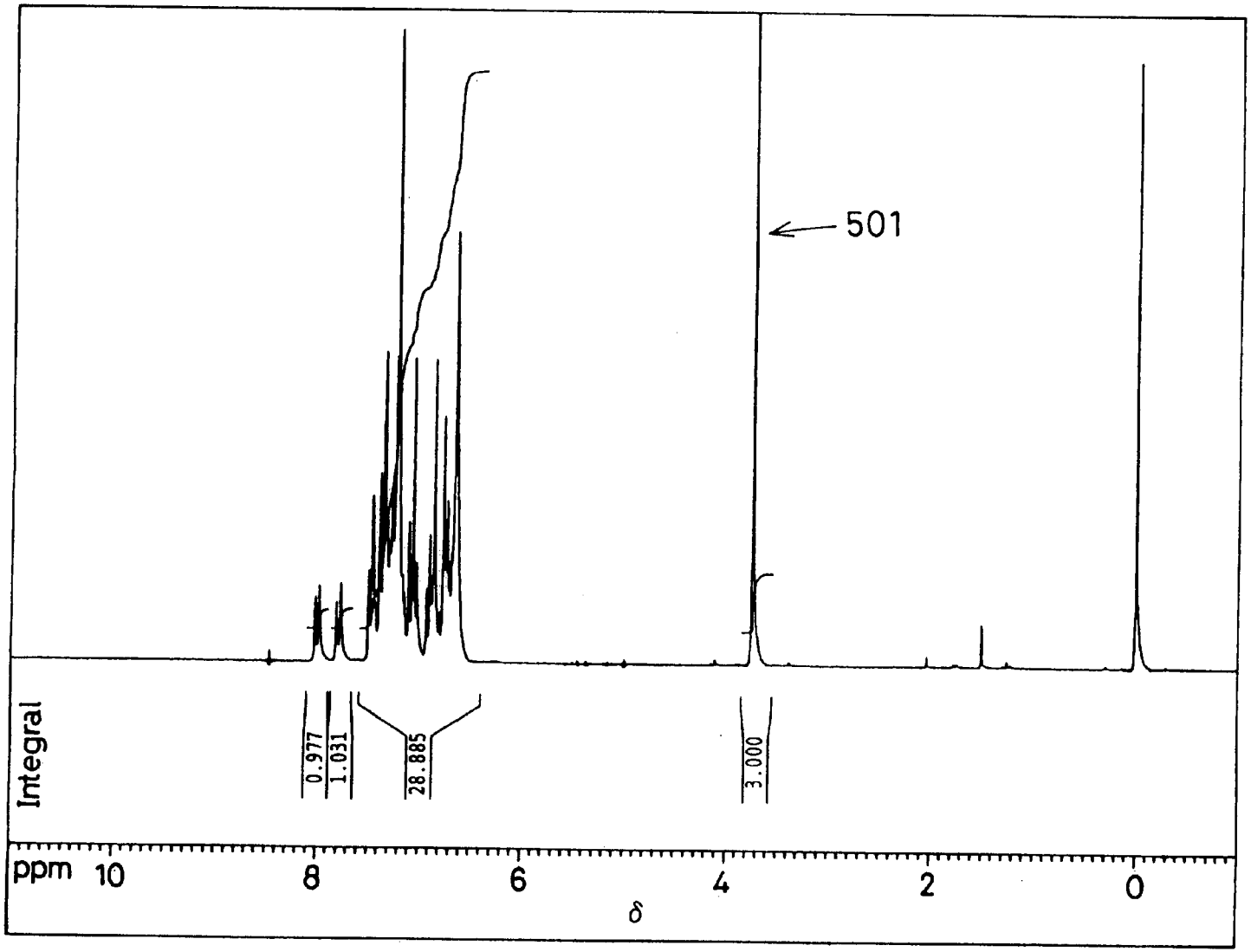
FIG. 11 is a $^{1}$H-NMR spectrum of the product in Production Example 2.
Figure 12:
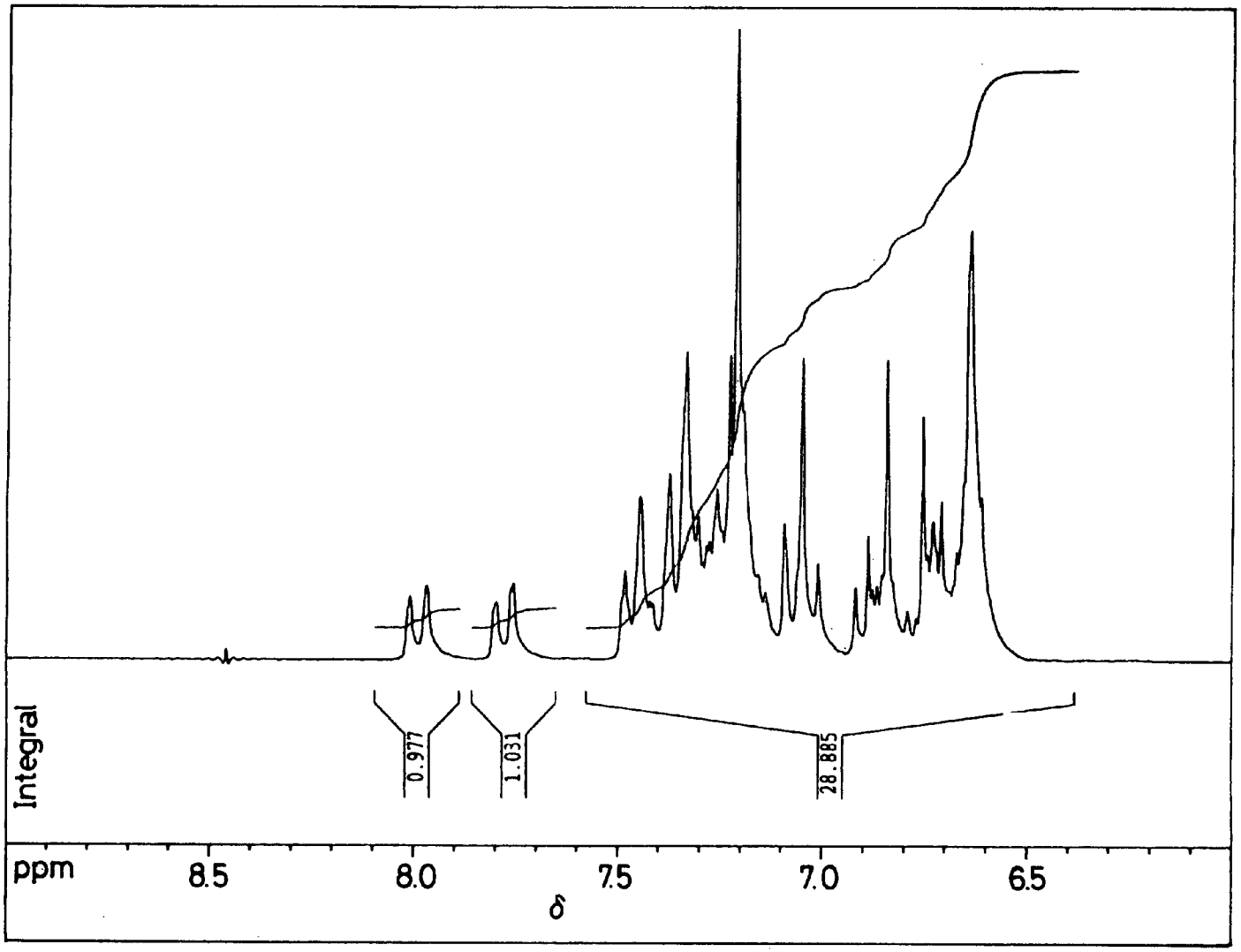
FIG. 12 is an enlarged view of the spectrum of FIG. 11 in the range of from 6 ppm to 9 ppm.
Figure 13:
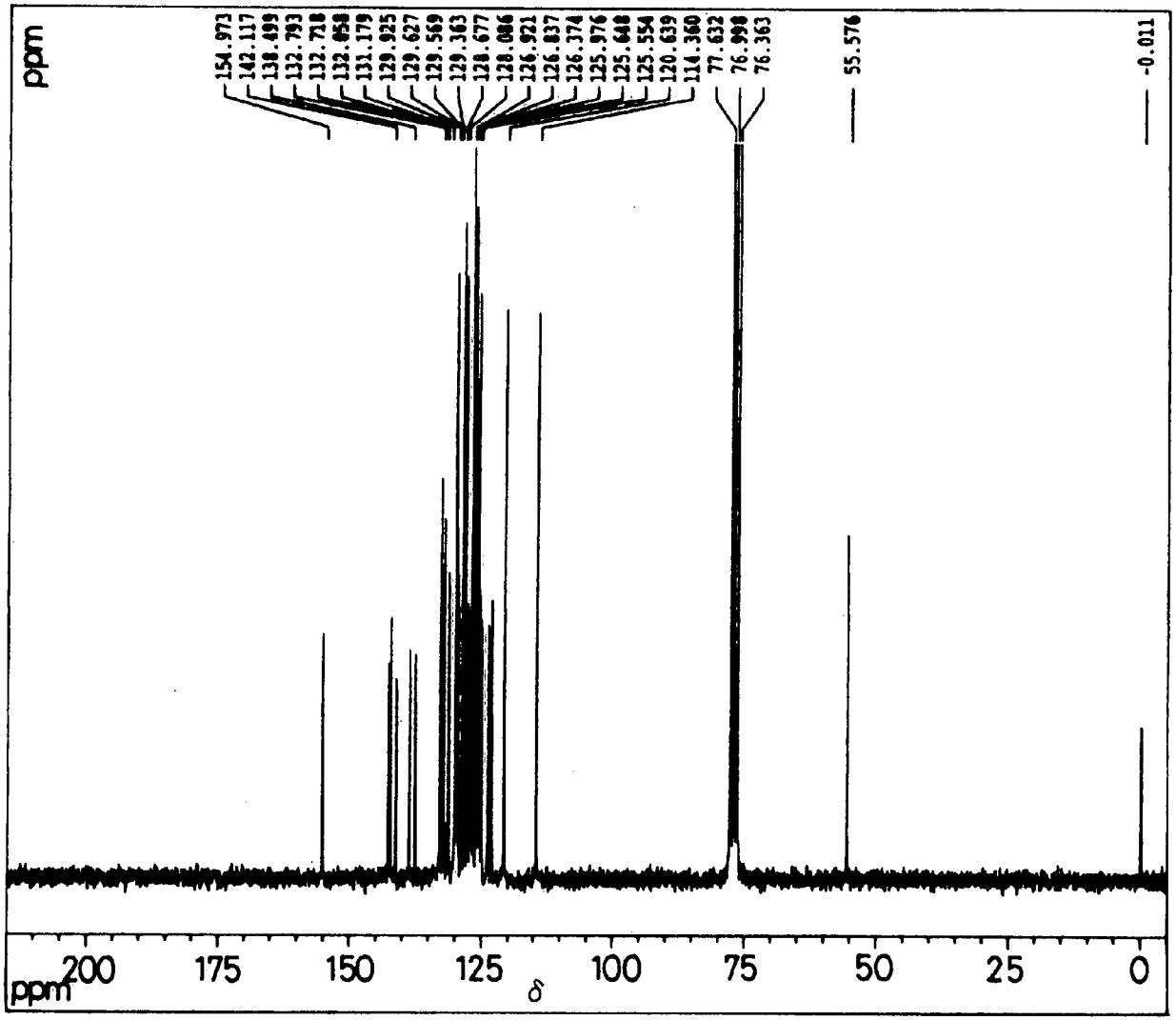
FIG. 13 is a $^{13}$C-NMR spectrum in ordinary measurement of the product in Production Example 2.
Figure 14:
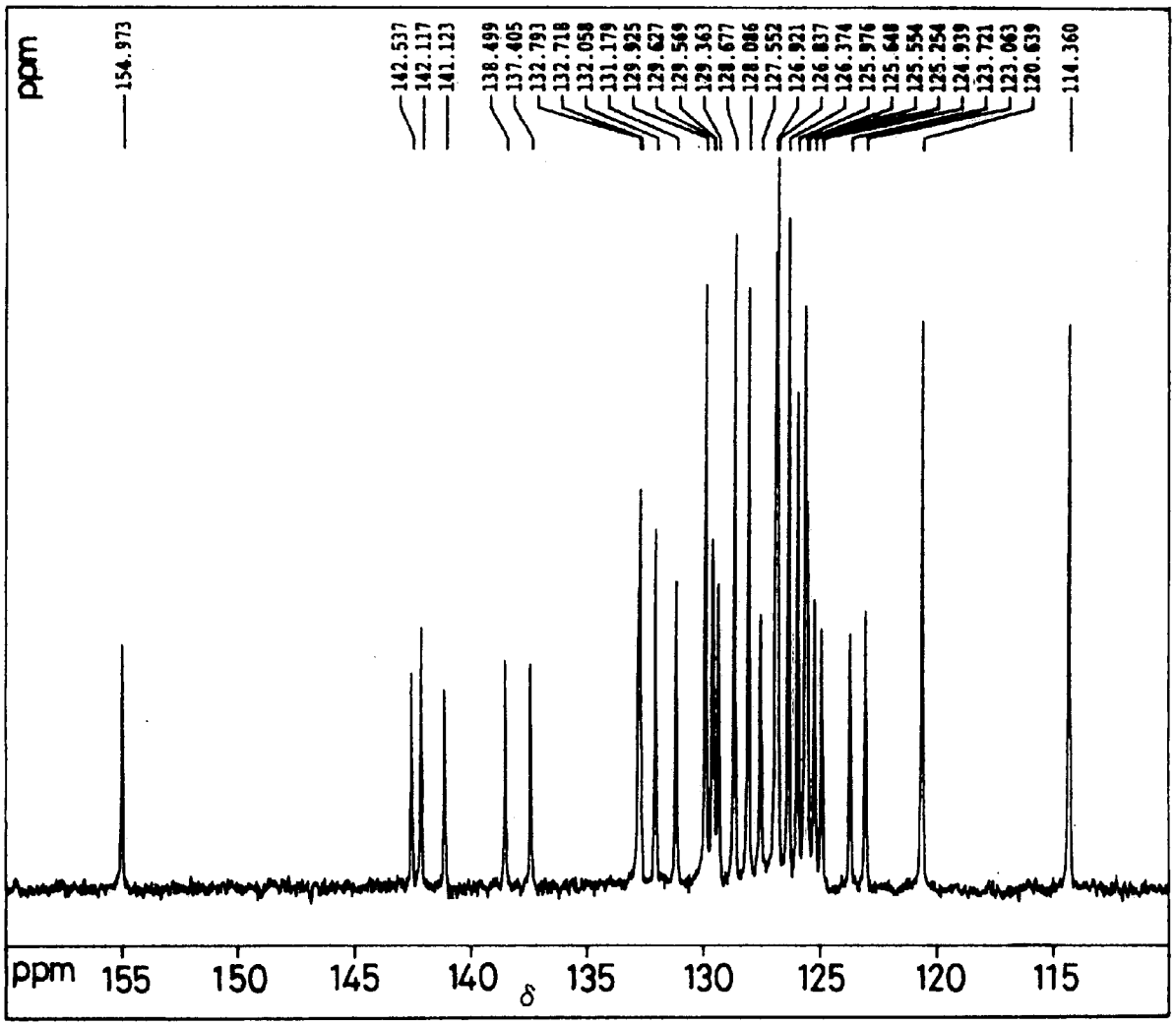
FIG. 14 is an enlarged view of the spectrum of FIG. 13 in the range of from 110 ppm to 160 ppm.
Figure 15:
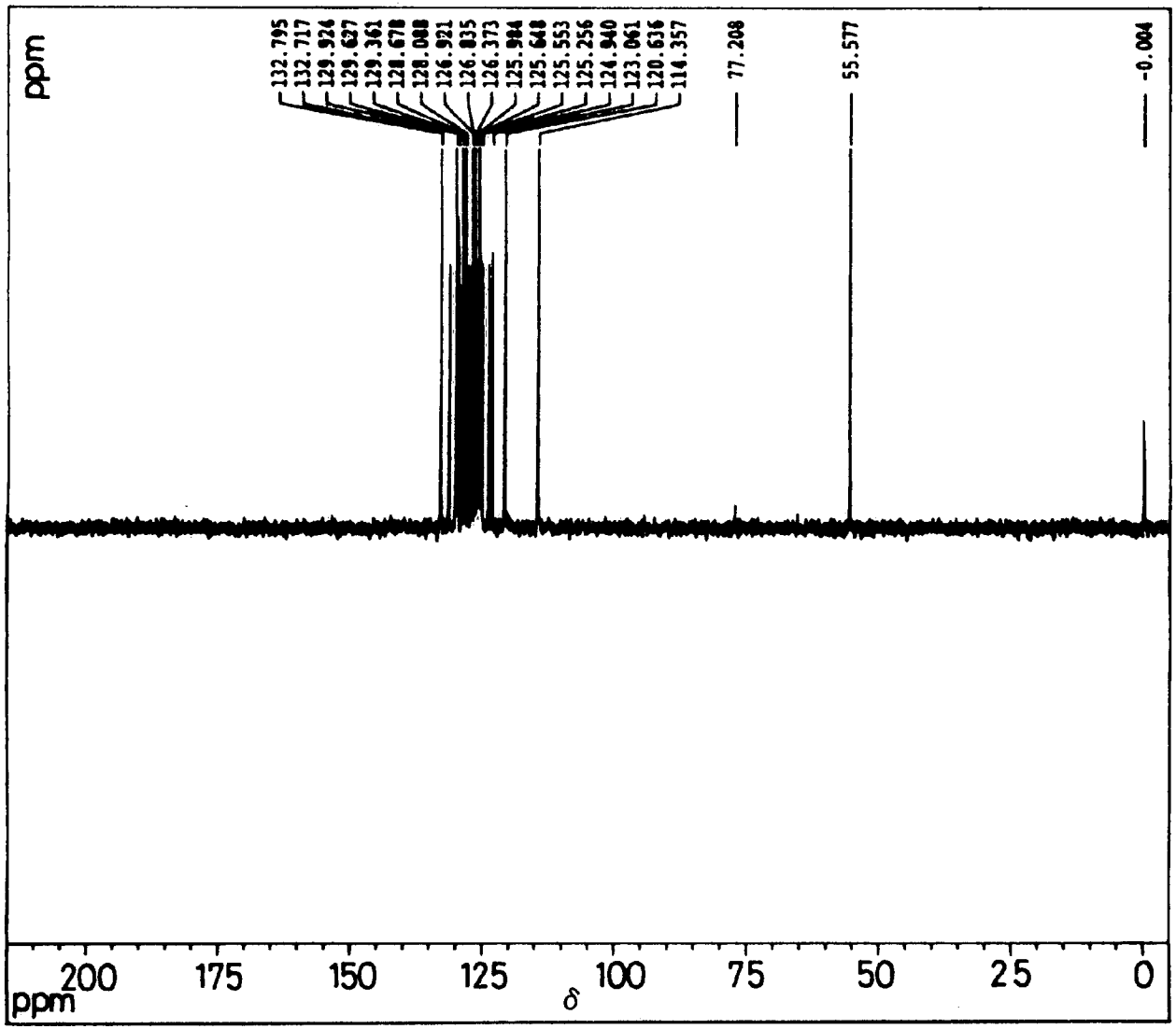
FIG. 15 is a $^{13}$C-NMR spectrum in DEPT135 measurement of the product in Production Example 2.
Figure 16:
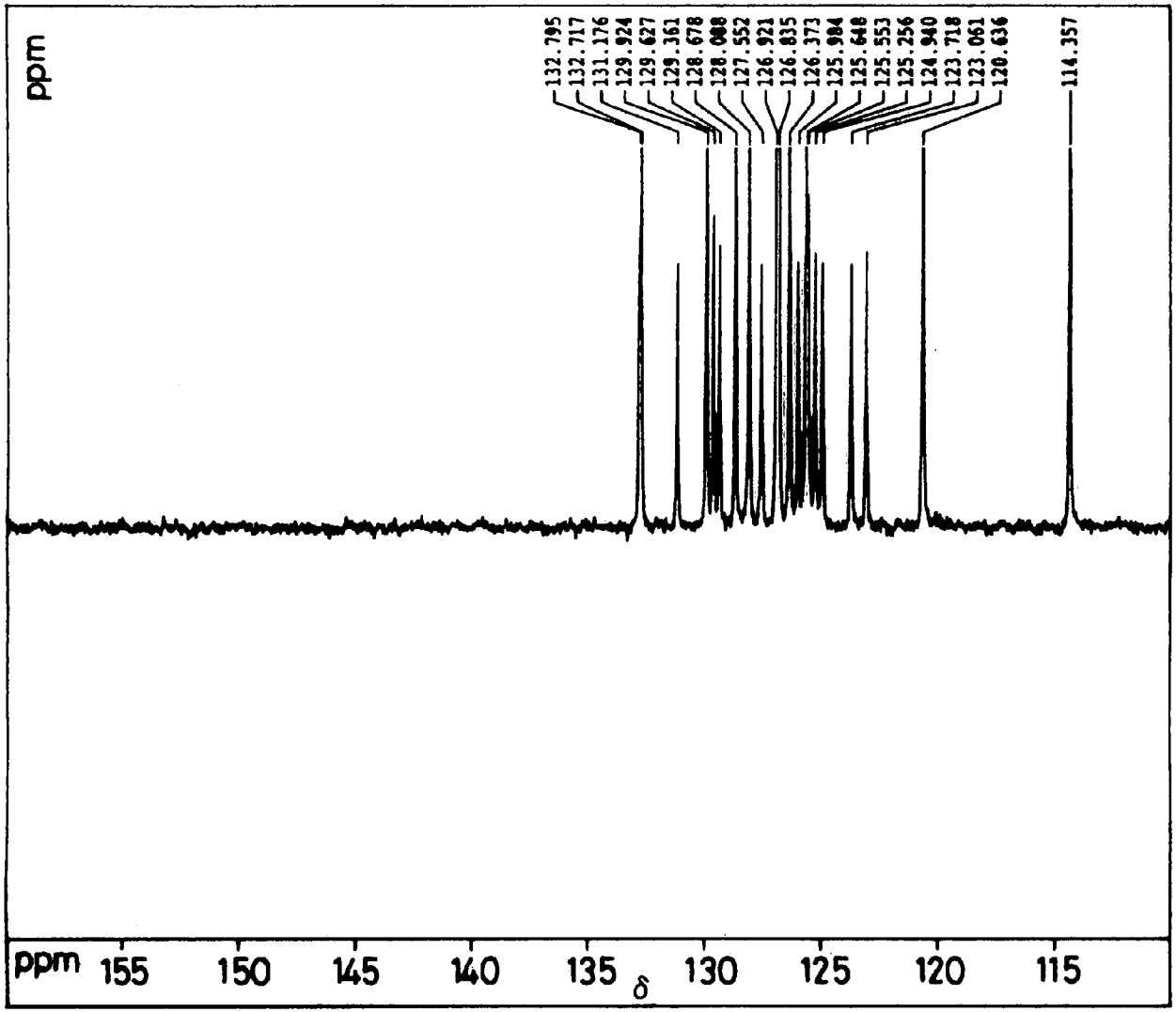
FIG. 16 is an enlarged view of the spectrum of FIG. 15 in the range of from 110 ppm to 160 ppm.

The NMR spectrum of the obtained compound in heavy chloroform ($CDCl_3$) was measured, and this spectrum supports the structure of the enamine compound, the Exemplified Compound No. 61. FIG. 11 is the $^1$H-NMR spectrum of the product in this Production Example 2, and FIG. 12 is an enlarged view of the spectrum of FIG. 11 in the range of from 6 ppm to 9 ppm. FIG. 13 is the $^{13}$C-NMR spectrum in ordinary measurement of the product in Production Example 2, and FIG. 14 is an enlarged view of the spectrum of FIG. 13 in the range of from 110 ppm to 160 ppm. FIG. 15 is the $^{13}$C-NMR spectrum in DEPT135 measurement of the product in Production Example 2, and FIG. 16 is an enlarged view of the spectrum of FIG. 15 in the range of from 110 ppm to 160 ppm. In FIG. 11 to FIG. 16, the horizontal axis indicates the chemical shift δ (ppm). In FIG. 11 and FIG. 12, the data written between the signals and the horizontal axis are relative integral values of the signals based on the integral value, 3, of the signal indicated by the reference numeral 501.

The analysis of LC-MS and the NMR spectrometry confirmed that the obtained compound was the enamine compound, the Exemplified Compound No. 61 (yield: 92%). In addition, the analysis of LC-MS further confirmed that the purity of the enamine compound, the obtained Exemplified Compound No. 61 was 99.0%.

As described above, the three-stage reaction process that comprises dehydrating condensation, Vilsmeier reaction and Wittig-Horner reaction gave the enamine compound, the Exemplified Compound No. 61 shown in Table 9, and the overall three-stage yield of the product was 73.5%.

Production Example 3

Production of Exemplified Compound No. 46

2.0 g (1.0 equivalent) of the enamine-aldehyde intermediate obtained in Production Example 1-2, which is represented by the structural formula (11), and 1.53 g (1.2 equivalents) of a Wittig reagent of the following structural formula (13) were dissolved in 15 ml of anhydrous DMF, and 0.71 g (1.25 equivalents) of potassium t-butoxide was gradually added to the solution at room temperature, then heated up to 50° C., and stirred for 5 hours while heated so as to keep 50° C. The reaction mixture was left cooled, and poured into excess methanol. The deposit was collected, and dissolved in toluene to prepare a toluene solution thereof. The toluene solution was transferred into a separating funnel and washed with water, and the organic layer was taken out. The taken-out organic layer was dried with magnesium sulfate. Solid matter was removed from the thus-dried organic layer, which was then concentrated and subjected to silica gel column chromatography so that 2.37 g of an yellow crystal was obtained.

(13)

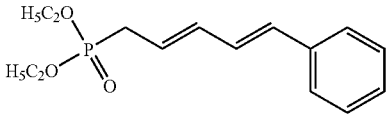

The obtained crystal was analyzed through LC-MS, which gave a peak at 566.4 corresponding to the molecular ion $[M+H]^+$ of the intended enamine compound which is an Exemplified Compound No. 46 shown in Table 7 (calculated molecular weight: 565.28) with a proton added thereto. This confirmed that the obtained crystal was the enamine compound, the Exemplified Compound No. 46 (yield: 92%). In addition, the analysis of LC-MS further confirmed that the purity of the enamine compound, the Exemplified Compound No. 46 was 99.8%.

As described above, the Wittig-Horner reaction of the enamine-aldehyde intermediate represented by the structural formula (11) and the Wittig reagent represented by the structural formula (13) gave the enamine compound, the Exemplified Compound No. 46 shown in Table 7.

Comparative Production Example 1

Production of Compound of Structural Formula (14)

2.0 g (1.0 equivalent) of the enamine-aldehyde intermediate obtained in Production Example 1-2, which is represented by the structural formula (11), was dissolved in 15 ml of anhydrous THF, and 5.23 ml (1.15 equivalents) of a THF solution (molar concentration: 1.0 mol/liter) of allylmagnesium bromide which is a Grignard reagent prepared from allyl bromide and metal magnesium was gradually added to the solution at 0° C. This was stirred at 0° C. for 0.5 hours, and then checked for the reaction progress through thin-layer chromatography, in which no definite reaction product was confirmed but some different products were found. This was post-processed, extracted and concentrated in an ordinary manner and then, the reaction mixture was isolated and purified through silica gel column chromatography.

However, the intended compound represented by the following structural formula (14) could not be obtained.

(14)

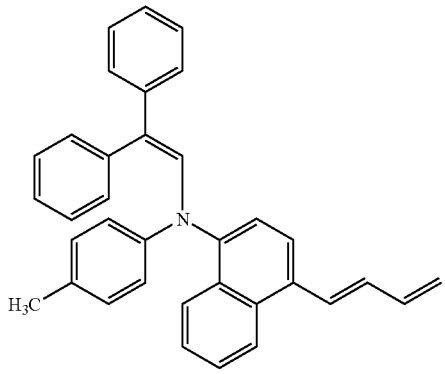

EXAMPLES

At first, description will be given to photoreceptors prepared as Examples and Comparative Examples by forming photosensitive layers under various conditions on cylindrical conductive substrates each made of aluminum, having 30 mm diameter and 346 mm length.

Example 1-4

Example 1

3 parts by weight of titanium oxide TTO-MI-1 (of dendritic rutile type which is surface-treated with $Al_2O_3$ and $ZrO_2$, containing 85% titanium component: manufactured by ISHIHARA SANGYO KAISHA LTD.) and 3 parts by weight of alcohol-soluble nylon resin CM8000 (manufactured by Toray Industries Inc.) were added to a solvent mixture of 60 parts by weight of methanol and 40 parts by weight of 1,3-dioxolane, and applied with a dispersing treatment for 10 hours by a paint shaker so that an embrocation for undercoat layer was prepared. The embrocation was filled in a coating vessel, to which the conductive support was dipped, and then pulled up and dried spontaneously so that an undercoat layer having 0.9 μm film thickness was formed.

Subsequently, 10 parts by weight of a butyral resin S-LEC BL-2 (manufactured by Sekisui Chemical Co., Ltd.), 1400 parts by weight of 1,3-dioxolane, and 15 parts by weight of titanyl phthalocyanine (in which all of $X^1$, $X^2$, $X^3$, and $X^4$ in the general formula (A) are hydrogen atoms) were applied with a dispersing treatment for 72 hours by a ball mill so that an embrocation for charge generating layer was prepared. The embrocation was coated on the previously formed undercoat layer by the same dip coating method as in the case of the undercoat layer, and dried spontaneously so that a charge generating layer having 0.2 μm film thickness was formed.

Subsequently, 100 parts by weight of the enamine compound of the Exemplified Compound No. 46 as the charge transporting substance shown in the Table 7, and as the binder resin, 48 parts by weight of polycarbonate resin J-500, 32 parts by weight of polycarbonate resin G-400, and 32 parts by weight of polycarbonate resin GH-503 (these three types are manufactured by Idemitsu Kosan Co., Ltd.), and 48 parts by weight of polycarbonate resin TS2020 (manufactured by Teijin Chemicals Ltd.), and further 5 parts by weight of Smilizer BHT (manufactured by Sumitomo Chemical Co., Ltd.) were mixed and dissolved in 980 parts by weight of tetrahydrofuran so that an embrocation for charge transporting layer was prepared. The embrocation was applied onto the previously formed charge generating layer by a dip coating method and dried at a temperature of 130° C. for 1 hour so that a charge transporting layer having 28 μm film thickness was formed. The photoreceptor of Example 1 was thus prepared.

Example 2

A photoreceptor of Example 2 was prepared in the same manner as in Example 1 except that 99 parts by weight of polycarbonate resin GK-700 (manufactured by Idemitsu Kosan Co., Ltd.) and 81 parts by weight of polycarbonate resin GH-503 (manufactured by Idemitsu Kosan Co., Ltd.) were used as the binder resin in the formation of the charge transporting layer.

Example 3

An undercoat layer and a charge generating layer were formed in the same manner as in Example 1. Subsequently, 100 parts by weight of the enamine compound of the Exemplified Compound No. 61 as the charge transporting substance shown in the Table 9, and as the binder resin, 88 parts by weight of polycarbonate resin GK-700 (manufactured by Idemitsu Kosan Co., Ltd.), and 72 parts by weight of polycarbonate resin GH-500 (manufactured by Idemitsu Kosan Co., Ltd.), and 5 parts by weight of Smilizer BHT (manufactured by Sumitomo Chemical Co., Ltd.) were dissolved in 1050 parts by weight of tetrahydrofuran so that an embrocation for charge transporting layer was prepared. By use of the embrocation, a photoreceptor of Example 3 was prepared in the same manner as in Example 1.

Example 4

A photoreceptor of Example 4 was prepared in the same manner as in Example 3 except that 99 parts by weight of polycarbonate resin GK-700 (manufactured by Idemitsu Kosan Co., Ltd.) and 81 parts by weight of polycarbonate resin GH-500 (manufactured by Idemitsu Kosan Co., Ltd.) were used as the binder resin in the formation of the charge transporting layer.

Comparative Example 1-6

Comparative Example 1

A photoreceptor of Comparative Example 1 was prepared in the same manner as in Example 3 except that 180 parts by weight of polycarbonate resin G-400 (manufactured by Idemitsu Kosan Co., Ltd.) was used as the binder resin in the formation of the charge transporting layer.

Comparative Example 2

A photoreceptor of Comparative Example 2 was prepared in the same manner as in Example 3 except that 99 parts by weight of polycarbonate resin G-503 (manufactured by Idemitsu Kosan Co., Ltd.) and 81 parts by weight of polycarbonate resin M-300 (manufactured by Idemitsu Kosan Co., Ltd.) were used as the binder resin in the formation of the charge transporting layer.

Comparative Example 3

A photoreceptor of Comparative Example 3 was prepared in the same manner as in Example 3 except that 180 parts by weight of polycarbonate resin M-300 (manufactured by Idemitsu Kosan Co., Ltd.) was used as the binder resin in the formation of the charge transporting layer.

Comparative Example 4

A photoreceptor of Comparative Example 4 was prepared in the same manner as in Example 3 except that 110 parts by weight of the enamine compound of the Exemplified Compound No. 61 was used as the charge transporting substance and polycarbonate resin G-400 (manufactured by Idemitsu Kosan Co., Ltd.) was used as the binder resin in the formation of the charge transporting layer.

Comparative Example 5

A photoreceptor of Comparative Example 5 was prepared in the same manner as in Example 3 except that 100 parts by weight of a butadiene-series compound represented by the following structural formula (15) was used as the charge transporting substance and as the binder resin, 88 parts by weight of polycarbonate resin J-500 (manufactured by Idemitsu Kosan Co., Ltd.) and 72 parts by weight of polycarbonate resin Z-200 (manufactured by Mitsubishi Gas Chemical Company, Inc.) were used in the formation of the charge transporting layer.

(15)

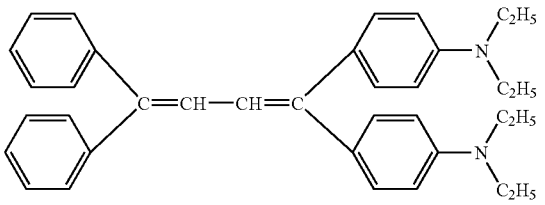

Comparative Example 6

A photoreceptor of Comparative Example 6 was prepared in the same manner as in Example 3 except that 100 parts by weight of the butadiene-series compound represented by the structural formula (15) was used as the charge transporting substance and as the binder resin, 48 parts by weight of polycarbonate resin J-500, 32 parts by weight of polycarbonate resin GF-700, 32 parts by weight of polycarbonate resin GH-503, and 48 parts by weight of polycarbonate resin M-300, (these four types are manufactured by Idemitsu Kosan Co., Ltd.) were used in the formation of the charge transporting layer.

As described above, in the preparation of each of the photoreceptors of Examples 1-4 and Comparative Examples 1-6, the creep value ($C_{IT}$) and plastic deformation hardness value (Hplast) of the photoreceptor surfaces were adjusted to desired values by changing kind and content ratio of the resin contained in the charge transporting substance and the embrocation for charge transporting layer. These $C_{IT}$ and Hplast of the photoreceptor surfaces of Examples 1-4 and Comparative Examples 1-6 were measured by a fisherscope H100 (manufactured by Fisher Instrumentation Ltd.) under circumstances of temperature of 25° C. and relative humidity of 50%. A measurement condition was such that the indentation maximum load Fmax was 30 mN, that the required loading time up to the indentation maximum load was 10 seconds, that the load-holding time t was 5 seconds, and that the charge-eliminating time was 10 seconds.

Evaluation tests for durability and electric characteristics were conducted through image formation with each of the photoreceptors of Examples 1-4 and Comparative Examples 1-6 attached to a copying machine AR-450 (manufactured by Sharp Co., Ltd.) having a non-contact charging process which is converted for test, in which image formation a pure toner for AR-450 was used. Note that the photoreceptor surface was charged by a negatively charging process. Next, a description will be given to an evaluation method for each of performances.

[Durability]

(Printing Durability)

An abutting pressure at which a cleaning blade of a cleaner provided in the copying machine AR-450 abuts against the photoreceptor, i.e., a so-called cleaning blade pressure, was adjusted to 21 gf/cm ($2.06\times10^{-1}$ N/cm) of an initial linear pressure. By use of the copying machine under circumstances of temperature of 25° C. and relative humidity of 50%, the printing durability test was conducted by forming a character test chart manufactured by Sharp Co., Ltd. onto 100,000 sheets of recording paper at every photoreceptor.

A film thickness at the beginning of printing durability test and a film thickness after the chart formation onto 100,000 sheets of recording paper, that is to say, a film thickness of the photosensitive layer were measured by use of an instant optical multichannel Analyser system MCPD-1100 (manufactured by Otsuka Electronics Co., Ltd.) through optical interferometry. A film loss per 100,000 revolutions of a photoreceptor drum was obtained from a difference between the film thickness at the beginning of printing durability test and the film thickness after the chart formation onto 100,000 sheets of recording paper. As the film loss is larger, it is evaluated that the printing durability was worse.

(Stability of Image Quality)

In the copying machine equipped with the photoreceptors, after the chart formation onto 100,000 sheets of recording paper, a half-tone image was further formed. By visually observing this half-tone image, density unevenness of the image was detected so that a level of image deterioration caused by the photoreceptors after the printing durability test, that is, the stability of image quality was evaluated.

The evaluation standards for the density unevenness are as follows.

○: good. The half-tone image has no density unevenness.

Δ: a non-problematic level on practical use. The half-tone image has minor density unevenness.

X: a problematic level on practical use. The half-tone image has density unevenness.

Further, the durability of the photoreceptor was determined by the film loss and the density unevenness of the half-tone image in combination. The determination standards for the durability are as follows.

◎: very good. The film loss was less than 1.0 μm and no density unevenness was found.

○: good. The film loss was 1.0 μm or more and 2.0 μm or less, and no density unevenness was found.

Δ: somewhat poor. The film loss exceeds 2.0 μm, or minor density unevenness was found.

X: poor. The film loss exceeds 2.0 μm and minor density unevenness was found, or density unevenness was found.

[Electric Characteristics]

Inside the copying machine is provided a surface electrometer (CATE751: manufactured by Gen-Tech, Inc.) so that the surface potential of the photoreceptor in the image formation process can be measured. By use of the copying machine, the surface potential of the photoreceptor right after charging operation through the charger was measured as a charged potential V0(V) under a Normal temperature/Normal humidity (N/N) circumstance at a temperature of 22° C. and at a relative humidity of 60%. Further, the surface potential of a photoreceptor right after application of exposure to the laser light was measured as a residual potential VL(V), and it was defined as a residual potential $VL_N$ under the N/N circumstance. As the absolute value of the charged potential V0 was larger, it was evaluated that the chargeability was more excellent. As the absolute value of the exposure potential $VL_N$ was smaller, it was evaluated that the light responsiveness was more excellent.

Further, under a Low temperature/Low humidity (L/L) circumstance at a temperature of 5° C. and at a relative humidity of 20%, the residual potential VL(V) was measured in the same manner as under the N/N circumstance, and it was defined as the residual potential $VL_L$ under the L/L circumstance. The absolute value of the difference between the residual potential $VL_N$ under the N/N circumstance and the residual potential $VL_L$ under the L/L circumstance was determined as: potential fluctuation $\Delta VL(=|VL_L-VL_N|)$. As the potential fluctuation ΔVL was smaller, it was evaluated that the stability of electric characteristics was excellent.

Further, the electric characteristics of the photoreceptor were determined by the charged potential V0 and exposure potential $VL_N$ under the N/N circumstance, and the potential fluctuation ΔVL in combination. The determination standards for the durability are as follows.

◎: very good. The absolute value of $VL_N$ is less than 35V and ΔVL is less than 85V.

○: good. The absolute value of $VL_N$ is less than 35V and ΔVL is 85V or more and less than 95V.

Δ: somewhat poor. The absolute value of $VL_N$ is 35V or more and less than 50V and ΔVL is less than 85V.

X: poor. The absolute value of $VL_N$ is 35V or more and less than 50V and ΔVL is 85V or more, or the absolute value of $VL_N$ is 50V or more, or ΔVL is 95V or more, or the absolute value of V0 is less than 600V.

[Overall Determination]

Further, the determined result of durability and the determined result of electric characteristics were combined to conduct an overall determination of photoreceptor performance. The determination standards for the overall determination are as follows.

◎: very good. With durability "◎" and electric characteristics "◎".

○: good. With durability "◎" and electric characteristics "○", or with durability "○" and electric characteristics "◎". Δ: somewhat poor. With durability "◎" and electric characteristics "Δ", or with durability "Δ" and electric characteristics "◎", or with durability "○" and electric characteristics "○".

X: poor. With durability "Δ" and electric characteristics "○" or "Δ", or with durability "○" or "Δ" and electric characteristics "Δ", or with durability "X", or with electric characteristics "X".

The above-described evaluation results will be all shown in Table 33.

TABLE 33

| | Property Value | | Charge | Durability | | |
|---|---|---|---|---|---|---|
| | $C_{IT}$ (%) | Hplast ($N/mm^2$) | Transporting Substance | Film Loss (μm/100,000 Rev.) | Density Unevenness (after printing durability test on 100,000 sheets) | Determination |
| Example 1 | 2.88 | 244.2 | Exemplified Compound 46 | 1.43 | ○ | ○ |
| Example 2 | 3.18 | 253.8 | Exemplified Compound 46 | 0.66 | ○ | ◎ |
| Example 3 | 2.96 | 246.6 | Exemplified Compound 61 | 1.32 | ○ | ○ |
| Example 4 | 3.24 | 255.2 | Exemplified Compound 61 | 0.45 | ○ | ◎ |
| Comp. Example 1 | 2.61 | 230.5 | Exemplified Compound 61 | 2.26 | ○ | Δ |
| Comp. Example 2 | 3.35 | 277.7 | Exemplified Compound 61 | 0.53 | Δ | Δ |
| Comp. Example 3 | 3.49 | 350.6 | Exemplified Compound 61 | 0.6 | X | X |
| Comp. Example 4 | 2.16 | 209.5 | Exemplified Compound 61 | 2.8 | Δ | X |
| Comp. Example 5 | 2.84 | 246.9 | Structural formula (15) | 1.51 | ○ | ○ |
| Comp. Example 6 | 3.29 | 226.8 | Structural formula (15) | 0.6 | ○ | ◎ |

| | Electric Characteristics | | | | |
|---|---|---|---|---|---|
| | N/N-Potential Characteristic | | L/L-Potential Fluctuation | | |
| | V0 (V) | $VL_N$ (V) | ΔVL (V) | Determination | Overall Determination |
| Example 1 | −626 | −26 | 85 | ○ | Δ |
| Example 2 | −629 | −30 | 90 | ○ | ○ |
| Example 3 | −620 | −18 | 69 | ◎ | ○ |
| Example 4 | −619 | −23 | 79 | ◎ | ◎ |
| Comp. Example 1 | −616 | −25 | 81 | ◎ | Δ |
| Comp. Example 2 | −623 | −23 | 72 | ◎ | Δ |
| Comp. Example 3 | −622 | −20 | 76 | ◎ | X |
| Comp. Example 4 | −629 | −15 | 60 | ◎ | X |
| Comp. Example 5 | −620 | −75 | 100 | X | X |
| Comp. Example 6 | −622 | −76 | 99 | X | X |

As to the durability of the photoreceptor, in the photoreceptors of Examples 1-4 and Comparative Examples 5 and 6 in each of which $C_{IT}$ was within a range of 2.70% or more and 5.00% or less and Hplast was within a range of 220 $N/mm^2$ or more and 275 $N/mm^2$ or less, the film loss was small and the printing durability was excellent, and even in the half-tone image after the printing durability test on 100,000 sheets, the density unevenness was not observed. Particularly, in the photoreceptors of Examples 2 and 4 and Comparative Example 6 in each of which $C_{IT}$ was 3.00% or more, the film loss was very small. This is considered to be reflection of the fact that the photosensitive layers which constitute the surfaces of the photoreceptors of Examples 2 and 4 and Comparative Example 6, have film flexibility typically represented by the creeping property, and moderate property in film hardness to be reflected in Hplast, which is not too soft nor exposes fragility.

In contrast, the photoreceptors of Comparative Examples 2 and 3 in each of which Hplast was larger than the range of the invention, exhibited excellent printing durability with small film loss owing to 3.00% or more of $C_{IT}$, but the density unevenness of images which is deemed to be caused by deterioration of smoothness of the photoreceptor surface, was observed. Particularly, in Comparative Example 3, Hplast was large and the film surface was hard, so that the photoreceptor was rubbed with the cleaning blade, thereby generating a large number of minute flaws along the rotation direction on the photoreceptor surface which looks like a surface of analog record, in a consequence whereof the deterioration in image quality after the printing durability test was apparent.

Further, in the photoreceptors of Comparative Examples 1 and 4 in each of which $C_{IT}$ is smaller than the range of the invention, the result was such that the film loss of the photoreceptor extremely increased. This is considered to be caused by decrease of an alleviating effect of the photoreceptor surface against abutting force of the cleaning blade owing to the small $C_{IT}$. Moreover, in the photoreceptor of Comparative Example 4, the smoothness of the photoreceptor surface was impaired after the printing durability test, and deterioration of image quality (density unevenness), although at a minor level, was found. The reason why the density unevenness was generated in the photoreceptor of Comparative Example 4 is not clear in detail, but considered as follows. That is to say, in the case of the photoreceptor of Comparative Example 4, Hplast is smaller than the range of the invention so that such a cause is conceivable as that the structural elaborateness of the film is impaired.

In the meantime, as to the electric characteristics, among the photoreceptors of Examples 1-4 and Comparative Example 5 and 6 in each of which $C_{IT}$ and Hplast were within the range of the invention, in the photoreceptors of Comparative Example 5 and 6 using the butadiene compound represented by the structural formula (15) as the charge transporting substance, good result could not be obtained.

In contrast, in the photoreceptors of Examples 1-4 in each of which the enamine compound represented by the general formula (1) was used as the charge transporting substance, regardless of the kind of the polycarbonate resin used as the binder resin, the result was obtained that the absolute value of the residual potential $VL_N$ under the N/N circumstance was small and the light responsiveness was excellent. Moreover, it was found that in the photoreceptors of Examples 1-4, the potential fluctuation ΔVL was small and sufficient light responsiveness was obtained even under L/L circumstance.

Further, by comparison between Examples 1, 2 and Examples 3, 4, it was found that compared to the photoreceptors of Examples 1 and 2 using the Exemplified Compound No. 46 as the charge transporting substance, the photoreceptors of Examples 3 and 4 using the Exemplified Compound No. 61 as the charge transporting substance had smaller absolute value of the residual potential $VL_N$ and potential fluctuation ΔVL, and excellent light responsiveness. This indicates that, of the enamine compounds represented by the general formula (1), the enamine compound represented by the general formula (2) is used so that the photoreceptor having particularly high light responsiveness can be obtained.

As described above, by use of the enamine compound represented by the general formula (1) as the charge transporting substance and setting the surface property so that $C_{IT}$ is 2.70% or more and 5.00% or less and Hplast is 220 N/mm$^2$ and more and 275 N/mm$^2$ or less, it was possible to obtain a highly reliable electrophotographic photoreceptor having excellent electric characteristics such as chargeability and light responsiveness which are electric characteristics, the electric characteristics being not deteriorated even by change of circumstance, with an excellent life duration of abrasion resistance so that no flaw and density unevenness are generated on a to-be-formed image for a long period of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, the photosensitive layer of the electrophotographic photoreceptor contains the enamine compound represented by the general formula (1), preferably the general formula (2) as the charge transporting substance. Further, the surface property of the electrophotographic photoreceptor is set so that a creep value ($C_{IT}$; hereinafter noted simply as $C_{IT}$) in a case where a maximum indentation load of 30 mN is put on the surface for 5 seconds under circumstances of temperature of 25° C. and relative humidity of 50%, is 2.70% or more and 5.00% or less, preferably 3.00% or more and 5.00% or less, and a plastic deformation hardness value (Hplast; hereinafter noted simply as Hplast) of the surface is 220 N/mm$^2$ or more and 275 N/mm$^2$ or less The enamine compound represented by the general formula (1) has a high charge transporting ability. Further, of the enamine compounds represented by the general formula (1), the enamine compound represented by the general formula (2) has a particularly high charge transporting ability. Accordingly, incorporation of the enamine compound represented by the general formula (1), preferably the general formula (2), into the photosensitive layer makes it possible to obtain the electrophotographic photoreceptor having high sensitivity and excellent light responsiveness and chargeability, these electric characteristics being not deteriorated even by any of exposure to light and change of circumstance nor by repetitive use.

Further, by setting the surface property of the electrophotographic photoreceptor as described above, the flexibility of the film which forms the surface layer of the electrophotographic photoreceptor is maintained, and the film can be brought to a preferable state of having not too soft plasticity nor being fragile. Accordingly, even on use for a long period of time that charging, exposure, development, transfer, cleaning, and charge elimination for the image formation are conducted repetitively, the film loss is reduced and moreover, a reduced number of flaws are generated on the film so that smoothness of the photoreceptor surface is maintained, thereby preventing flaws and density unevenness from being generated on a to-be-formed image.

That is to say, by incorporating the enamine compound represented by the general formula (1), preferably the general formula (2) into the photosensitive layer and setting the surface property as described above, it is possible to obtain the highly reliable electrophotographic photoreceptor having high sensitivity and excellent light responsiveness and chargeability which are electric characteristics, the electric characteristics being not deteriorated even by any of exposure to light and change of circumstance nor by repetitive use, with an excellent life duration of abrasion resistance so that no flaw and density unevenness are generated on a to-be-formed image for a long period of time.

Further, according to the invention, in the photosensitive layer of the electrophotographic photoreceptor, the enamine compound represented by the general formula (1), preferably general formula (2), and the titanyl phthalocyanine compound are used in combination. This makes it possible to obtain the electrophotographic photoreceptor having a particularly good sensitivity characteristics, charging characteristics, and image reproducibility.

According to the invention, the photosensitive layer of the electrophotographic photoreceptor is constituted by lamination of the charge generating layer containing the charge generating substance, and the charge transporting layer containing the charge transporting substance. By forming the photosensitive layer into the lamination type that plural layers are laminated as described above, the degree of freedom for the materials constituting each of the layers and the combination thereof is increased, so that it becomes easier to set $C_{IT}$ and Hplast of the electrophotographic photoreceptor within the desired range. Further, by allotting the charge generating function and the charge transporting function on separate layers as described above, it becomes possible to select an optimal material for each of the charge generating function and the charge transporting function as a material constituting each layer and therefore, the photoreceptor having particularly good sensitivity characteristics, charging characteristics, and image reproducibility can be obtained.

Further, according to the invention, provided is the electrophotographic photoreceptor having excellent electric characteristics such as sensitivity characteristic, light responsiveness, and chargeability which are not deteriorated even by change of circumstance nor by repetitive use, with an excellent life duration of abrasion resistance and flaw resistance, so that realized is the highly reliable image forming apparatus which can provide images of good quality having no flaw and density unevenness for a long period of time under various circumstances. Moreover, the electric characteristics of the electrophotographic photoreceptor are not deteriorated by exposure to light, so that deterioration of image quality caused by exposure of the electrophotographic photoreceptor to the light at the time of maintenance or the like is suppressed.

The invention claimed is:

1. An electrophotographic photoreceptor comprising:

a conductive substrate; and a photosensitive layer disposed on the conductive substrate, containing a charge generating substance and a charge transporting substance, wherein the charge transporting substance contains an enamine compound represented by the following general formula (1), and in a case where a maximum indentation load of 30 mN is put on a surface for 5 seconds under circumstances of temperature of 25° C. and relative humidity of 50%, a creep value ($C_{IT}$) is 2.70% or more and 5.00% or less and a plastic deformation hardness value (Hplast) of the surface is 220 N/mm$^2$ or more and 275 N/mm$^2$ or less, (1)

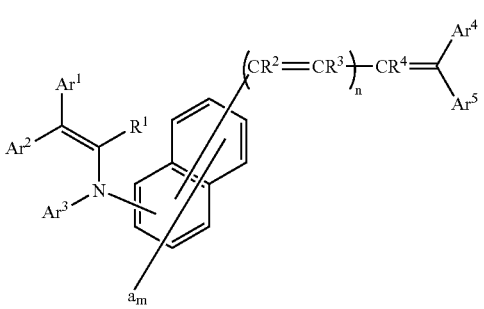

wherein $Ar^1$ represents an aryl group which may have a substituent or a heterocyclic group which may have a substituent; $Ar^2$ represents an aryl group which may have a substituent or a heterocyclic group which may have a substituent; $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have ha substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent.

2. The electrophotographic photoreceptor of claim 1, wherein the enamine compound represented by the general formula (1) is an enamine compound represented by the following general formula (2), (2)

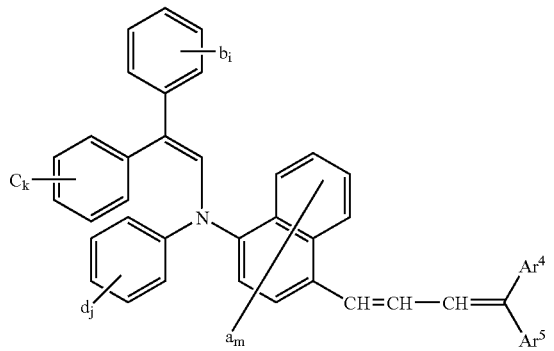

wherein b, c and d each represent an alkyl group which may have a substituent, an alkoxy group which may have a substituent, a dialkylamino group which may have a substituent, an aryl group which may have a substituent, a halogen atom, or a hydrogen atom; i, k and j each indicate an integer of from 1 to 5; when i is 2 or more, then the "b"s may be the same or different and may bond to each other to form a cyclic structure; when k is 2 or more, then the "c"s may be the same or different and may bond to each other to form a cyclic structure; and when j is 2 or more, then the "d"s may be the same or different and may bond to each other to form a cyclic structure; $Ar^4$, $Ar^5$, "a" and "m" represent the same as those defined in formula (1).

3. The electrophotographic photoreceptor of claim 1 or 2, wherein the creep value ($C_{IT}$) is 3.00% or more and 5.00% or less.

4. The electrophotographic photoreceptor of claim 1, wherein the charge generating substance contains a titanylphthalocyanine compound.

5. The electrophotographic photoreceptor of claim 1, wherein the photosensitive layer is constituted by lamination of a charge generating layer containing the charge generating substance and a charge transporting layer containing the charge transporting substance.

6. An image forming apparatus comprising:

the electrophotographic photoreceptor of claim 1;

charging means for charging a surface of the electrophotographic photoreceptor;

exposure means for exposing the charged surface of the electrophotographic photoreceptor to light according to image information thereby forming an electrostatic latent image;

developing means for developing the electrostatic latent image to form a toner image;

transfer means for transferring the toner image from the surface of the electrophotographic photoreceptor to a transfer member; and cleaning means for cleaning the surface of the electrophotographic photoreceptor after transfer of the toner image.

7. An electrophotographic photoreceptor comprising:

a conductive substrate; and a photosensitive layer disposed on the conductive substrate, containing a charge generating substance and a charge transporting substance, wherein the photosensitive layer comprises a charge generating layer and a charge transporting layer on the charge generating layer, the charge transporting layer containing the charge transporting substance and a binder resin, the binder resin containing at least two separate polycarbonate resins, and wherein the charge transporting substance contains an enamine compound represented by the following general formula (1), and in a case where a maximum indentation load of 30 mN is put on a surface for 5 seconds under circumstances of temperature of 25° C. and relative humidity of 50%, a creep value ($C_{IT}$) is 2.70% or more and 5.00% or less and a plastic deformation hardness value (Hplast) of the surface is 220 N/mm$^2$ or more and 275 N/mm$^2$ or less,

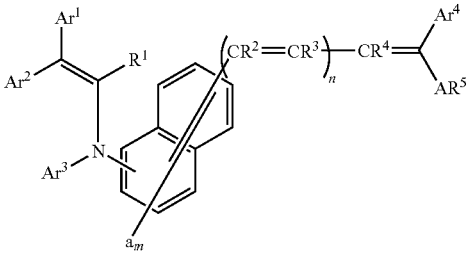

wherein $Ar^1$ represents an aryl group which may have a substituent or a heterocyclic group which may have a substituent; $Ar^2$ represents an aryl group which may have a substituent or a heterocyclic group which may have a substituent: $Ar^3$ represents an aryl group which may have a substituent, a heterocyclic group which may have a substituent, an aralkyl group which may have a substituent, or an alkyl group which may have a substituent; $Ar^4$ and $Ar^5$ each represent a hydrogen atom, an aryl group which may have a substituent, a heterocyclic group which may have a substituent, an aralkyl group which may have a substituent, or an alkyl group which may have a substituent, but it is excluded that $Ar^4$ and $Ar^5$ are hydrogen atoms at the same time; $Ar^4$ and $Ar^5$ may bond to each other via an atom or an atomic group to form a cyclic structure; "a" represents an alkyl group which may have a substituent, an alkoxy group which may have a substituent, a dialkylamino group which may have a substituent, an aryl group which may have a substituent, a halogen atom, or a hydrogen atom; m indicates an integer of from 1 to 6; when m is 2 or more, then the "a"s may be the same or different and may bond to each other to form a cyclic structure; $R^1$ represents a hydrogen atom, a halogen atom, or an alkyl group which may have a substituent; $R^2$, $R^3$ and $R^4$ each represent a hydrogen atom, an alkyl group which may have a substituent, an aryl group which may have a substituent, a heterocyclic group which may have a substituent, or an aralkyl group which may have a substituent; n indicates an integer of from 0 to 3; when n is 2 or 3, then the $R^2$s may be the same or different and the $R^3$s may be the same or different, but when n is 0, $Ar^3$ is a heterocyclic group which may have a substituent.

* * * * *